US008237653B2

(12) United States Patent
Maeda et al.

(10) Patent No.: US 8,237,653 B2
(45) Date of Patent: Aug. 7, 2012

(54) ELECTROPHORETIC DISPLAY DEVICE, METHOD OF DRIVING ELECTROPHORETIC DEVICE, AND ELECTRONIC APPARATUS

(75) Inventors: Hiroshi Maeda, Hara-mura (JP); Yasuhiro Shimodaira, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 1076 days.

(21) Appl. No.: 12/077,039

(22) Filed: Mar. 15, 2008

(65) Prior Publication Data

US 2008/0238867 A1 Oct. 2, 2008

(30) Foreign Application Priority Data

Mar. 29, 2007 (JP) ..... 2007-087666
Nov. 14, 2007 (JP) ..... 2007-295996

(51) Int. Cl.
*G09G 3/34* (2006.01)

(52) U.S. Cl. ..... 345/107; 345/98; 345/204; 345/100; 345/55; 349/33; 359/295; 359/296

(58) Field of Classification Search ..... 345/107, 345/100, 90, 30, 55, 98, 204; 359/296, 295; 349/19, 33, 41, 143
See application file for complete search history.

(56) References Cited

U.S. PATENT DOCUMENTS

| | | | | |
|---|---|---|---|---|
| 5,471,225 | A | 11/1995 | Parks | |
| 5,712,652 | A * | 1/1998 | Sato et al. | 345/90 |
| 6,456,267 | B1 | 9/2002 | Sato et al. | |
| 6,771,241 | B2 | 8/2004 | Miyazawa et al. | |
| 7,173,589 | B2 | 2/2007 | Senda et al. | |
| 7,301,521 | B2 | 11/2007 | Miyazawa et al. | |
| 2003/0048370 | A1 * | 3/2003 | Koyama | 348/311 |
| 2003/0151582 | A1 * | 8/2003 | Ishii | 345/100 |
| 2004/0263701 | A1 | 12/2004 | Ukigaya | |
| 2007/0133080 | A1 | 6/2007 | Shikina et al. | |
| 2009/0189884 | A1 * | 7/2009 | Maeda | 345/214 |

FOREIGN PATENT DOCUMENTS

| | | | |
|---|---|---|---|
| EP | 1020840 | | 7/2000 |
| EP | 1246159 | A2 | 10/2002 |
| EP | 1246159 | A3 | 9/2005 |
| JP | 52-070791 | A | 6/1977 |
| JP | 58-198084 | A | 11/1983 |
| JP | 11-160676 | A | 6/1999 |
| JP | 2001-356743 | A | 12/2001 |
| JP | 2002-297102 | A | 10/2002 |
| JP | 2003-084314 | A | 3/2003 |

(Continued)

*Primary Examiner* — Lun-Yi Lao
*Assistant Examiner* — Olga Merkoulova
(74) *Attorney, Agent, or Firm* — AdvantEdge Law Group, LLC

(57) ABSTRACT

An electrophoretic display device includes a pair of substrates, an electrophoretic element that includes electrophoretic particles and that are held between the pair of substrates, and a display portion formed of a plurality of pixels. The display portion includes pixel electrodes, an opposite electrode, a first control line and a second control line. The opposite electrode is opposed to the plurality of pixel electrodes through the electrophoretic element. The first control line and the second control line are connected to each of the pixels. Each of the pixels includes a pixel switching element, a memory circuit, and a switch circuit. Switching of the switch circuit is performed by an output signal of the memory circuit to switch between a connected state where the pixel electrode is connected to the first control line and a connected state where the pixel electrode is connected to the second control line.

6 Claims, 47 Drawing Sheets

FOREIGN PATENT DOCUMENTS

| | | | |
|---|---|---|---|
| JP | 2004-102054 | A | 4/2004 |
| JP | 2005-189851 | | 7/2005 |
| JP | 2006-084846 | A | 3/2006 |
| JP | 2007-003607 | A | 1/2007 |
| WO | WO-03-100757 | A1 | 12/2003 |
| WO | WO-2008-001288 | A1 | 1/2008 |

* cited by examiner

ST11
ST12
ST15

ST13

ST14

ST31
ST33

ST101

ST102

ST111

ST112

ST120

ST130

ST201

ST202

ST211

ST212

ST220

ST230

ST301

ST302

ST311

ST312

ST320

ELECTROPHORETIC DISPLAY DEVICE, METHOD OF DRIVING ELECTROPHORETIC DEVICE, AND ELECTRONIC APPARATUS

BACKGROUND

1. Technical Field

The present invention relates to an electrophoretic display device, a method of driving an electrophoretic device, and an electronic apparatus.

2. Related Art

In order to display an image with an electrophoretic display device, an image signal is once stored in a memory circuit through a switching element. The image signal stored in the memory circuit is directly input to a pixel electrode, and, when the pixel electrode is applied with an electric potential, a difference in electric potential is generated between opposite electrodes. Thus, an electrophoretic element is driven to be able to display an image (which is, for example, described in JP-A-2003-84314). In addition, JP-A-2003-84314 describes a configuration that includes an SRAM (Static Random Access Memory) as a memory circuit (a configuration in which a latch that holds a piece of information in the form of electric potential is provided in a pixel) and also describes a configuration that includes a DRAM (Dynamic Random Access Memory) as a memory circuit (a configuration in which an electric potential is held by a capacitor).

In order to display an image with the electrophoretic display device, a sufficient difference in electric potential has to be applied between the electrodes that hold the electrophoretic element therebetween, so that the power supply voltage of the memory circuit needs to be 10 V or above. At this time, when the adjacent pixels are displaying different colors, the pixel electrodes of the adjacent pixels are input with different electric potentials. Therefore, because a large difference in electric potential occurs between the adjacent pixel electrodes, a leakage current flows between adjacent first electrodes through an adhesive, or the like, that fixes the electrophoretic elements to the substrate. Although a leakage current per pixel is small, a leakage current over the entire display portion of the electrophoretic display device is large. This has caused an increase in power consumption. Note that the occurrence of the leakage current will be specifically described later in an embodiment with reference to FIG. 10.

Moreover, the occurrence of a leakage current means that there is a possibility that an electrochemical reaction may occur in the pixel electrodes. That is, there has been a possibility that the reliability of the pixel electrodes is deteriorated because of generation of ion migration or corrosion. Then, for example, when a material, such as gold or platinum, that is chemically stable and anticorrosive, is used for the pixel electrode, the reliability may be improved; however, manufacturing costs will increase.

Furthermore, in an active matrix electrophoretic display device, when the screen is switched from an image (original image) that has been already displayed to an image (new image) that will be displayed next, a pre-display operation is executed in order to prevent after-image. For example, an operation by which white display is performed over the entire display portion (all white display), an operation by which black display is performed over the entire display portion (all black display), an operation by which all white display and all black display are alternately executed, an operation by which the inverted image of an original image or a new image is displayed for a short time, or the like, is executed. Then, after such a pre-display operation has been performed, a new image will be displayed.

An image switching sequence that includes the above pre-display operation is absolutely necessary to achieve a high-quality (high contrast, after-image free) under circumstances in which the electrophoretic display device is used. However, in the above image switching sequence, it is necessary to transfer data of all white, all black or an inverted image to a pixel every time an image is switched and, therefore, it has caused an increase in power consumption of the electrophoretic display device.

SUMMARY

An advantage of some aspects of the invention is that it provides an electrophoretic display device that is able to suppress a leakage current between adjacent pixels and also to improve power saving characteristic and reliability and that it also provides a driving method suitable for the electrophoretic display device. Furthermore, another advantage of some aspect of the invention is that it provides an electrophoretic display device provided with a configuration that is able to make an image switching sequence more efficient and also to reduce power consumption and that it also provides a driving method that includes an efficient image switching sequence.

An aspect of the invention provides an electrophoretic display device. The electrophoretic display device includes a pair of substrates, an electrophoretic element that includes electrophoretic particles and that are held between the pair of substrates, and a display portion formed of a plurality of pixels. The display portion includes pixel electrodes, an opposite electrode, a first control line and a second control line. Each of the pixel electrodes is formed in each of the pixels. The opposite electrode is opposed to the plurality of pixel electrodes through the electrophoretic element. The first control line and the second control line are connected to each of the pixels. Each of the pixels includes a pixel switching element, a memory circuit, and a switch circuit. The memory circuit is connected to the pixel switching element. Switching of the switch circuit is performed by an output signal of the memory circuit to switch between a connected state where the pixel electrode is connected to the first control line and a connected state where the pixel electrode is connected to the second control line. According to the above configuration, image data input to the memory circuit are used to perform switching of the switch circuit that electrically connects the pixel electrode and either one of the first control line or the second control line, and the input of electric potential to the pixel electrode is performed through the first control line or the second control line. According to the above configuration, the first control line and the second control line that are connected to the pixel electrode form a leakage path; however, it is only necessary that these control lines be connected to the circuit only in a period during which the input of electric potential to the pixel electrode is performed to enter a state where a signal is inputable, and, in the other period, these control lines may be made into a high impedance state where they are electrically disconnected. Then, when at least one of the first control line and the second control line is in a high impedance state, a leakage path is interrupted at the control lines. Thus, it is possible to suppress generation of leakage current between adjacent pixels. Thus, according to the aspect of the invention, it is possible to suppress generation of leakage current between adjacent pixels, and it is also possible to effectively prevent deterioration of reliability due to a leakage current. In addition, as described above, in the aspect of the invention, independently of image data input to the memory circuit, it is possible to control an electric potential that is input from the first control line or the second control line to the pixel electrode and also possible to control the display state of the pixel. That is, in the aspect of the invention, without transferring image data to the pixel, it is possible to perform a pre-display operation, such as all white display or all black display, and also possible to reduce power consumption in association with the pre-display operation.

The electrophoretic display device may further include a pixel driving portion and an electric potential control portion. The pixel driving portion is connected through a scanning line and a data line to each of the pixels, and supplies image data through the corresponding pixel switching element to each of the memory circuits. The electric potential control portion is connected to both the first control line and the second control line and the opposite electrode. The electric potential control portion supplies an voltage, which is applied to each of the pixel electrodes, through the first control line and the second control line to each of the switch circuits, and supplies the opposite electrode with a rectangular wave that has more than one cycle and that repeats a first electric potential and a second electric potential corresponding to an electric potential supplied to the first control line and an electric potential supplied to the second control line. That is, the electrophoretic display device may include a pixel driving portion that supplies each of the pixels with image data to be displayed and an electric potential control portion that supplies a voltage applied to each of the pixel electrodes and the opposite electrode in order to perform display on the basis of the image data. In the aspect of the invention, a rectangular wave that repeats a first electric potential and a second electric potential is supplied to the opposite electrode, and a driving mode that is termed "common oscillation driving" in the description is employed. According to this common oscillation driving method, because an electric potential applied to each of the pixel electrodes and the opposite electrode may be controlled using binary values, that is, a high level (H) and a low level (L), it is possible to simplify a circuitry while attempting to operate on a low voltage. In addition, when a TFT (Thin Film Transistor) is used as a pixel switching element, it is advantageous in that the reliability of the TFT may be ensured by low voltage driving.

The electrophoretic display device may be configured so that each of the memory circuits includes a first output terminal and a second output terminal that output different signals from each other, wherein each of the switch circuits includes a first transfer gate and a second transfer gate, wherein the first transfer gate is connected between the first control line and the pixel electrode, wherein switching of the first transfer gate is performed by an output of the first output terminal, wherein the second transfer gate is connected between the second control line and the pixel electrode, and wherein switching of the second transfer gate is performed by an output of the second output terminal. According to the above configuration, the electrophoretic display device may be configured to alternatively select the first control line or the second control line to be connected to the pixel electrode using the transfer gates and to control an electric potential of the pixel electrode. In this case, each memory circuit has a plurality of output terminals, and, for example, may be formed as a latch circuit that combines inverters.

The electrophoretic display device may be configured so that each of the switch circuits includes a first transistor that is connected between the first control line and the pixel electrode and a second transistor that is connected between the second control line and the pixel electrode, wherein one of the first transistor and the second transistor is a P-type transistor and the other transistor is an N-type transistor. In the above configuration as well, on the basis of a signal output from the memory circuit, it is possible to alternatively select the first control line or the second control line to be connected to the pixel electrode. In addition, according to the above configuration, because each of the switch circuits may be formed of two transistors, it is possible to reduce an area occupied by the switch circuit and also possible to easily conform to high-definition pixels. Furthermore, the configuration is advantageous in reduction of a parasitic capacitance and power consumption in the switch circuit.

The electrophoretic display device may be configured so that each of the memory circuits includes a first output terminal and a second output terminal that output different signals from each other, wherein each of the switch circuits includes a first transistor formed of an N-type transistor and a second transistor formed of an N-type transistor, wherein the first transistor is connected between the first control line and the pixel electrode, wherein switching of the first transistor is performed by an output of the first output terminal, wherein the second transistor is connected between the second control line and the pixel electrode, and wherein switching of the second transistor is performed by an output of the second output terminal. Thus, when each of the switch circuits is formed of two N-type transistors as well, on the basis of a signal. output from the memory circuit, it is possible to alternatively select the first control line or the second control line to be connected to the pixel electrode and, therefore, the same function and advantageous effects are obtained. According to the above configuration, by using outputs from both the first output terminal and the second output terminal of the memory circuit, selection of the first control line or the second control line may be made by the same channel type transistors.

The electrophoretic display device may be configured so that each of the memory circuits includes a first output terminal and a second output terminal that output different signals from each other, wherein each of the switch circuits includes a first transistor formed of a P-type transistor and a second transistor formed of a P-type transistor, wherein the first transistor is connected between the first control line and the pixel electrode, wherein switching of the first transistor is performed by an output of the first output terminal, the second transistor is connected between the second control line and the pixel electrode, and wherein the second transistor is performed by an output of the second output terminal. Thus, when each of the switch circuits is formed of two P-type transistors as well, on the basis of a signal output from the memory circuit, it is possible to alternatively select the first control line or the second control line to be connected to the pixel electrode and, therefore, the same function and advantageous effects are obtained. According to the above configuration as well, by using outputs from both the first output terminal and the second output terminal of the memory circuit, selection of the first control line or the second control line may be made by the same channel type transistors.

Both the first control line and the second control line may be a common line to the plurality of pixels. That is, both the first control line and the second control line may be a global line. According to the configuration, it is possible to simplify a circuit pattern that controls the control lines and the wiring of the control lines and also possible to reduce the costs of design and manufacturing.

Each of the memory circuits may be a latch circuit. The latch circuit may be realized by the same configuration as an SRAM cell that loop-connects two inverters. According to the above configuration, it is possible to hold image data that are input through the pixel switching element as an electric potential, it is possible to hold the state of switch circuit without a refresh operation at a constant interval, and it is possible to hold an electric potential of the pixel electrode. In addition, because a plurality of output terminals that output different signals may be provided, an appropriate control that suitable for the configuration of the switch circuit may be performed.

The electric potential control portion, when portion of the pixels are changed from the first gray scale to the second gray scale as a first operation, may electrically disconnect the first control line from the switch circuit, and connect only the second control line, to which the second electric potential is supplied, to the switch circuit. In this manner, even when the different electric potentials are input to the respective first electrodes of the adjacent pixels, because the first control line is electrically disconnected, it is possible to suppress generation of the leakage current between the adjacent first electrodes and also possible to obtain an electrophoretic display device that reduces power consumption. The electric potential control portion, when portion of the pixels are changed from the second gray scale to the first gray scale as a second operation, may electrically disconnect the second control line from the switch circuit, and connect only the first control line, to which the first electric potential is supplied, to the switch circuit. In this manner, even when the different electric potentials are input to the respective first electrodes of the adjacent pixels, because the second control line is electrically disconnected, it is possible to suppress generation of the leakage current between the adjacent first electrodes and also possible to obtain an electrophoretic display device that consumes less power. The electric potential control portion, when the display state of the pixel is held, may electrically disconnect all the lines, which are connected to the memory circuit, the switch circuit and the second electrode, from the memory circuit, the switch circuit and the second electrode. In this manner, it is possible to obtain an electrophoretic display device that consumes less power when an image is held. The electric potential control portion may update an image by alternately repeating a first operation in which the first control line is electrically disconnected from the switch circuit and only the second control line, to which the second electric potential is supplied, is connected to the switch circuit to thereby change portion of the pixels from the first gray scale to the second gray scale, and a second operation in which the second control line is electrically disconnected from the switch circuit and only the first control line, to which the first electric potential is supplied, is connected to the switch circuit to thereby change portion of the pixels from the second gray scale to the first gray scale. In this manner, by reducing the leakage current when an image is updated, it is possible to obtain an electrophoretic display device that consumes less power. A different electric potential may be input to the second electrode in synchronization with switching between the first operation and the second operation. In this manner, it is not necessary to control the electric potential, which is input from the electric potential control portion to the second electrode, in accordance with the above two operations. Then, it is possible to simplify a circuit pattern and thereby possible to obtain an electrophoretic display device that reduces manufacturing costs. A period during which the first control line and the second control line are electrically disconnected from the switch circuit may be provided between a period of the first operation and a period of the second operation. In this manner, because both the first control line and the second control line are electrically disconnected, it is possible to further reduce the leakage current and thereby to obtain an electrophoretic display device that updates an image with smaller power consumption.

Another aspect of the invention provides a method of driving an electrophoretic display device. The electrophoretic display device is provided with a pair of substrates, an electrophoretic element that includes electrophoretic particles and that are held between the pair of substrates, and a display portion formed of a plurality of pixels. The display portion includes pixel electrodes, an opposite electrode, a first control line, and a second control line. The pixel electrode is formed in each of the pixels. The opposite electrode is opposed to the plurality of pixel electrodes through the electrophoretic element. The first control line and the second control line are connected to each of the pixels. Each of the pixels includes a pixel switching element, a memory circuit, and a switch circuit. The memory circuit is connected to the pixel switching element. The switch circuit is connected between the memory circuit and the pixel electrode and is connected to the first control line and the second control line. The method includes inputting an image signal through the corresponding pixel switching element to each of the memory circuits, supplying a first electric potential and a second electric potential respectively to the first control line and the second control line, inputting an electric potential from the first control line or the second control line by operating each of the switch circuits on the basis of an output from the corresponding memory circuit, and inputting a rectangular wave that has more than one cycle and that repeats the first electric potential and the second electric potential to the opposite electrode. The above driving method includes inputting image data to each of the memory circuits and performing a display operation on the basis of the image data held in each of the memory circuits. That is, independently of image data input to each memory circuit, an electric potential that is input from the first control line and the second control line to the corresponding pixel electrode is controlled to thereby control the display state of each pixel. Thus, because it is possible to perform a pre-display operation, that is, all white display and all black display, without updating the image data held in the memory circuit, it is possible to reduce power consumption in association with the pre-display operation.

The driving method may be configured so that a first image signal is input to the memory circuit of each pixel that displays a first gray scale and a second image signal is input to the memory circuit of each pixel that displays a second gray scale, wherein, in each pixel that displays the first gray scale, the first control line and the pixel circuit are made into a connected state by operating the switch circuit on the basis of an output from the memory circuit that holds the first image signal, and wherein, in each pixel that displays the second gray scale, the second control line and the pixel electrode are made into a connected state by operating the switch circuit on the basis of an output from the memory circuit that holds the second image signal. That is, the driving method may switch between the first control line and the second control line to be connected to the pixel electrode in accordance with the gray scale value of image data. It is possible to perform display on the basis of the image data by setting the electric potential of the first control line and the electric potential of the second control line in accordance with the gray scale value.

Each of the switch circuit may include a first transfer gate that is connected between the first control line and the pixel electrode and a second transfer gate that is connected between the second control line and the pixel electrode, wherein the driving method may be configured so that the first control line and each of the pixel electrodes are made into a connected state by switching the corresponding first transfer gate to an on state using a low level signal output from a first output terminal of the corresponding memory circuit and a high level signal output from a second output terminal of the corresponding memory circuit, and wherein the second control line and each of the pixel electrodes are made into a connected state by switching the corresponding second transfer gate to an on state using a high level signal output from the first output terminal and a low level signal output from the second output terminal. When each of the switch circuits includes a first transfer gate and a second transfer gate, two line outputs of the memory circuit may be input respectively to the transfer gates, and switching of the transfer gates may be performed using these two line outputs. In this manner, it is possible to apply a voltage of the first control line and a voltage of the second control line to the pixel electrode without a decrease in the voltage.

Each of the switch circuits may include a first transistor, formed of a P-type transistor, that is connected between the first control line and the pixel electrode and a second transistor, formed of an N-type transistor, that is connected between the second control line and the pixel electrode, wherein the driving method may be configured so that the first control line and each of the pixel electrodes are made into a connected state by switching the corresponding first transistor to an on state using a low level signal output from the corresponding memory circuit, and wherein the second control line and each of the pixel electrodes are made into a connected state by switching the corresponding second transistor to an on state using a high level output from the corresponding memory circuit. As described above, when each of the switch circuits includes a P-type transistor and an N-type transistor, it is possible to control the operation of the switch circuit using one line output of the memory circuit.

Each of the switch circuits may include a first transistor and a second transistor, both of which are formed of an N-type transistor, wherein the first control line is connected through the corresponding first transistor to each of the pixel electrodes and the second control line is connected through the corresponding second transistor to each of the pixel electrodes, wherein the driving method may be configured so that the first control line and each of the pixel electrodes are made into a connected state by switching the corresponding first transistor to an on state using a high level signal output from a first output terminal of the corresponding memory circuit, and wherein the second control line and each of the pixel electrodes are made into a connected state by switching the corresponding second transistor to an on state using a high level signal output from a second output terminal of the corresponding memory circuit. In this manner, when each of the switch circuits is formed of two N-type transistors, it is possible to control the switch circuit by means of the same channel type transistors using two line outputs of the memory circuit.

The switch circuit may include a first transistor and a second transistor, both of which are formed of a P-type transistor, wherein the first control line is connected through the corresponding first transistor to each of the pixel electrodes and the second control line is connected through the corresponding second transistor to each of the pixel electrodes, wherein the driving method may be configured so that the first control line and each of the pixel electrodes are made into a connected state by switching the corresponding first transistor to an on state using a low level signal output from a first output terminal of the corresponding memory circuit, and wherein the second control line and each of the pixel electrodes are made into a connected state by switching the corresponding second transistor to an on state using a low level signal output from a second output terminal of the corresponding memory circuit. Thus, when each of the switch circuits is formed of two P-type transistors as well, it is possible to control the switch circuit by means of the same channel type transistors using two line outputs of the memory circuit.

The driving method may be configured so that all the pixels are made to have the same gray scale by supplying signals having the same electric potential to the first control line and the second control line. In this manner, because all black display or all white display may be performed irrespective of image data held in the memory circuit, it is possible to execute an operation to erase an image while suppressing power consumption.

The driving method may be configured so that the first control line is made into a high impedance state where the first control line is electrically disconnected and the second control line is supplied with the second electric potential to thereby change at least portion of the pixels of the display portion from the first gray scale to the second gray scale, and wherein the first control line is supplied with the first electric potential and the second control line is made into a high impedance state where the second control line is electrically disconnected to thereby change at least portion of the pixels of the display portion from the second gray scale to the first gray scale. The first control line when the pixels are changed from the first gray scale to the second gray scale and the second control line when the pixels are changed from the second gray scale to the first gray scale do not actually contribute to a display operation, and they rather become a path of leakage current between pixel electrodes. For this reason, as described above, when the driving method is configured to perform display while the control line that does not contribute to a display operation is made into a high impedance state where appropriate, it is possible to eliminate a leakage current by interrupting a leakage path and, therefore, a driving method with low power consumption may be obtained. In addition, because a leakage current is not generated, the driving method does not cause deterioration of reliability in each pixel electrode.

The driving method may be configured to update a display image by repeating the operation in which the at least portion of the pixels of the display portion are changed from the first gray scale to the second gray scale and the operation in which the at least portion of the pixels of the display portion are changed from the second gray scale to the first gray scale. Only the pixels that perform, for example, black display are driven in the operation in which the at least portion of the pixels are changed from the first gray scale to the second gray scale and only the pixels that perform, for example, white display are driven in the operation in which the at least portion of the pixels are changed from the second gray scale to the first gray scale. Thus, when each of the operations is continued until the display operation of the pixels ends, it takes time until an image to be displayed is recognized. Then, by alternately repeating the operation in which the at least portion of the pixels of the display portion are changed from the first gray scale to the second gray scale and the operation in which the at least portion of the pixels of the display portion are changed from the second gray scale to the first gray scale, the same image as a display image but having a lower contrast may appear on the display portion. Thus, it is possible to update an image without any stress being placed on a user.

The driving method may be configured so that, between the operation in which the at least portion of the pixels of the display portion are changed from the first gray scale to the second gray scale and the operation in which the at least portion of the pixels of the display portion are changed from the second gray scale to the first gray scale, the first control line and the second control line are made into a high impedance state where the first control line and the second control line are electrically disconnected. According to the above driving method, because there is no chance that the first control line and the second control line are connected to the pixels at the same time, it is possible to reliably interrupt a leakage path.

The driving method may be configured so that, after the rectangular wave that repeats the first electric potential and the second electric potential and that has more than one cycle has been input to the opposite electrode, each of the memory circuits, each of the switch circuits and the opposite electrode are made into a high impedance state where each of the memory circuits, each of the switch circuits and the opposite electrode are electrically disconnected. According to the above driving method, it is possible to prevent a leakage current in the pixels and, thereby, possible to obtain an electrophoretic display device that can hold display well. In addition, because the electrophoretic element is electrically isolated, it is possible to reduce power consumption when an image is held.

Yet another aspect of the invention provides an electrophoretic display device having a control portion that executes the driving method according to the above described aspects of the invention. According to the above configuration, it is possible to provide an electrophoretic display device that is able to reduce power consumption and also to execute a display operation without a decrease in reliability.

Further another aspect of the invention provides an electronic apparatus that is provided with the above described electrophoretic display device. According to the above configuration, it is possible to provide an electronic apparatus having a display device that is able to suppress power consumption and that has a high reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
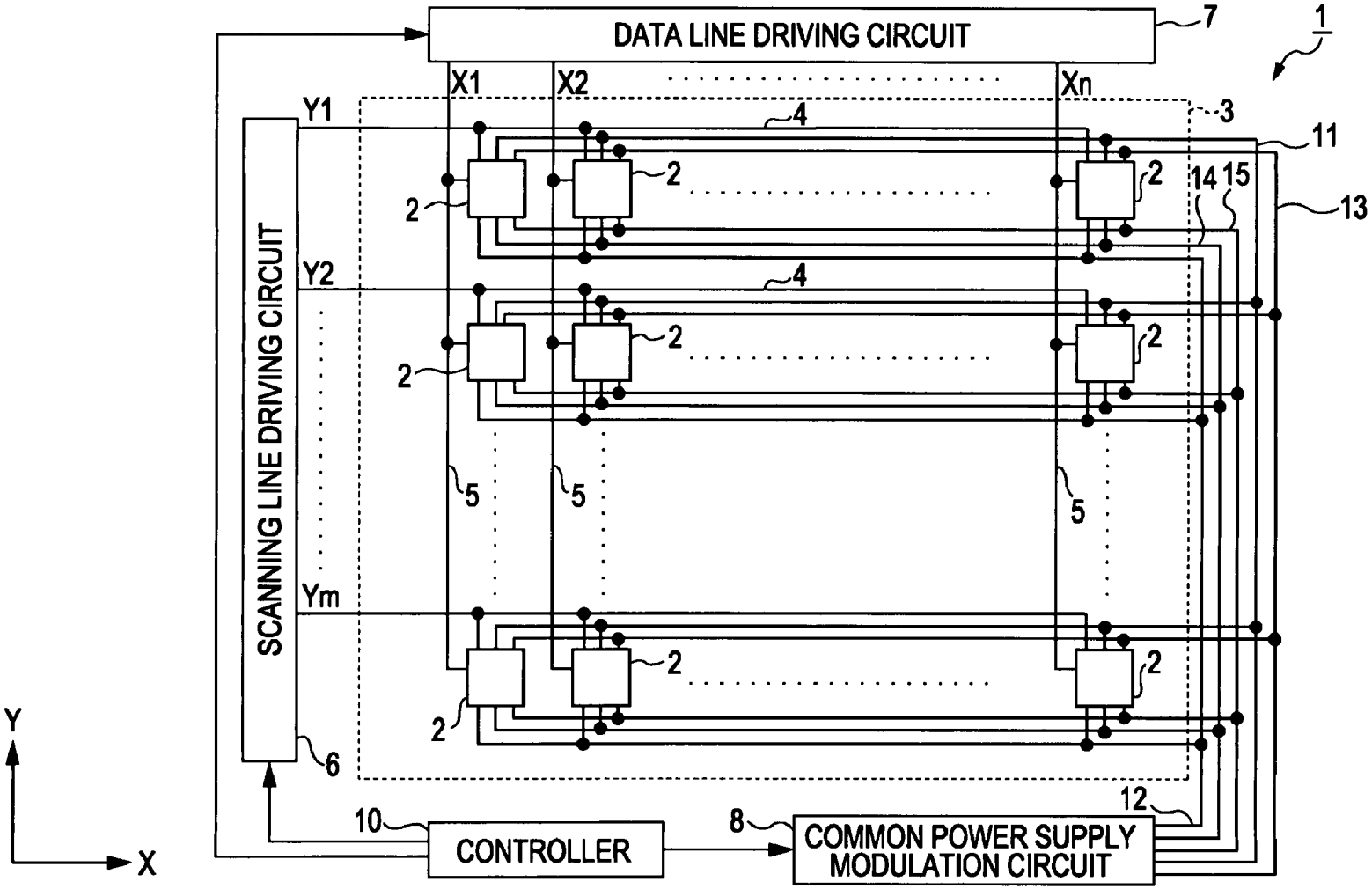
FIG. 1 is a block diagram of an electrophoretic display device according to a first embodiment.

Hereinafter, an electrophoretic display device 1 according to a first embodiment of the invention will be described with reference to the accompanying drawings. FIG. 1 is a block diagram of the electrophoretic display device 1 according to the first embodiment of the invention. The electrophoretic display device 1 includes a display portion 3, a scanning line driving circuit (pixel driving portion) 6, a data line driving circuit (pixel driving portion) 7, a common power supply modulation circuit (electric potential control portion) 8 and a controller 10.

Pixels 2 are formed in the display portion 3 in a matrix such that m pixels 2 are arranged along a Y-axis direction and n pixels 2 are arranged along an X-axis direction. The scanning line driving circuit 6 is connected to the pixels 2 through a plurality of scanning lines (Y1, Y2, . . . , Ym) that extend over the display portion 3 along the X-axis direction. The data line driving circuit 7 is connected to the pixels 2 through a plurality of data lines 5 (X1, X2, . . . , Xn) that extend over the display portion 3 along the Y-axis direction. The common power supply modulation circuit 8 is connected through a first control line 11, a second control line 12, a first power supply line 13, a second power supply line 14 and a common electrode power supply line 15 to the pixels 2. The scanning line driving circuit 6, the data line driving circuit 7 and the common power supply modulation circuit 8 are controlled by the controller 10. The control lines 11 and 12, the power supply lines 13 and 14, and the common electrode power supply line 15 are used by all the pixels 2 as common lines.

Figure 2:
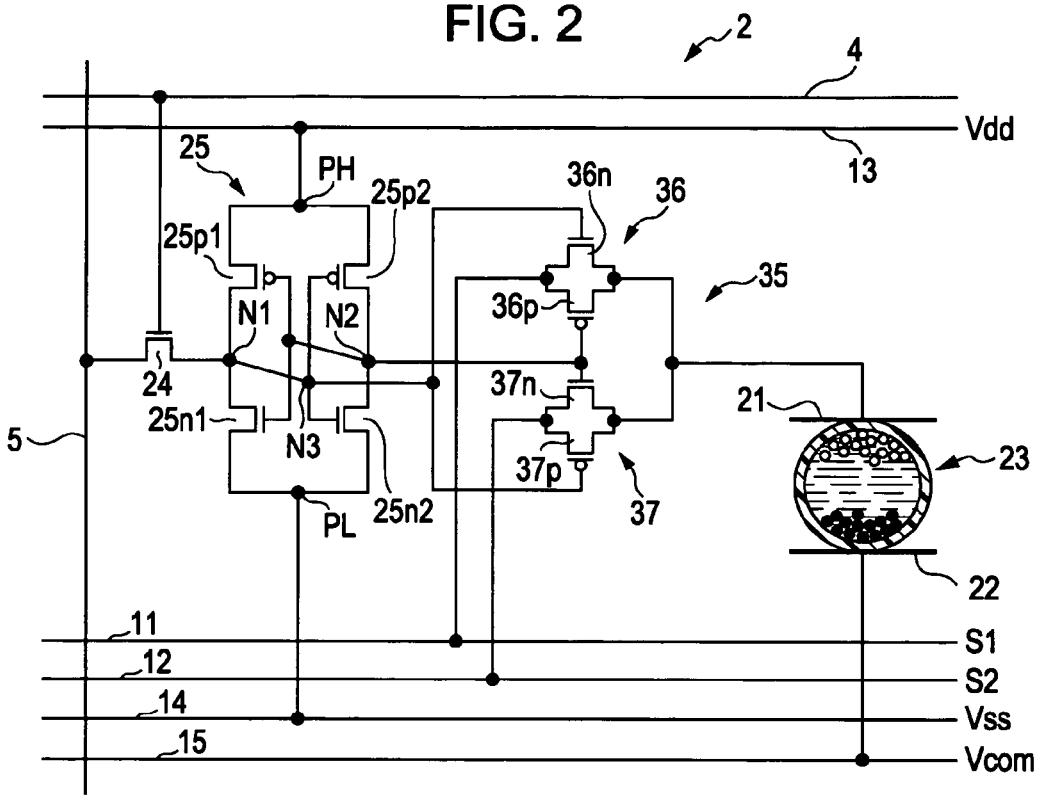
FIG. 2, is a view that shows a circuit diagram of a pixel according to the first embodiment.

FIG. 2 is a view that shows a circuit diagram of the pixel 2. The pixel 2 includes a driving TFT (Thin Film Transistor) 24 which corresponds to a pixel switching element, an SRAM (Static Random Access Memory) 25 which corresponds to a memory circuit, a switch circuit 35, a pixel electrode 21 which corresponds to a first electrode, a common electrode 22 which corresponds to an opposite electrode or a second electrode, and an electrophoretic element 23.

The driving TFT 24 is formed of an N-MOS (Negative Metal Oxide Semiconductor). The gate portion of the driving TFT 24 is connected to the scanning line 4, the source side thereof is connected to the data line 5, and the drain side thereof is connected to the SRAM 25. The driving TFT 24 is used to input an image signal, which is input from the data line driving circuit 7 through the data line 5, to the SRAM 25 in such a manner that the data line 5 and the SRAM 25 are connected during a period when a selection signal is input from the scanning line driving circuit 6 through the scanning line 4 to the driving TFT 24.

The SRAM 25 is formed of two P-MOSs (Positive Metal Oxide Semiconductor) 25*p*1 and 25*p*2 and two N-MOSs 25*n*1 and 25*n*2. The source side of each of the P-MOSs 25*p*1 and 25*p*2 is connected to the first power supply line 13, and the source side of each of the N-MOSs 25*n*1 and 25*n*2 is connected to the second power supply line 14. Thus, the source side of the P-MOS 25*p*1 and the source side of the P-MOS 25*p*2 correspond to a high electric potential power supply terminal PH of the SRAM 25, and the source side of the N-MOS 25*n*1 and the source side of the N-MOSn2 correspond to a low electric potential power supply terminal PL of the SRAM 25.

In addition, the switch circuit 35 includes a first transfer gate 36 and a second transfer gate 37. The first transfer gate 36 has a P-MOS 36*p* and an N-MOS 36*n*. The second transfer gate 37 has a P-MOS 37*p* and an N-MOS 37*n*. The source side of the first transfer gate 36 is connected to the first control line 11, and the source side of the second transfer gate 37 is connected to the second control line 12. The drain side of each of the transfer gates 36 and 37 is connected to the pixel electrode 21.

The SRAM 25 includes an input terminal N1, a first output terminal N2 and a second output terminal N3. The input terminal N1 is connected to the drain side of the driving TFT 24. The first output terminal N2 and the second output terminal N3 are connected to the switch circuit 35. The drain side of the P-MOS 25*p*1 of the SRAM 25 and the drain side of the N-MOS 25*n*1 of the SRAM 25 serve as the input terminal N1 of the SRAM 25. The input terminal N1 is connected to the drain side of the driving TFT 24 and also connected to the second output terminal N3 (the gate portion of the P-MOS 25*p*2 and the gate portion of the N-MOS 25*n*2) of the SRAM 25. Furthermore, the second output terminal N3 is connected to the gate portion of the N-MOS 36*n* of the first transfer gate 36 and the gate portion of the P-MOS 37*p* of the second transfer gate 37.

The drain side of the P-MOS 25*p*2 of the SRAM 25 and the drain side of the N-MOS 25*n*2 of the SRAM 25 serve as the first output terminal N2 of the SRAM 25. The first output terminal N2 is connected to the gate portion of the P-MOS 25*p*1 and the gate portion of the N-MOS 25*n*1, and also connected to the gate portion of the P-MOS 36*p* of the first transfer gate 36 and the gate portion of the N-MOS 37*n* of the second transfer gate 37.

The SRAM 25 holds an image signal that is sent from the driving TFT 24 and is used to input an image signal to the switch circuit 35. The switch circuit 35 serves as a selector that selects any one of the first control line 11 and the second control line 12 on the basis of an image signal input from the SRAM 25 and then connects the selected control line to the pixel electrode 21. At this time, only one of the first transfer gate 36 and the second transfer gate 37 operates in accordance with the level of the image signal.

Specifically, when a high level (H) is input to the input terminal N1 of the SRAM 25 as an image signal, a low level (L) is output from the first output terminal N2. Thus, among the transistors that are connected to the first output terminal N2, the P-MOS 36*p* operates and, in addition, the N-MOS 36*n* that is connected to the second output terminal N3 (input terminal N1) operates. As a result, the transfer gate 36 is driven. Thus, the first control line 11 is electrically connoted to the pixel electrode 21. On the other hand, when a low level (L) is input to the input terminal N1 of the SRAM 25 as an image signal, a high level (H) is output from the first output terminal N2. Thus, among the transistors that are connected to the first output terminal N2, the N-MOS 37*n* operates and, in addition, the P-MOS 37*p* that is connected to the second output terminal N3 (input terminal N1) operates. As a result, the transfer gate 37 is driven. Thus, the second control line 12 is electrically connected to the pixel electrode 21. Then, through the operating transfer gate, the control line 11 or the control line 12 is electrically connected to the pixel electrode 21 to thereby input an electric potential to the pixel electrode 21.

Figure 3:
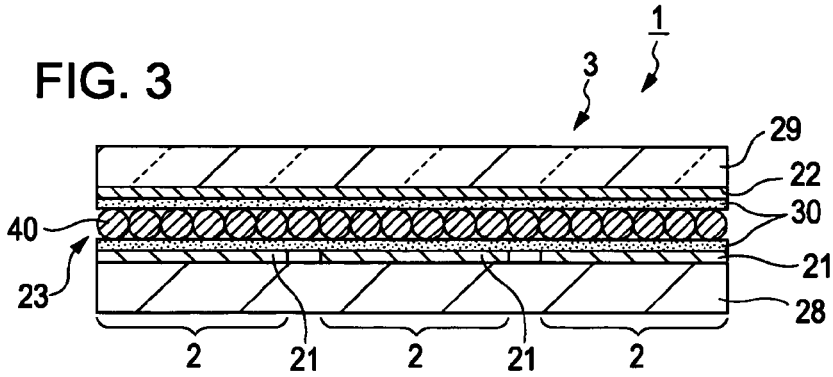
FIG. 3 is a cross-sectional view of a display portion according to the first embodiment.

The electrophoretic element 23 displays an image using a difference in electric potential between the pixel electrode 21 and the common electrode 22. The common electrode 22 is connected to the common electrode power supply line 15. FIG. 3 is a partially cross-sectional view of the display portion 3 in the electrophoretic display device 1. The display portion 3 is configured to hold the electrophoretic element 23 by the element substrate 28, on which the pixel electrodes 21 are mounted, and the opposite substrate 29, on which the common electrode 22 is mounted. The electrophoretic element 23 is formed of a plurality of microcapsules 40. The electrophoretic element 23 is fixed between the substrates 28 and 29 by means of an adhesive layer 30. That is, the adhesive layer 30 is formed between the electrophoretic element 23 and both substrates 28 and 29. Note that the adhesive layer 30 on the side of the element substrate 28 is necessary to adhere to the surfaces of the pixel electrodes 21; however, the adhesive layer 30 on the side of the opposite substrate 29 is not necessary. This is because, after the common electrode 22, the plurality of microcapsules 40 and the adhesive layer 30 on the side of the opposite substrate 29 have been formed on the opposite substrate 29 in advance through a series of manufacturing processes, when the obtained product is used as an electrophoretic sheet, it is assumed that only the adhesive layer 30 on the side of the element substrate 28 is necessary as an adhesive layer.

The element substrate 28 is a substrate, which is, for example, formed of glass, plastic, or the like. The pixel electrodes 21 are formed on the element substrate 28, and each of the pixel electrodes 21 is formed into a rectangular shape in each pixel 2. Although not shown in the drawing, in a region between the adjacent pixel electrodes 21 and on the lower face of each pixel electrode 21 (layer on the side of the element substrate 28), the scanning lines 4, the data lines 5, the control lines 11 and 12, the power supply lines 13 and 14, the common electrode power supply line 15, the driving TFTs 24, the SRAMs 25, the switch circuits 35, and the like, are formed.

The opposite substrate 29 is arranged on the side from which an image is displayed, so that the opposite substrate 29 is a translucent substrate, such as glass. The material having translucency and conductivity is used for the common electrode 22, which is formed on the opposite substrate 29, and the material includes, for example, MgAg (magnesium silver), ITO (indium tin oxide), IZO (indium zinc oxide), and the like. Note that the electrophoretic element 23 is formed on the side of the opposite substrate 29 in advance, and the electrophoretic sheet generally includes the electrophoretic element, the opposite substrate 29 and the adhesive layer 30. In addition, a protective release paper is adhered on the side of the adhesive layer 30. In the manufacturing process, the display portion 3 is formed in such a manner that the electrophoretic sheet, from which the release paper has been peeled off, is adhered on the element substrate 28 on which the pixel electrodes 21 and the circuits are separately manufactured and formed. For this reason, in the general configuration, the adhesive layer 30 is only present on the side of the pixel electrodes 21.

Figure 4:
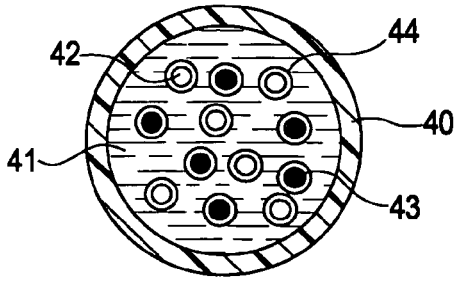
FIG. 4 is a schematic diagram of a microcapsule.

FIG. 4 is a schematic diagram of one of the microcapsules 40. Each microcapsule 40, for example, has a particle size of approximately 50 μm, and is formed of a translucent polymer resin, such as acrylic resin, which includes polymethylmethacrylate and polymethylmethacrylate, urea resin, and gum arabic. The microcapsules 40 are held between the common electrode 22 and the pixel electrodes 21, and the plurality of microcapsules 40 are arranged in a matrix in each of the pixels. A binder (not shown) is provided to fix the microcapsules 40 so as to fill the surroundings of the microcapsules 40. Each of the microcapsules 40 incorporates therein a dispersion medium 41 and charged particles including a plurality of white particles 42 and a plurality of black particles 43, which serve as electrophoretic particles.

The dispersion medium 41 is a liquid that disperses the white particles 42 and the black particles 43 within the microcapsule 40. The dispersion medium 41 may include, for example, water, alcohol medium, such as methanol, ethanol, isopropanol, butanol, octanol, and methyl cellosolve, various esters, such as ethyl acetate, and butyl acetate, ketone, such as acetone, methyl ethyl ketone, and methyl isobutyl ketone, aliphatic hydrocarbon, such as pentane, hexane, and octane, alicyclic hydrocarbon, such as cyclohexane, and methylcyclohexane, aromatic hydrocarbon having long-chain alkyl group, such as benzene, toluene, xylene, hexylbenzene, hebutylbenzene, octylbenzene, nonylbenzene, decylbenzene, undecylbenzene, dodecylbenzene, tridecylbenzene, and tetradecylbenzene, halogenated hydrocarbon, such as methylene chloride, chloroform, carbon tetrachloride, and 1,2-dichloroethane, carboxylate, and other various oils, either alone or in combination, mixed with a surface-active agent.

The white particles 42 are, for example, particles (polymer or colloid) formed of white pigment, such as titanium dioxide, zinc white, and antimony trioxide, and are, for example, negatively charged. The black particles 43 are, for example, particles (polymer or colloid) formed of black pigment, such as aniline black, and carbon black, and are, for example, positively charged. For this reason, the white particles 42 and the black particles 43 are able to move within an electric field that is generated by a difference in electric potential between the pixel electrodes 21 and the common electrode 22 in the dispersion medium 41.

These pigments may include additives such as electrolyte, surface active agent, metallic soap, resin, rubber, oil, varnish, charge control agent formed of particles such as compound, and dispersing agent, lubricant, stabilizing agent such as titanium coupling agent, aluminate coupling agent, and silane coupling agent, where necessary.

The white particles 42 and the black particles 43 are covered with ions in the medium, and an ion layer 44 is formed on the surface of each of these particles. An electric double layer is formed between each of the electrostatically-charged white particles 42 or black particles 43 and the corresponding ion layer 44. Generally, it has been known that the charged particles, such as the white particles 42 or the black particles 43, hardly respond to an electric field of a frequency that is equal to or more than 10 kHz and hardly move even when the electric field is applied thereto. It has been known that, because the particle size of ions is far smaller than that of the charged particles, the ions around the charged particles move in accordance with an electric field of a frequency that is equal to or more than 10 kHz when the electric field is applied thereto.

Figure 5A:
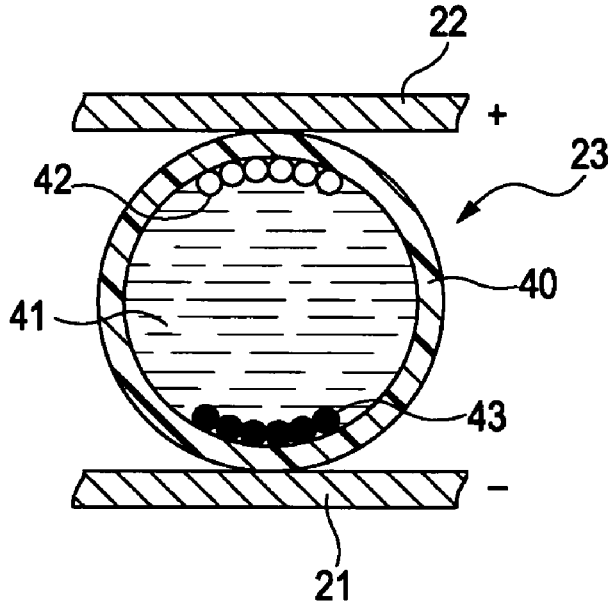
FIG. 5A and FIG. 5B are views illustrating the operation of the microcapsule.
Figure 5B:
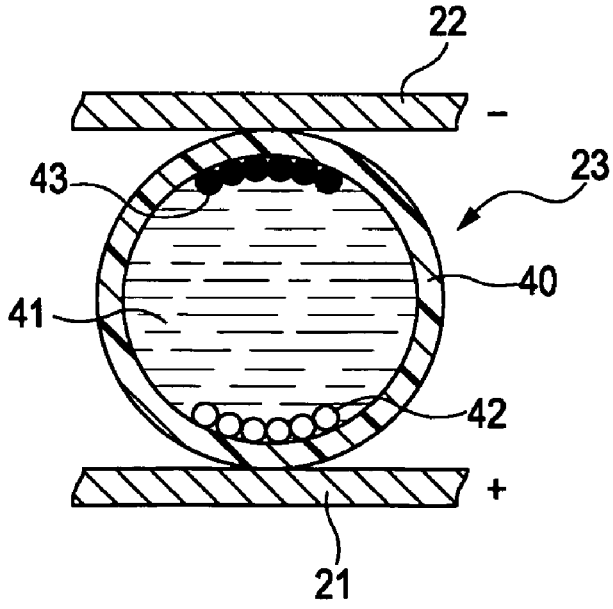

FIG. 5A and FIG. 5B are views illustrating the operation of the microcapsule 40. Here, an ideal example when the ion layers 44 are not formed will be described. A voltage is applied between the pixel electrode 21 and the common electrode 22 so that the common electrode 22 is applied with a relatively high electric potential. Then, as shown in FIG. 5A, the positively-charged black particles 43 are attracted on the basis of Coulomb force toward the pixel electrode 21 within the microcapsule 40. On the other hand, the negatively-charged white particles 42 are attracted on the basis of Coulomb force toward the common electrode 22 in the microcapsule 40. As a result, the white particles 42 gather on the display surface side (common electrode 22 side) within the microcapsule 40, and the color (white color) of the white particles 42 is displayed on the display surface.

Conversely, a voltage is applied between the pixel electrode 21 and the common electrode 22 so that the pixel electrode 21 is applied with a relatively high electric potential. Then, as shown in FIG. 5B, the negatively-charged white particles 42 are attracted on the basis of Coulomb force toward the pixel electrode 21. In addition, the positively-charged black particles 43 are attracted on the basis of Coulomb force toward the common electrode 22. As a result, the black particles 43 gather on the display surface side of the microcapsule 40, and the color (black color) of the black particles 43 is displayed on the display surface.

Note that, by replacing the pigments used for the white particles 42 and the black particles 43 with, for example, pigments, such as red color, green color, blue color, and the like, it is possible to obtain the electrophoretic display device 1 that displays red color, green color, blue color, and the like.

First Driving Method

Figure 6:
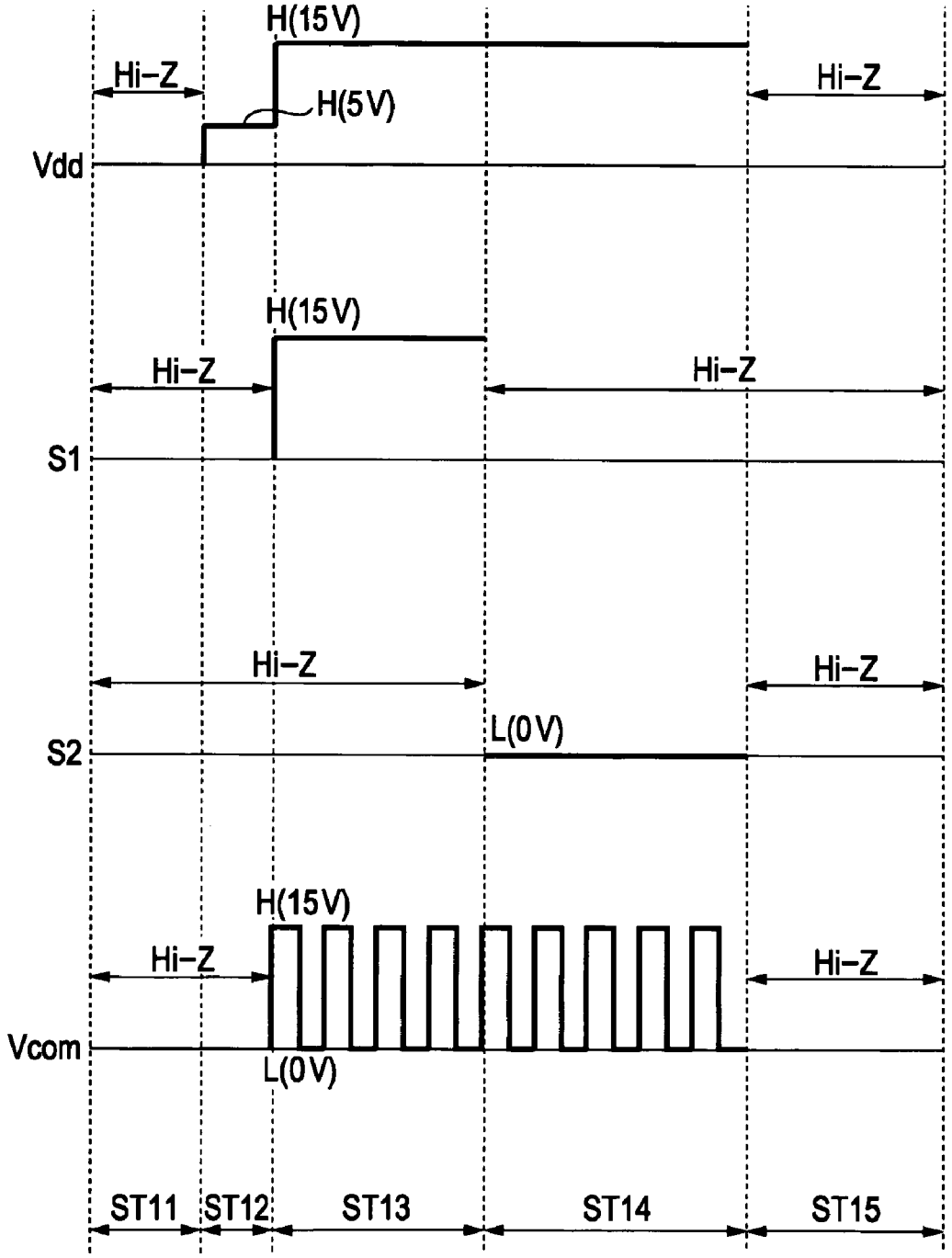
FIG. 6 is a view that shows a timing chart according to a first driving method.

Next, a method of driving the electrophoretic display device 1 according to the present embodiment will be described with reference to the accompanying drawings. FIG. 6 is a view that shows a timing chart according to a first driving method. The drawing shows that the operation is performed in a sequence of a power supply off period ST11, an image signal input period ST12, a black color image display period ST13, a white color image display period ST14, and a power supply off period ST15, and the state where an image is displayed. These operations are collectively shown in Table 1.

FIG. 6 shows an electric potential (an electric potential of the first power supply line 13) Vdd of the high electric potential power supply terminal PH of the SRAM 25, an electric potential S1 of the first control line 11, an electric potential S2 of the second control line 12, and an electric potential Vcom of the common electrode power supply line 15. In addition, specific voltage values (5 V, 15 V, 0 V, and the like) shown in Table 1 and FIG. 6 are exemplified for easier description, and are not intended to limit the scope of the invention.

TABLE 1

| | | STATE OF POWER SUPPLY LINE | | STATE OF CONTROL LINE | |
|---|---|---|---|---|---|
| SEQUENCE | PURPOSE OF OPERATION | FIRST POWER SUPPLY LINE 13 | SECOND POWER SUPPLY LINE 14 | FIRST CONTROL LINE 11 | SECOND CONTROL LINE 12 |
| ST11 | POWER SUPPLY OFF PERIOD | DISCONNECTED (Hi-Z) | DISCONNECTED (Hi-Z) | DISCONNECTED (Hi-Z) | DISCONNECTED (Hi-Z) |
| ST12 | IMAGE SIGNAL INPUT PERIOD | H (5 v) | L (0 v) | DISCONNECTED (Hi-Z) | DISCONNECTED (Hi-Z) |
| ST13 | BLACK COLOR IMAGE DISPLAY PERIOD | H (15 v) | L (0 v) | H | DISCONNECTED (Hi-Z) |
| ST14 | WHITE COLOR IMAGE DISPLAY PERIOD | H (15 v) | L (0 v) | DISCONNECTED (Hi-Z) | L |
| ST15 | POWER SUPPLY OFF PERIOD | DISCONNECTED (Hi-Z) | DISCONNECTED (Hi-Z) | DISCONNECTED (Hi-Z) | DISCONNECTED (Hi-Z) |

| | | | IMAGE DISPLAY | |
|---|---|---|---|---|
| SEQUENCE | PURPOSE OF OPERATION | STATE OF COMMON ELECTRODE 22 | PIXELS OF IMAGE SIGNAL H | PIXELS OF IMAGE SIGNAL L |
| ST11 | POWER SUPPLY OFF PERIOD | DISCONNECTED (Hi-Z) | PRECEDING IMAGE | |
| ST12 | IMAGE SIGNAL INPUT PERIOD | DISCONNECTED (Hi-Z) | UNCHANGED | UNCHANGED |
| ST13 | BLACK COLOR IMAGE DISPLAY PERIOD | PULSE | BLACK OF NEW IMAGE | UNCHANGED |
| ST14 | WHITE COLOR IMAGE DISPLAY PERIOD | PULSE | UNCHANGED | WHITE OF NEW IMAGE |
| ST15 | POWER SUPPLY OFF PERIOD | DISCONNECTED (Hi-Z) | NEW IMAGE | |

In the power supply off period S11 shown in Table 1 and FIG. 6, the first power supply line 13, the second power supply line 14, the first control line 11, the second control line 12, and the common electrode 22 all are in an open state (high impedance state (Hi-Z)) where they are electrically disconnected from other circuits. At this time, on the display portion 3, the image that has been displayed before is being held.

Next, the image signal input period ST12 (first step) will be described. The SRAM 25 is driven in such a manner that an electric potential of approximately 5 V (which is referred to as high level; H (5 V)) is input from the common power supply modulation circuit 8 shown in FIG. 1 to the SRAM 25 shown in FIG. 2 through the first power supply line 13, and an electric potential of approximately 0 V (which is referred to as L (0 V)), which is a low level (second electric potential) is input from the common power supply modulation circuit 8 to the SRAM 25 through the second power supply line 14. At this time, the first control line 11, the second control line 12, and the common electrode power supply line 15 are electrically disconnected by the common power supply modulation circuit 8 (Hi-Z).

The scanning line driving circuit 6 shown in FIG. 1 inputs a selection signal to the scanning line Y1. On the basis of this selection signal, the driving TFT 24 of each of the pixels 2 connected to the scanning line Y1 is driven, and the SRAMs 25 of the pixels 2 connected to the scanning line Y1 are respectively connected to the data lines X1, X2, . . . , Xn. The data line driving circuit 7 shown in FIG. 1 supplies image signals to the data lines X1, X2, . . . , Xn to thereby input image signals to the SRAMs 25 of the pixels 2 connected to the scanning line Y1.

When an image signal is input, the scanning line driving circuit 6 interrupts the supply of selection signal to the scanning line Y1 and releases the selected state of the pixels 2 connected to the scanning line Y1. This operation is sequentially executed until the pixels 2 connected to the scanning line Ym are selected, and an image signal is thereby input to the SRAM 25 of each of the pixels 2. In this manner, an electric potential corresponding to image data is stored in the SRAM 25 of each of the pixels 2 that constitute the display portion 3.

Next, the period proceeds to the black color image display period ST13 (second step). The first power supply line 13 (high electric potential power supply terminal PH) is supplied from the common power supply modulation circuit 8, shown in FIG. 1, with an electric potential (H (15 V)) of approximately 15 V, which is a high level (first electric potential). For this reason, the image signal that is input to the SRAM 25 at 5 V is held at a higher electric potential (15 V). In the meantime, the first control line 11 is electrically connected to the common power supply modulation circuit 8, and the first control line 11 is supplied with a high level electric potential (H (15 V)). In this manner, a high level is input to the source side of the first transfer gate 36. At this time, the second control line 12 is in a high impedance state where the second control line 12 is electrically disconnected. A pulse-like signal that periodically repeats a period of high level (H (15 V)) and a period of low level (L (0 V)) is input to the common electrode 22 through the common electrode power supply line 15.

At this time, in each of the pixels 2 of which image signals are at a high level, the electric potential of the first output terminal N2 of the SRAM 25 is at a low level, and the electric potential of the second output terminal N3 (input terminal N1) of the SRAM 25 is at a high level. Thus, the first transfer gate 36 is driven, and the pixel electrode 21 is connected to the first control line 11. In this manner, a high level electric potential (H (15 V)) is input to the pixel electrode 21. Then, when the electric potential Vcom of the common electrode 22, to which a pulse-like signal is input, is at a low level (L (0 V)), a large difference in electric potential is generated between the electrodes 21 and 22. Thus, as shown in FIG. 5B, the black particles 43 of the electrophoretic element 23 are attracted toward the common electrode 22, and the white particles 42 are attracted toward the pixel electrode 21. As a result, black color is displayed on this pixel 2.

In contrast, in each of the pixels 2 of which image signals are at a low level, the electric potential of the first output terminal N2 of the SRAM 25 is at a high level, and the electric potential of the second output terminal N3 (input terminal N1) of the SRAM 25 is at a low level. Thus, the second transfer gate 37 is driven, and the pixel electrode 21 is connected to the second control line 12. However, because the second control line 12 is electrically disconnected, the pixel electrode 21 holds the electric potential that displays the preceding image as it is. As a result, the electrophoretic element 23 of this pixel does not operate and maintains the preceding image as it is.

Next, the white color image display period ST14 (second step) will be described. When the period proceeds to the white color image display period ST14, the common power supply modulation circuit 8 shown in FIG. 1 supplies a low level (L (0 V)) to the second control line 12 and also electrically disconnects the first control line 11 (Hi-Z). In this manner, a low level electric potential (L (0 V)) is input from the second control line 12 to the source side of the second transfer gate 37.

At this time, in each of the pixels 2 of which image signals are at a low level, the electric potential of the first output terminal N2 of the SRAM 25 is at a high level, and the electric potential of the second output terminal N3 (input terminal N1) of the SRAM 25 is at a low level. Thus, the second transfer gate 37 is driven, and the pixel electrode 21 is connected to the second control line 12. In this manner, a low level electric potential is input to the pixel electrode 21. Then, when the electric potential Vcom of the common electrode 22, to which a pulse-like signal is input, is at a high level (H (15 V)), a large difference in electric potential is generated between the electrodes 21 and 22. Thus, as shown in FIG. 5A, the white particles 42 are attracted toward the common electrode 22, and the black particles 43 are attracted toward the pixel electrode 21. As a result, white color is displayed on this pixel 2.

In contrast, in each of the pixels 2 of which image signals are at a high level, the electric potential of the first output terminal N2 of the SRAM 25 is at a low level, and the electric potential of the second output terminal N3 (input terminal N1) of the SRAM 25 is at a high level. Thus, the first transfer gate 36 is driven, and the pixel electrode 21 is connected to the first control line 11. However, because the first control line 11 is electrically disconnected, the electric potential of the pixel electrode 21 never varies and maintains the black image that has been displayed in the above black color image display period ST13.

In the above described black color image display period ST13 and white color image display period ST14, a reference pulse that repeats a high level (H) and a low level (L) at a predetermined interval is input to the common electrode 22. The above driving method is termed "common oscillation driving" in the description. In addition, the definition of common oscillation driving is a driving method in which, in an image update period, a pulse that repeats a high level and a low level is applied to the common electrode 22 at least one cycle or more.

According to this common oscillation driving method, it is possible to further reliably move the black particles and the white particles to the respective desired electrodes, so that the contrast may be improved. In addition, because the electric potential applied to the pixel electrode and the electric potential applied to the common electrode may be controlled using binary values, that is, a high level (H) and a low level (L), a control voltage may be made low, and the circuitry may be simplified. Moreover, when a TFT (Thin Film Transistor) is used as a switching element of the pixel electrode 21, it is advantageous in that the reliability of the TFT may be ensured by low voltage driving. Note that the frequency and periodicity of common oscillation driving are preferably determined appropriately according to the specifications and characteristics of the electrophoretic element 23.

As described above, when a new image is displayed on the display portion 3, the period proceeds to the power supply off period ST15. When the period proceeds to the power supply off period ST15, the common power supply modulation circuit 8 shown in FIG. 1 electrically disconnects the first control line 11, the second control line 12, the first power supply line 13 (high electric potential power supply terminal PH), the second power supply line 14 (low electric potential power supply terminal PL) and the common electrode power supply line 15. In this manner, the lines that are connected to the pixels 2 enter a high impedance state.

By providing the power supply off period ST15, it is possible to maintain an image without consuming power. In addition, when both the first control line 11 and the second control line 12, which are power sources of the pixel electrode 21, are electrically disconnected, a leakage path that extends from the pixel electrode 21 to the lines is interrupted, so that it is effective to reduce a leakage current as well.

Furthermore, by repeating the image signal input period ST12, the black color image display period ST13, the white color image display period ST14, and the power supply off period ST15 (ST11), it is possible to sequentially update and display an image. Note that the sequence of the white color image display period ST13 and the black color image display period ST14 may be interchanged.

In addition, by interchanging an electric potential supplied to the first control line 11 and an electric potential supplied to the second control line 12 each other, it is possible to display an inverted image. That is, when S1 is at a low level and S2 is at a high level, it is possible to perform an operation to invert a display image with a simple operation without inputting an inverted image signal to the SRAM 25 of each of the pixels.

Prevention of Leakage Current

Figure 7:
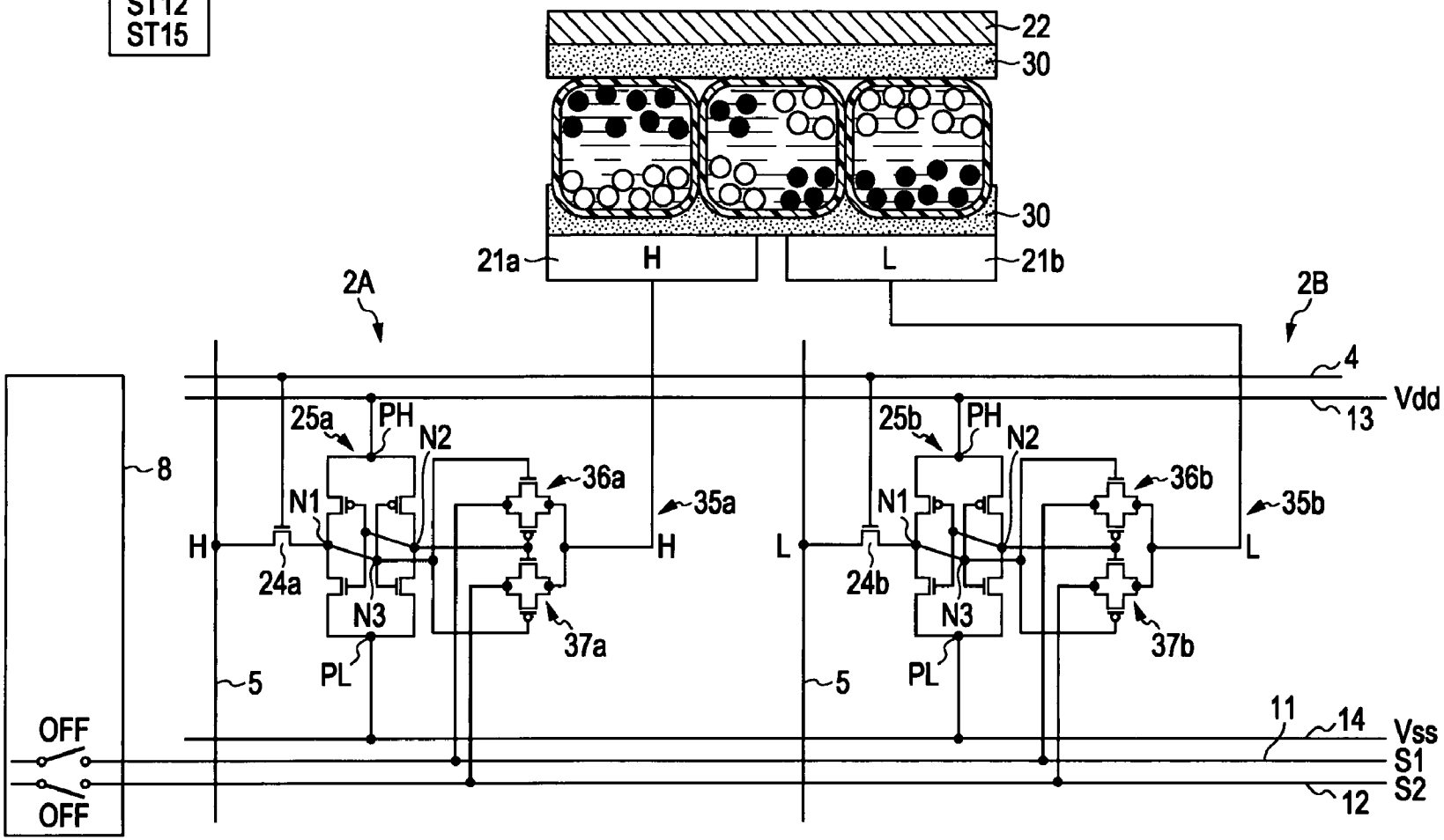
FIG. 7 is a schematic view of two adjacent pixels in the first driving method.
Figure 8:
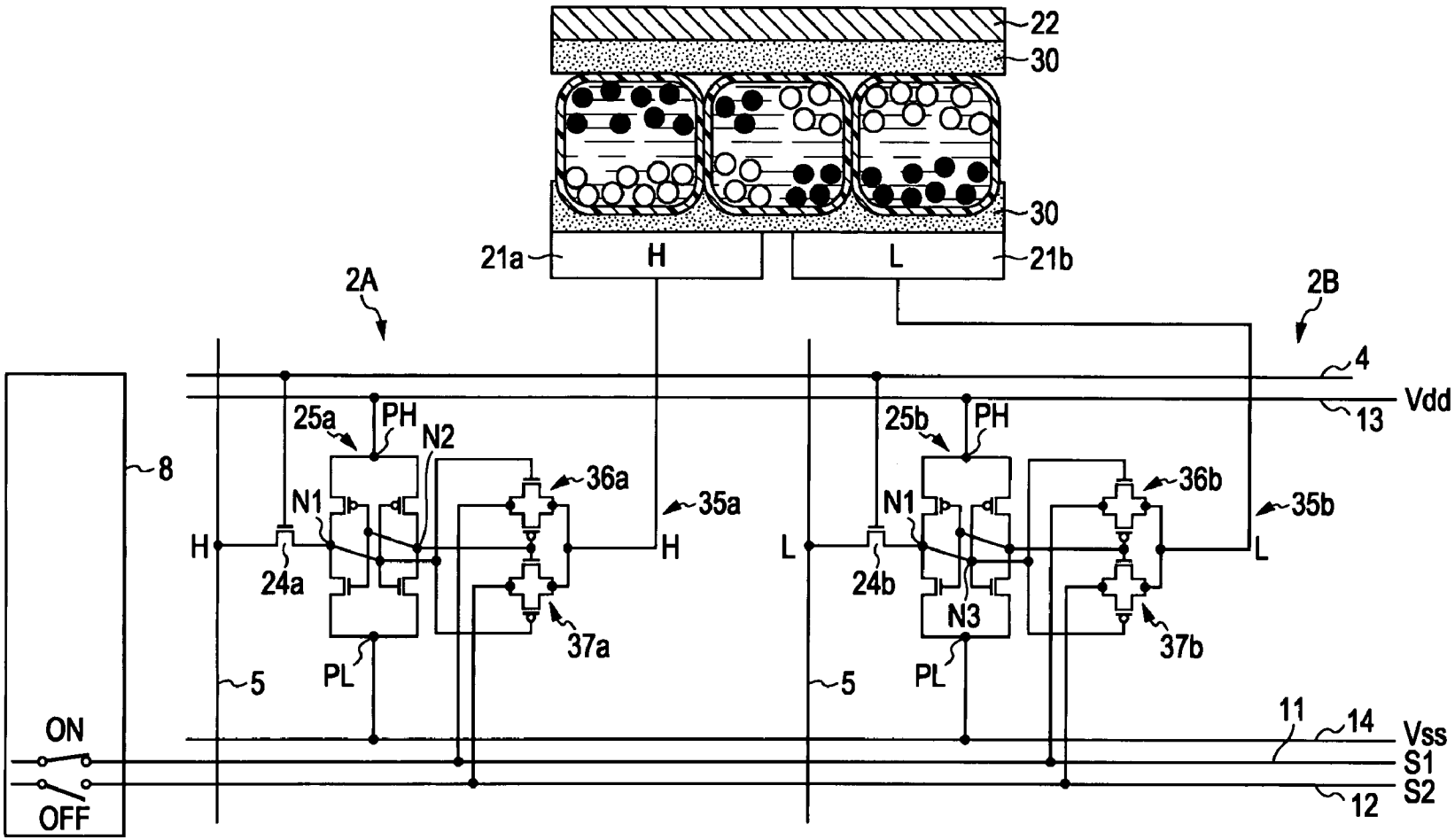
FIG. 8 is a schematic view of the two adjacent pixels in the first driving method.
Figure 9:
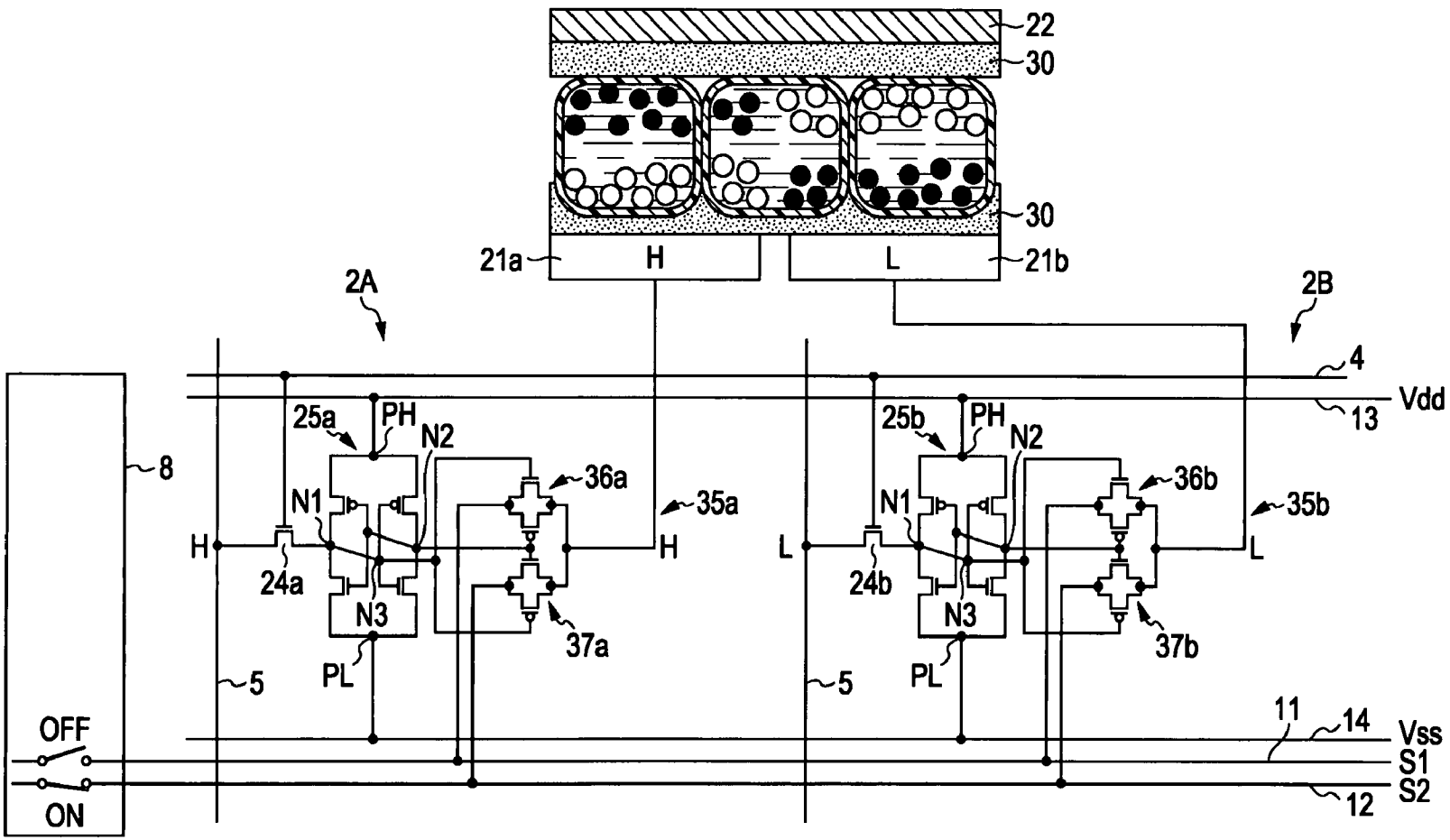
FIG. 9 is a schematic view of the two adjacent pixels in the first driving method.

FIG. 7, FIG. 8, and FIG. 9 are views, each of which schematically shows the adjacent pixels 2 of the display portion 3 shown in FIG. 1. FIG. 7 is a view showing the state of pixels 2A and 2B in the power supply off period ST11, in the image signal input period ST12, and in the power supply off period ST15. FIG. 8 is a view that shows the state of the pixels 2A and 2B in the black color image display period ST13. FIG. 9 is a view that shows the state of the pixels 2A and 2B in the white color image display period ST14.

In these drawings, the pixel 2A shown on the left side in each drawing includes a switch circuit 35*a* and a pixel electrode 21*a*. The switch circuit 35*a* includes a driving TFT 24*a*, an SRAM 25*a*, a first transfer gate 36*a* and a second transfer gate 37*a*. The pixel 2B shown on the right side in each drawing includes a switch circuit 35*b* and a pixel electrode 21*b*. The switch circuit 35*b* includes a driving TFT 24*b*, an SRAM 25*b*, a first transfer gate 36*b* and a second transfer gate 37*b*. Note that the pixels 2A and 2B do not differ in configuration from the pixel 2 shown in FIG. 2, and the suffixes "A" and "B" are used for the sake of convenience to identify the adjacent pixels. In addition, the suffixes "a" and "b" for the components are only used to clarify that each component belongs to which one of the pixels 2A and 2B and are not intended to be used for any other purposes.

In either one of FIG. 7, FIG. 8, and FIG. 9, the adjacent pixels 2 (2A and 2B) display different colors. For example, the pixel 2A displays black and the pixel 2B displays white. At this time, a high level (H) electric potential is input to the pixel electrode 21*a*, and a low level (L) is input to the pixel electrode 21*b*. Because an electric field is generated on the basis of a large difference in electric potential between the pixel electrodes 21*a* and 21*b* that are arranged adjacent to each other, the pixel electrodes 21*a* and 21*b* tend to cause a leakage current to flow through the adhesive layer 30.

However, in the above described first driving method, in the image signal input period ST12 (FIG. 7), in the black color image display period ST13 (FIG. 8), in the white color image display period ST14 (FIG. 9) and in the power supply off period ST15 (FIG. 7), at least one of the two control lines 11 and 12 is electrically disconnected by the common power supply modulation circuit 8 shown in FIG. 1. More specifically, in the state shown in FIG. 7, both the first control line 11 and the second control line 12 are electrically disconnected. In addition, in the state shown in FIG. 8, the second control line 12 is electrically disconnected, and, in the state shown in FIG. 9, the first control line 11 is electrically disconnected.

For this reason, a leakage current does not flow between the pixel electrodes 21*a* and 21*b*. Thus, according to this driving method, it is possible to suppress generation of a leakage current between the pixels. In this way, the function that is able to suppress a leakage current will be described below while comparing the existing circuit shown in FIG. 10.

Figure 10:
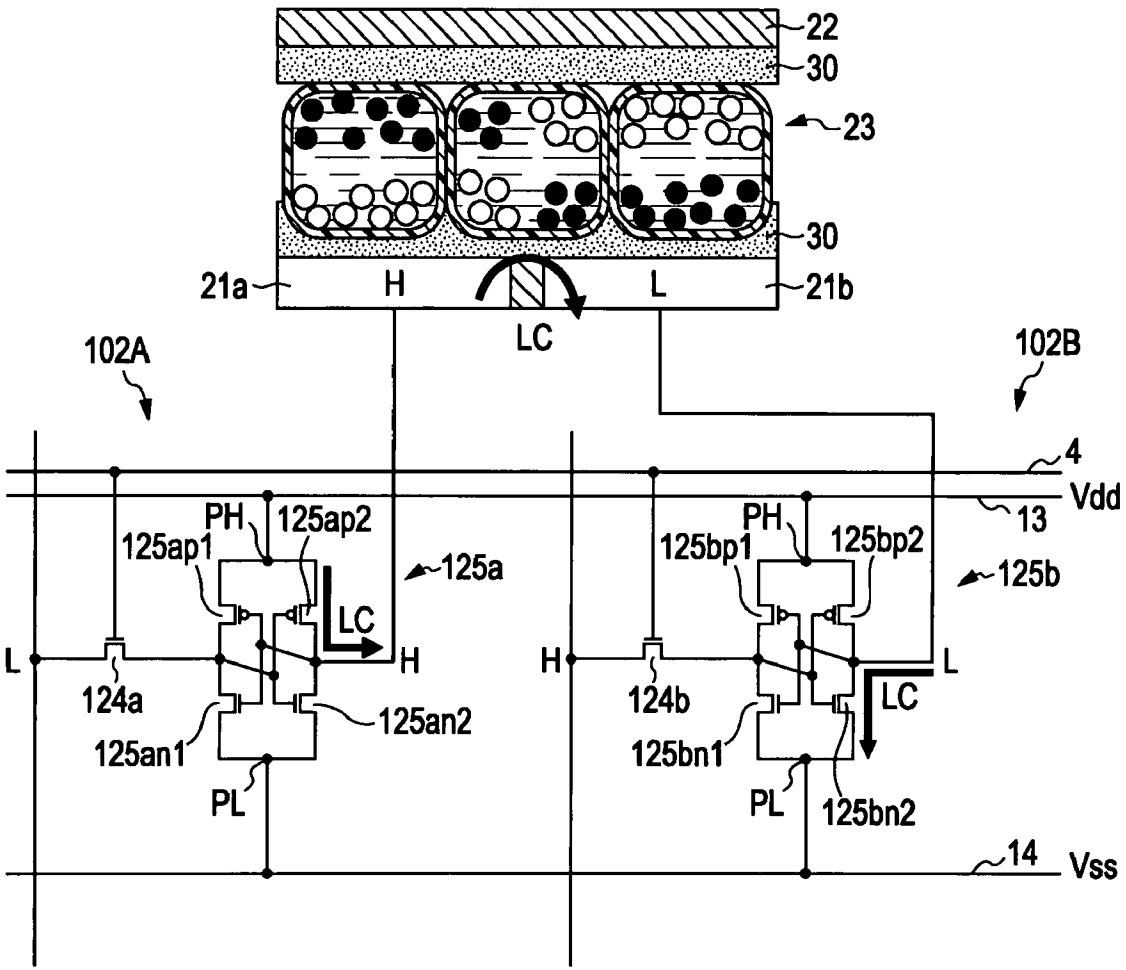
FIG. 10 is a circuitry diagram according to the existing art.

FIG. 10 is a view that shows the circuitry when the existing circuit is used. In the drawing, adjacent two pixels 102A and 102B are schematically shown.

The pixel 102A shown on the left side in FIG. 10 includes a driving TFT 124*a*, an SRAM 125*a*, and a pixel electrode 21*a*. The pixel 102B shown on the right side in FIG. 10 includes a driving TFT 124*b*, an SRAM 125*b*, and a pixel electrode 21*b*. The SRAM 125*a* is formed of P-MOSs 125*ap*1 and 125*ap*2 and N-MOSs 125*an*1 and 125*an*2, and the SRAM 125*b* is formed of P-MOSs 125*bp*1 and 125*bp*2 and N-MOSs 125*bnl* and 125*bn*2. That is, the pixels 102A and 102B each have a configuration that the switch circuit 35 is omitted from the pixel 2 shown in FIG. 2 and, then, the output terminal of the memory circuit is directly connected to the pixel electrode.

The adjacent pixels 102A and 102B display different colors. For example, the pixel 102A displays black, and the pixel 102B displays white. A high level (H) electric potential Vdd is input from the first power supply line 13 to the pixel electrode 21*a* through the P-MOS 125*ap*2, and a low level (L) electric potential Vss is input from the second power supply line 14 to the pixel electrode 21*b* through the N-MOS 125*bn*2.

At this time, an electric field (an electric field in the lateral direction) is generated on the basis of a large difference in electric potential between the pixel electrodes 21*a* and 21*b*. In this manner, a leakage path is formed to extend from the first power supply line 13 through the P-MOS 125*ap*2 of the SRAM 125*a*, the pixel electrode 21*a*, the adhesive layer 30, the pixel electrode 21*b*, the N-MOS 125*bn*2 of the SRAM 125*b* to the second power supply line 14 and thereby a leakage current LC flows between the pixels 102A and 102B. Then, when the leakage current LC flows, power consumption of the entire device increases. In addition, there is a possibility that the leakage current will become a corrosion current to corrode the pixel electrodes 21*a* and 21*b*. This adversely affects the reliability of the electrophoretic display device.

In contrast, according to the driving method of the aspects of the invention, when black color image display and white color image display are performed, one of the control lines 11 and 12 shown in FIG. 2 is electrically disconnected, so that a leakage current is not generated.

More specifically, in the electrophoretic display device according to the aspects of the invention, as shown in FIG. 7, by providing the switch circuits 35*a* and 35*b*, the pixel electrodes 21*a* and 21*b* are supplied with electric potential from the first control line 11 and the second control line 12 not through the SRAMs 25*a* and 25*b* but through the switch circuits 35*a* and 35*b*. Thus, the leakage path formed by an electric field generated between the pixel electrodes 21*a* and 21*b* is a path extending from the first control line 11 through the first transfer gate 36*a*, the pixel electrode 21*a*, the adhesive layer 30, the pixel electrode 21*b* and the second transfer gate 37*b* to the second control line 12, in each of FIG. 7 to FIG. 9.

Then, in the driving method according to the aspects of the invention, in the power supply off period ST11, and the like, both the first control line 11 and the second control line 12 are electrically disconnected. In addition, in the black color image display period ST13 and in the white color image display period ST14, shown in FIG. 8 and FIG. 9, one of the first control line 11 and the second control line 12 is electrically disconnected. Thus, the above described leakage current that extends from the first control line 11 through the pixels 2A and 2B to the second control line 12 is always interrupted, so that a leakage current is not generated.

Second Driving Method

Next, a second driving method will be described. The second driving method is a driving method in which, by further improving the first driving method, it is possible to further reliably prevent generation of a leakage current. Thus, the same reference numerals are assigned to the same periods in FIG. 11 as those of the first driving method, and the description thereof will be omitted.

Figure 11:
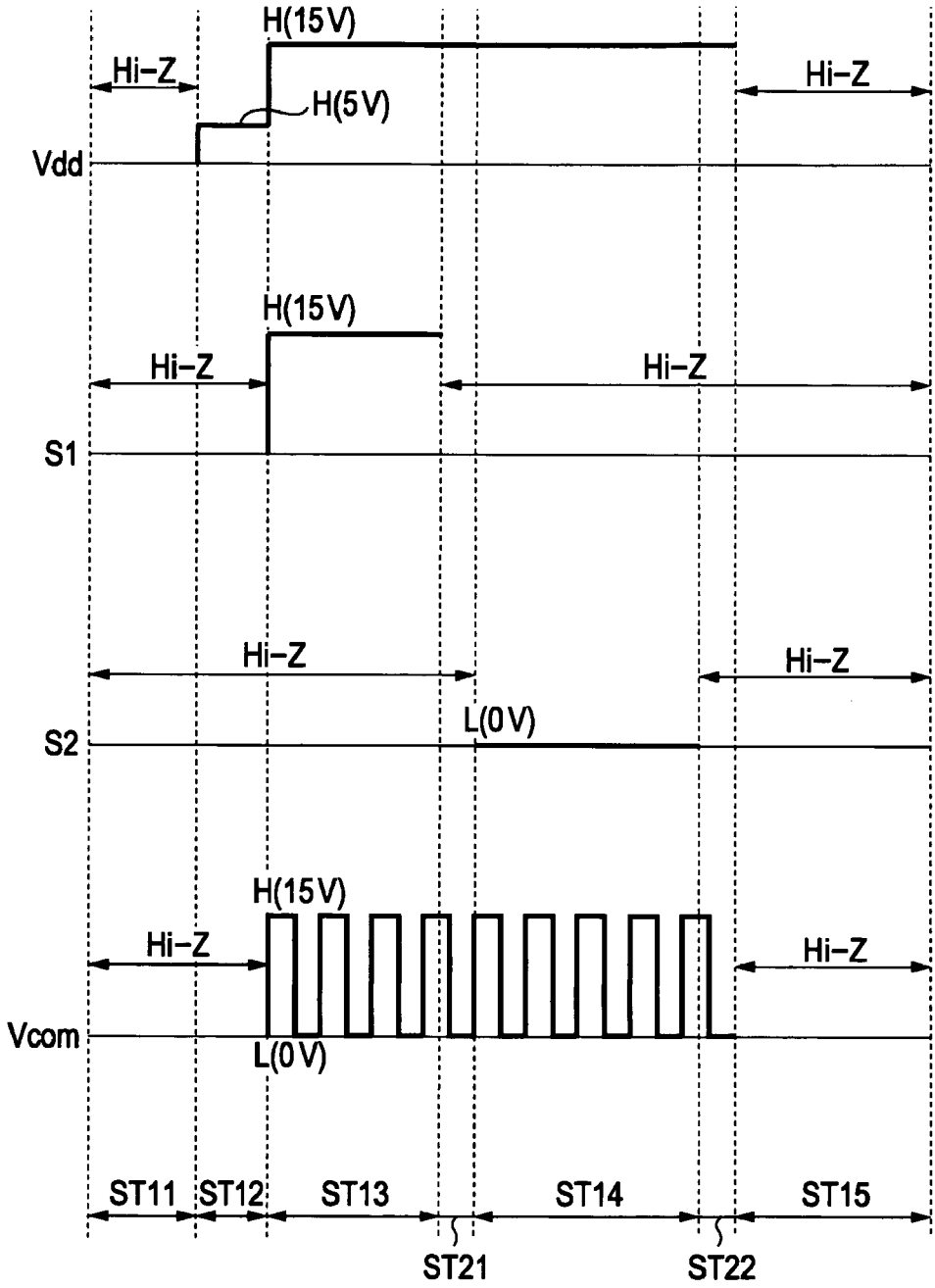
FIG. 11 is a view that shows a timing chart according to a second driving method.

FIG. 11 is a view that shows a timing chart according to the second driving method. In the drawing, the operation is performed in the sequence of a power supply off period ST11, an image signal input period ST12, a black color image display period ST13, a display image holding period ST21, a white color image display period ST14, a display image holding period ST22, and a power supply off period ST15, and the state where an image is displayed is shown. These operations are collectively shown in Table 2.

FIG. 11 shows an electric potential (an electric potential of the first power supply line 13) Vdd of the high electric potential power supply terminal PH of the SRAM 25, an electric potential S1 of the first control line 11, an electric potential S2 of the second control line 12, and an electric potential Vcom of the common electrode power supply line 15. In addition, specific voltage values (5 V, 15 V, 0 V, and the like) shown in Table 2 and FIG. 11 are exemplified for easier description, and are not intended to limit the scope of the invention.

TABLE 2

| | | STATE OF POWER SUPPLY LINE | | STATE OF CONTROL LINE | |
|---|---|---|---|---|---|
| SEQUENCE | PURPOSE OF OPERATION | FIRST POWER SUPPLY LINE 13 | SECOND POWER SUPPLY LINE 14 | FIRST CONTROL LINE 11 | SECOND CONTROL LINE 12 |
| ST11 | POWER SUPPLY OFF PERIOD | DISCONNECTED (Hi-Z) | DISCONNECTED (Hi-Z) | DISCONNECTED (Hi-Z) | DISCONNECTED (Hi-Z) |
| ST12 | IMAGE SIGNAL INPUT PERIOD | H (5 v) | L (0 v) | DISCONNECTED (Hi-Z) | DISCONNECTED (Hi-Z) |
| ST13 | BLACK COLOR IMAGE DISPLAY PERIOD | H (15 v) | L (0 v) | H | DISCONNECTED (Hi-Z) |
| ST21 | DISPLAY IMAGE HOLDING PERIOD | H (15 v) | L (0 v) | DISCONNECTED (Hi-Z) | DISCONNECTED (Hi-Z) |
| ST14 | WHITE COLOR IMAGE DISPLAY PERIOD | H (15 v) | L (0 v) | DISCONNECTED (Hi-Z) | L |
| ST22 | DISPLAY IMAGE HOLDING PERIOD | H (15 v) | L (0 v) | DISCONNECTED (Hi-Z) | DISCONNECTED (Hi-Z) |
| ST15 | POWER SUPPLY OFF PERIOD | DISCONNECTED (Hi-Z) | DISCONNECTED (Hi-Z) | DISCONNECTED (Hi-Z) | DISCONNECTED (Hi-Z) |

| | | | IMAGE DISPLAY | |
|---|---|---|---|---|
| SEQUENCE | PURPOSE OF OPERATION | STATE OF COMMON ELECTRODE 22 | PIXELS OF IMAGE SIGNAL H | PIXELS OF IMAGE SIGNAL L |
| ST11 | POWER SUPPLY OFF PERIOD | DISCONNECTED (Hi-Z) | PRECEDING IMAGE | |
| ST12 | IMAGE SIGNAL INPUT PERIOD | DISCONNECTED (Hi-Z) | UNCHANGED | UNCHANGED |
| ST13 | BLACK COLOR IMAGE DISPLAY PERIOD | PULSE | BLACK OF NEW IMAGE | UNCHANGED |
| ST21 | DISPLAY IMAGE HOLDING PERIOD | PULSE | UNCHANGED | UNCHANGED |
| ST14 | WHITE COLOR IMAGE DISPLAY PERIOD | PULSE | UNCHANGED | WHITE OF NEW IMAGE |
| ST22 | DISPLAY IMAGE HOLDING PERIOD | PULSE | UNCHANGED | UNCHANGED |
| ST15 | POWER SUPPLY OFF PERIOD | DISCONNECTED (Hi-Z) | NEW IMAGE | |

The second driving method differs from the above described first driving method in that the display image holding period ST21 is provided between the black color image display period ST13 and the white color image display period ST14, and the display image holding period ST22 is provided between the white color image display period ST14 and the power supply off period ST15. Then, because the operations in the other periods are the same in the corresponding periods of the first driving method, the period from the black color image display period ST13 to the display image holding period ST22 will be described in detail below.

In the black color image display period ST13, the electric potential S1 of the first control line 11 is made to a high level (H (15 V)), and the second control line 12 is made into a high impedance state where the second control line 12 is electrically disconnected. In addition, a pulse-like signal that repeats a high level (H (15 V)) and a low level (L (0 V)) is input to the common electrode 22 (Vcom). In this manner, as in the case of the first driving method, a black display is performed on the pixels 2 to which a predetermined image signal (high level) is input.

After that, the period proceeds to the display image holding period ST21. In the display image holding period ST21, by the common power supply modulation circuit 8 shown in FIG. 1, the first control line 11 and the second control line 12 both are electrically disconnected and these lines are made into a high impedance state (Hi-Z). At this time, a pulse-like signal is continuously input to the common electrode 22.

After that, when the period proceeds to the white color image display period ST14, the first control line 11 maintains a high impedance state where the first control line 11 is electrically disconnected, while, on the other hand, the second control line 12 is supplied with a low level (L) from the common power supply modulation circuit 8. In the meantime, a pulse-like signal is continuously input to the common electrode 22. In this manner, as in the case of the first driving method, a white display is performed on the pixels 2 to which a predetermined image signal (low level) is input.

After that, the period further proceeds to the display image holding period ST22. In the above period as well, as in the case of the above described display image holding period ST21, the first control line 11 and the second control line 12 both are made into a high impedance state where both the first control line 11 and the second control line 12 are electrically disconnected. Note that, in the present embodiment, a pulse-like signal is continuously input to the common electrode 22 in the display image holding period ST22 as well; however, it is applicable that a pulse input to the common electrode 22 is stopped and the common electrode 22 is made into a high impedance state.

As described above, in the driving method of the present embodiment, between the black color image display period ST13 during which only the first control line 11 is connected and the white color image display period ST14 during which only the second control line 12 is connected, the display image holding periods ST21 and ST22 during which the first control line 11 and the second control line 12 both are disconnected to be in a high impedance state are provided.

When both the first control line 11 and the second control line 12 are instantaneously connected when they are switched, a leakage path between the pixels is connected to thereby generate a leakage current. However, when an image is displayed by means of this driving method, both the lines are absolutely disconnected prior to switching between the first control line 11 and the second control line 12, so that, as shown in FIG. 7 to FIG. 9, at least one of the first control line 11 and the second control line 12 is absolutely electrically disconnected. Thus, a leakage path through the adhesive layer 30 is reliably interrupted, so that a leakage current is not generated.

In the present embodiment, it is applicable that, after the display image holding period ST22, the period not proceeds to the power supply off period ST15 but repeats the black color image display period ST13 and the white color image display period ST14. In this case, when the duration of each black color image display period ST13 and the duration of each white color image display period ST14 is made short and the number of times repeated is increased, black display and white display on the display portion 3 are repeated at a short interval. Thus, an updated image may be recognized more quickly. Note that, in all the periods between the repeated black color image display period ST13 and white color image display period ST14, the display image holding period during which the first control line 11 and the second control line 12 are made into a high impedance state is desirably provided.

In the present embodiment, because the period proceeds to the power supply off period ST15 immediately after the display image holding period ST22, it is not necessary to provide the display image holding period ST22. However, when the configuration has respective series of operations, that is, a set of the black color image display period ST13 and the immediately following display image holding period and a set of the white color image display period ST14 and the immediately following display image holding period, because the operation in which the first control line 11 and the second control line 12 are made into a high impedance state is absolutely inserted after display operation, it is possible to obtain a driving method that is able to reliably prevent generation of a leakage current.

Third Driving Method

Figure 12:
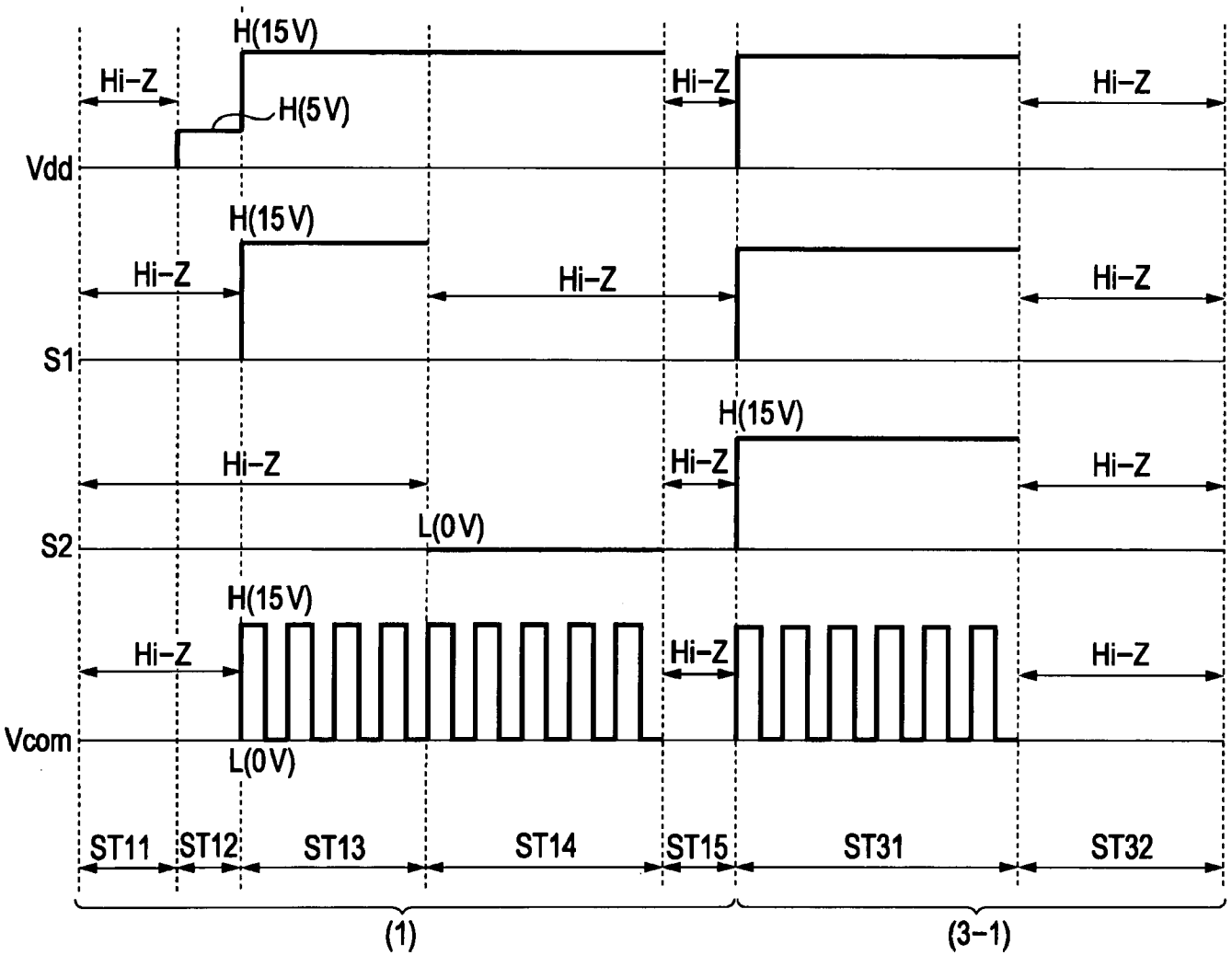
FIG. 12 is a view that shows a timing chart according to a third driving method.
Figure 13:
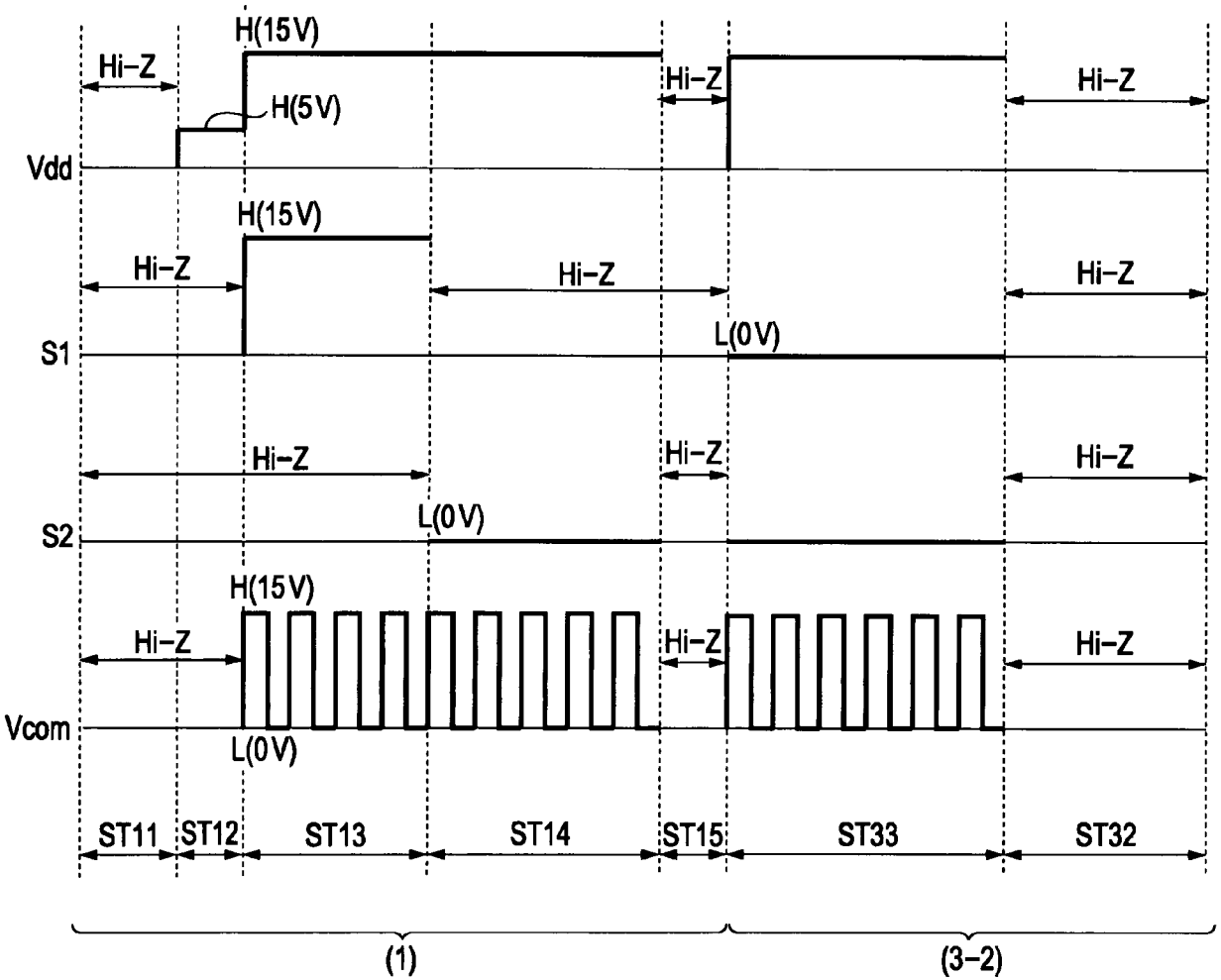
FIG. 13 is a view that shows a timing chart according to the third driving method.

Next, a third driving method will be described. The third driving method is a driving method by which white color or black color is displayed on each of the pixels 2. That is, the driving method may be applied to an operation by which an image is erased. FIG. 12 and FIG. 13 are views, each of which shows a timing chart according to the third driving method. In this example, the state of erasing an image after the image has been displayed using the first driving method is shown.

FIG. 12 and FIG. 13 show that the electric potential (electric potential of the first power supply line 13) Vdd of the high electric potential power supply terminal PH of the SRAM 25, the electric potential S1 of the first control line 11, the electric potential S2 of the second control line 12 and the electric potential Vcom of the common electrode power supply line 15. In addition, specific voltage values (5 V, 15 V, 0 V, and the like) shown in FIG. 12 and FIG. 13 are exemplified for easier description, and are not intended to limit the scope of the invention.

In FIG. 12, an image display period (1) during which the first driving method is used and an all black erasing period (3-1) during which the third driving method is used are executed. The all black erasing period (3-1) includes a black color image display period ST31, during which all the pixels display a black color image, and a power supply off period ST32.

As shown in FIG. 12, when an image display operation ends in the image display period (1) during which the first driving method is used, all the lines are in a high impedance state, that is, all the lines are electrically disconnected (power supply off period ST15). The period proceeds from this image holding state to the black color image display period ST31, during which all the pixels 2 display a black color image, within the all black erasing period (3-1).

When the period proceeds to the black color image display period ST31, the common power supply modulation circuit 8 inputs a high level (H (15 V)) to both the first control line 11 and the second control line 12. At this time, in each of the pixels 2, the first transfer gate 36 or the second transfer gate 37 is driven by an image signal that is held in the corresponding SRAM 25. Specifically, in each of the pixels 2 in which an image signal is at a high level, the electric potential of the first output terminal N2 of the SRAM 25 is at a low level, and the electric potential of the second output terminal N3 (input terminal N1) of the SRAM 25 is at a high level. Thus, the first transfer gate 36 is in an on state and thereby the pixel electrode 21 is connected to the first control line 11. On the other hand, in each of the pixels 2 in which an image signal is at a low level, the electric potential of the first output terminal N2 of the SRAM 25 is at a high level, and the electric potential of the second output terminal N3 (input terminal N1) of the SRAM 25 is at a low level. Thus, the second transfer gate 37 is in an on state and thereby the pixel electrode 21 is connected to the second control line 12.

Then, because both of the control lines 11 and 12 are supplied with a high level, a high level is input to the pixel electrode 21 of each of the pixels 2. In addition, a pulse-like signal that repeats a period of high level and a period of low level is input to the common electrode 22. As a result, irrespective of the electric potential (high level/low level) of an image signal that is held in the SRAM 25, black color is displayed on all the pixels 2. After that, the period proceeds to the power supply off period ST32, and the state in which all the pixels 2 display black is held.

Next, in the driving method shown in FIG. 13, the image display period (1) during which the first driving method is used and an all white erasing period (3-2) during which the third driving method is used are executed. The all white erasing period (3-2) includes a white color image display period ST33, during which all the pixels display a white color image, and the power supply off period ST32.

As shown in FIG. 13, the period proceeds from the image holding state, after the image display period (1) during which the first driving method is used, to the white color image display period ST33, during which all the pixels 2 display a white color image, within the all white erasing period (3-2).

when the period proceeds to the white color image display period ST33, the common power supply modulation circuit 8 inputs a low level (L (0 V)) to both the first control line 11 and the second control line 12. In the meantime, a pulse-like signal that repeats a period of high level and a period of low level is input to the common electrode 22, and then white color is displayed on all the pixels 2 on the basis of a difference in electric potential between the pixel electrode 21 and the common electrode 22. After that, the period proceeds to the power supply off period ST32, and the state in which all the pixels 2 display white is held.

Figure 14:
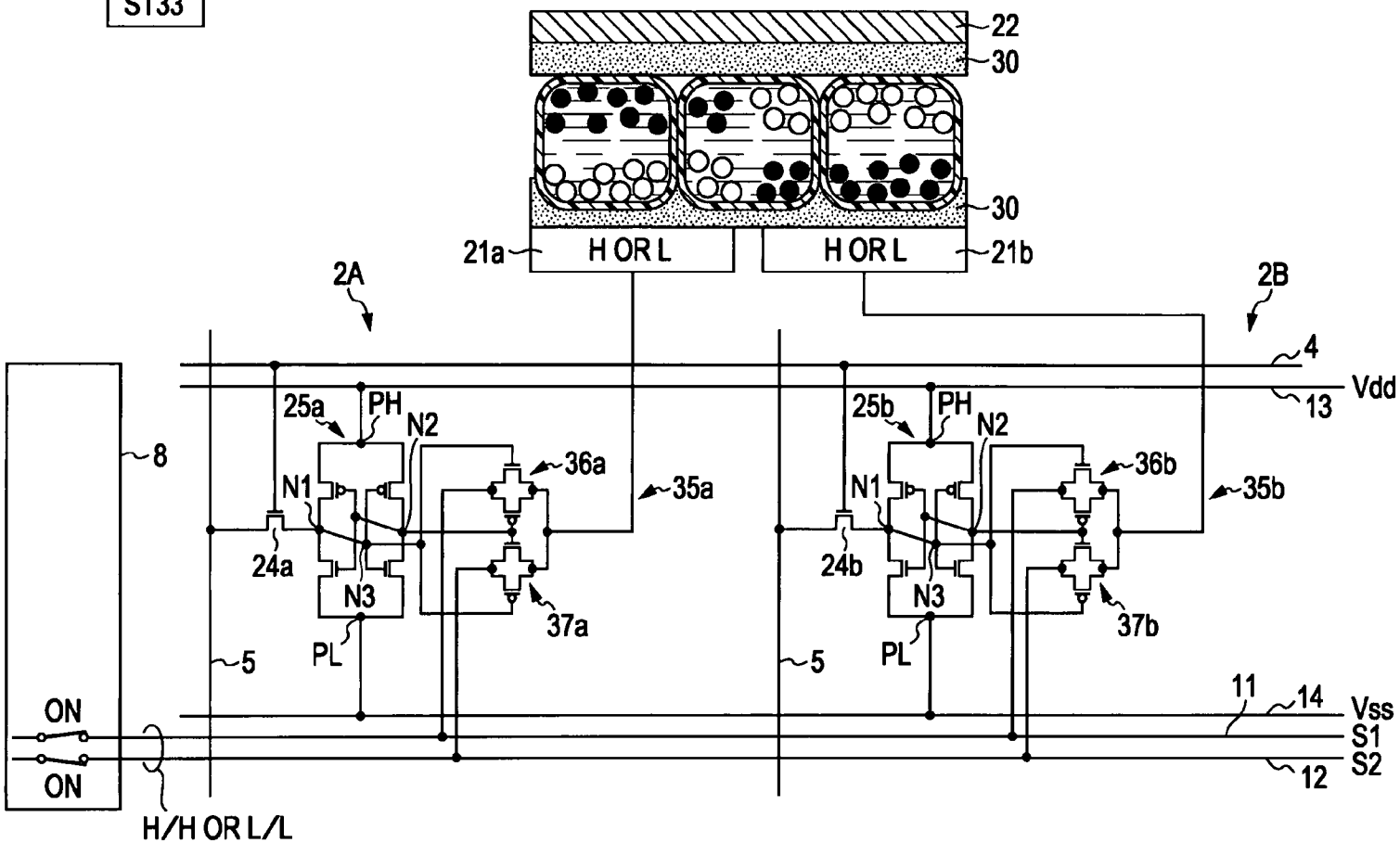
FIG. 14 is a schematic view of two adjacent pixels in the third driving method.

FIG. 14 is a view that shows the state of two adjacent pixels 2A and 2B in the third driving method. As described above, in the black color image display period ST31 and in the white color image display period ST33, both the first control line 11 and the second control line 12 are electrically connected. However, a high level or a low level is input to both the pixel electrodes 21*a* and 21*b*. Thus, a difference in electric potential is never generated between the pixel electrodes 21*a* and 21*b* and, therefore, a leakage current does not flow.

Fourth Driving Method

Figure 17:
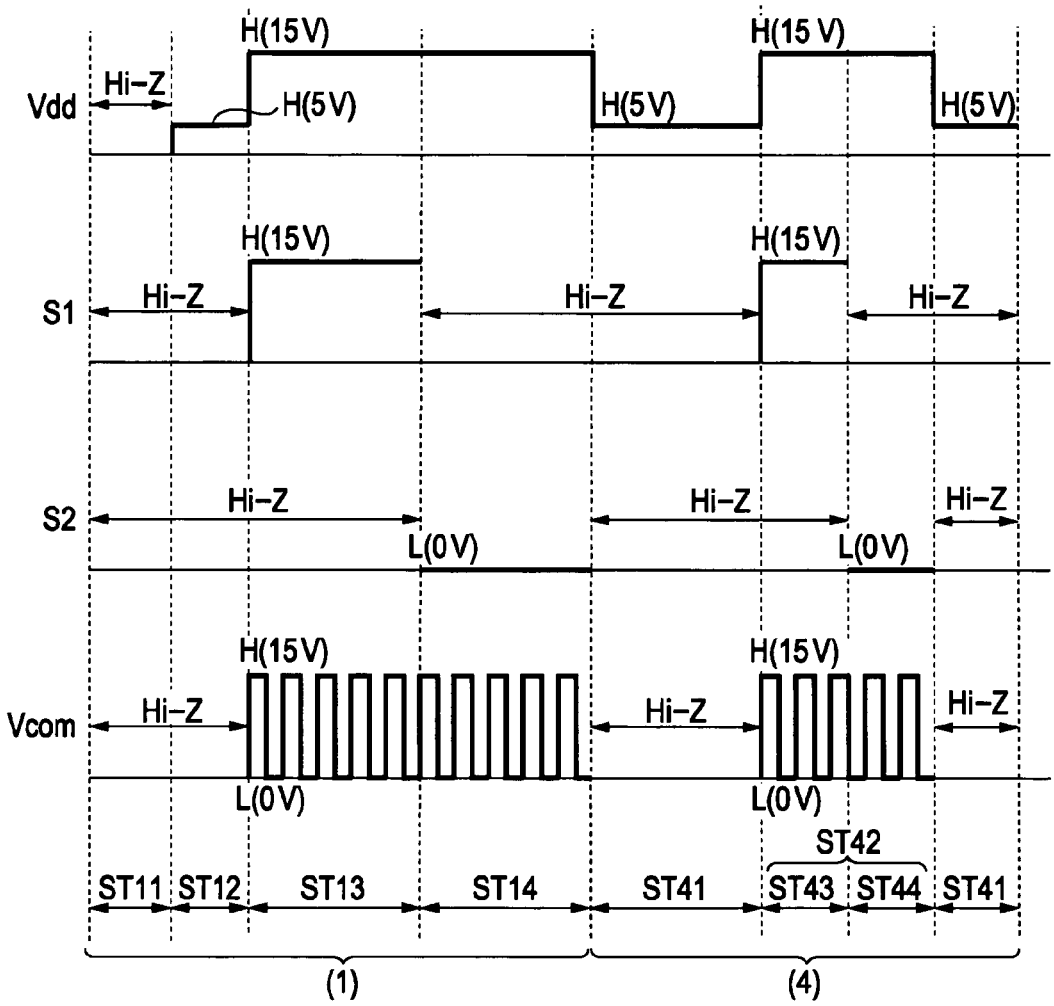
FIG. 17 is a view that shows a timing chart according to a fourth driving method.

Next, a fourth driving method according to the first embodiment will be described with reference to FIG. 17. FIG. 17 is a view that shows a timing chart according to the fourth driving method. FIG. 17 shows an electric potential (an electric potential of the first power supply line 13) Vdd of the high electric potential power supply terminal PH of the SRAM 25, an electric potential S1 of the first control line 11, an electric potential S2 of the second control line 12, and an electric potential Vcom of the common electrode power supply line 15. In addition, specific voltage values (5 V, 15 V, 0 V, and the like) shown in FIG. 17 are exemplified for easier description, and are not intended to limit the scope of the invention.

The fourth driving method is a driving method in which a display image holding period (4) is provided in place of the power supply off period ST15 of the first driving method described above. Thus, the same reference numerals are assigned to the same periods in FIG. 17 as those of the first driving method, and the description thereof will be omitted.

In the first driving method, after an image displayed on the display portion 3 has been updated, the period proceeds to the power supply off period ST15 when all the lines are made to enter a high impedance state. In contrast, in the fourth driving method, the period proceeds to a display image holding period (4) during which an interval period ST41 and a refresh period ST42 are alternately provided. That is, the fourth driving method is able to hold a display image at an appropriate contrast over a long period of time.

As shown in FIG. 17, after the white color image display period ST14 during which the first driving method is used ends and then the period proceeds to the interval period ST41, the first control line 11, the second control line 12 and the common electrode 22 are made into a high impedance state where the first control line 11, the second control line 12 and the common electrode 22 are electrically disconnected by the common power supply modulation circuit 8. On the other hand, the high electric potential power supply terminal PH (first power supply line 13) of the SRAM 25 is not made into a high impedance state but is decreased in voltage from 15 V to 5 V and then a high level is held. Although not shown in the drawing, the electric potential Vss of the low electric potential power supply terminal PL (second power supply line 14) is held at a low level (L (0 V)). That is, in the interval period ST41, the SRAM 25 maintains a power on state of low voltage driving and holds an image signal that is input in the image signal input period ST12.

Note that specific voltage values (15 V, 5 V) of the high electric potential power supply terminal PH are examples and are not limited to these voltage values. For example, Vdd in the interval period ST41 may be set to a further low electric potential (for example, 1 V) in the range in which an image signal is allowed to be held in the SRAM 25.

Next, after the period proceeds to the interval period ST41 and then a predetermined time has elapsed, the period proceeds to the refresh period ST42. The refresh period ST42 includes a black color image display period ST43 and a white color image display period ST44.

First, when the period proceeds to the black color image display period ST43, the electric potential Vdd of the high electric potential power supply terminal PH of the SRAM 25 is increased to 15 V. In addition, a high level (H (15 V)) is input to the first control line 11. The second control line 12 remains in a high impedance state.

At this time, in each of the pixels 2 in which a high level image signal is held, the first transfer gate 36 enters an on state on the basis of the output of the SRAM 25 and thereby the pixel electrode 21 is connected to the first control line 11. In this manner, a high level (H (15 V)) is input from the first control line 11 to the pixel electrode 21. Then, a pulse-like signal is input to the common electrode 22, and the black display operation of each pixel 2 is performed on the basis of a difference in electric potential between the pixel electrode 21 and the common electrode 22. Through this black display operation, it is possible to recover the contrast, which has been decreasing over time in each pixel 2 of black display, to the state immediately after a display image is updated. Note that, in each of the pixels 2 in which a low level image signal is held, the second transfer gate 37 enters an on state and, thereby, the second control line 12 is connected to the pixel electrode 21. However, the second control line 12 is in a high impedance state, so that the electric potential of the pixel electrode 21 does not vary. Thus, the display of this pixel 2 remains unchanged.

Next, when the period proceeds to the white color image display period ST44, the first control line 11 is made into a high impedance state while the Vdd is being held at 15 V. Thus, a low level (L (0 V)) is input to the second control line 12. In this manner, in each of the pixels 2 in which a low level image signal is held, the second transfer gate 37 enters an on state on the basis of the output of the SRAM 25 and thereby the pixel electrode 21 is connected to the second control line 12. In this manner, a low level is input to the pixel electrode 21. Then, because a pulse-like signal is input to the common electrode 22, the white display operation of each pixel 2 is performed on the basis of a difference in electric potential between the pixel electrode 21 and the common electrode 22. Through this white display operation, it is possible to recover the contrast, which has been decreasing over time in each pixel 2 of black display, to the state immediately after a display image is updated. Note that, in the white color image display period ST44, the display of each pixel 2 that displays black remains unchanged.

After the contrast of the display image has been recovered in the above refresh period ST42, the period proceeds to the interval period ST41 again. That is, while an image signal is held with a minimum power consumption by decreasing the driving voltage of the SRAM 25, other lines are made into a high impedance state to thereby prevent a leakage current. Thus, a display image is held over a long period of time. After that, when the interval period ST41 and the refresh period ST42, which are set to a predetermined period of time, are alternately repeated, it is possible to hold an appropriate contrast.

As described above, according to the fourth driving method, because the interval period ST41 and the refresh period ST42 are provided, it is possible to hold a display image without decreasing the contrast over a long period of time. In addition, in the interval period ST41, because power of the SRAM 25 is not turned off but the operating state of the SRAM 25 is held, it is possible to perform a refresh operation without inputting an image signal to the SRAM 25 again, and also it is possible to eliminate power consumption due to the transfer of image signals. Furthermore, because, in the interval period ST41, the electric potential Vdd of the high electric potential power supply terminal PH is decreased, it is possible to suppress an increase in power consumption in the display image holding period (4).

Note that the duration of the interval period ST41 is not particularly limited; however, the amount of decrease in contrast increases as the duration is increased and, in accordance with that, it is necessary to increase the duration of the refresh period ST42. In addition, a variation in contrast due to the refresh operation is noticeable and, therefore, is more likely to be recognized. Then, the duration of the interval period ST41 should be set so that the refresh operation is performed before an excessive decrease in contrast occurs.

In addition, in the refresh period ST42, the sequence of the black color image display period ST43 and the white color image display period ST44 may be interchanged. In addition, a period during which both the first control line 11 and the second control line 12 are made into a high impedance state may be provided between the black color image display period ST43 and the white color image display period ST44. Furthermore, as the refresh period ST42, a period during which black display and white display are performed at the same time may be provided. In this case, in the refresh period ST42, the electric potential is input to the first control line 11 and the second control line 12 at the same time, and a pulse-like signal is input to the common electrode 22. In this driving method, a leakage current is more likely to be generated because the electric potential is input to both the first control line 11 and the second control line 12 at the same time; however, because the refresh operation of an image ends in a short time, the influence on power consumption is smaller in comparison with the case where the same driving method is used when a display image is updated.

Second Embodiment

Next, a second embodiment of the invention will be described. An electrophoretic display device according to the present embodiment is provided with a switch circuit formed of two transistors (first and second transistors) in place of the switch circuit 35 formed of four transistors in the first embodiment. In addition, hereinafter, in regard to the electrophoretic display device of the second embodiment, a plurality of examples (first to third configuration examples) in which a configuration is modified will be described.

The first configuration example has a configuration in which a switch circuit uses a P-MOS as a first transistor and uses an N-MOS as a second transistor. The second configuration example has a configuration in which a switch circuit uses an N-MOS for either one of the first transistor and the second transistor. The third configuration example has a configuration in which a switch circuit uses a P-MOS for either one of the first transistor and the second transistor.

FIRST CONFIGURATION EXAMPLE

Figure 18:
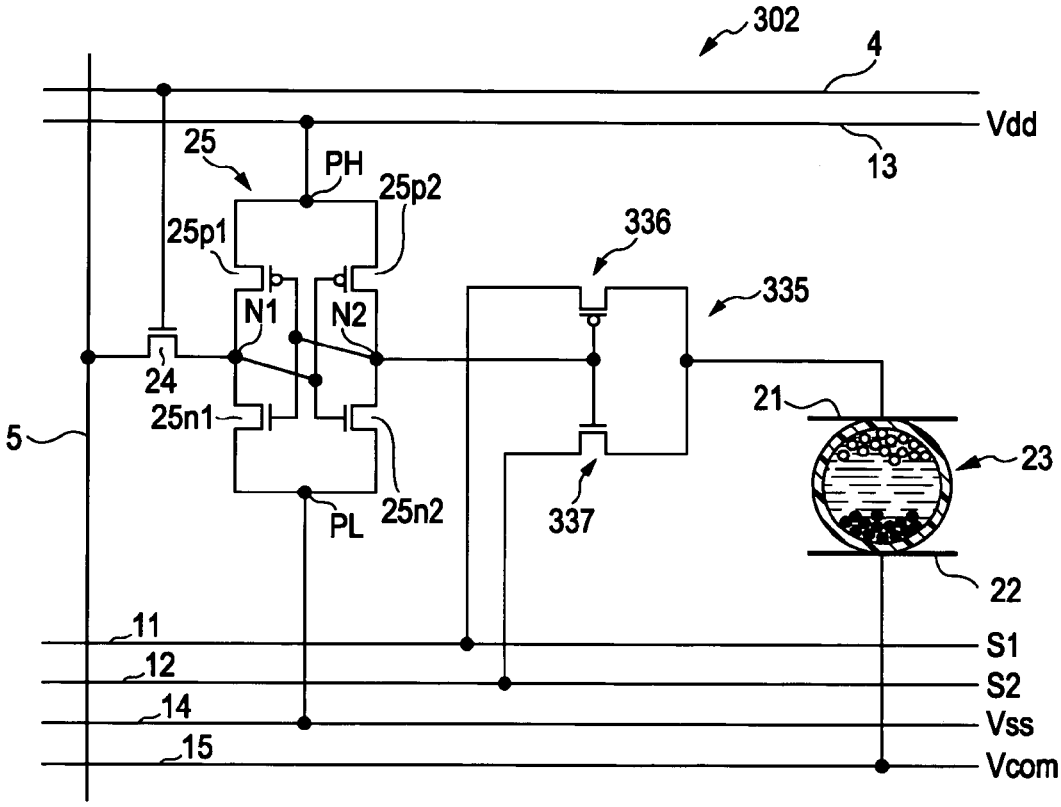
FIG. 18 is a circuitry diagram of a pixel according to a first configuration example of a second embodiment.

FIG. 18 is a circuit diagram of a pixel 302 provided in an electrophoretic display device according to the first configuration example of the second embodiment. The pixel 302 shown in FIG. 18 is configured to include a switch circuit 335 formed of a P-MOS (first transistor) 336 and an N-MOS (second transistor) 337 in place of the switch circuit 35 of the pixel 2 shown in FIG. 2. Thus, hereinafter, the same reference numerals are assigned to the same components as those shown in FIG. 2, and the description thereof will be omitted.

In the pixel 302, the switch circuit 335 is connected between the output terminal N2 of the SRAM 25 and the pixel electrode 21. The gate terminal of the P-MOS 336 and the gate terminal of the N-MOS 337 are connected to each other and are also connected to the output terminal N2 of the SRAM 25. The source terminal of the P-MOS 336 is connected to the first control line 11, and the drain terminal thereof is connected to the pixel electrode 21. The source terminal of the N-MOS 337 is connected to the second control line 12, and the drain terminal thereof is connected to the pixel electrode 21.

In the above configured pixel 302, when a high level (H) is input as an image signal, a low level electric potential (Vss) is output from the output terminal N2 of the SRAM 25. In this manner, the P-MOS 336 enters an on state and, thereby, the first control line 11 is connected to the pixel electrode 21. On the other hand, when a low level (L) is input as an image signal, a high level electric potential (Vdd) is output from the output terminal N2 of the SRAM 25. In this manner, the N-MOS 337 enters an on state and, thereby, the second control line 12 is connected to the pixel electrode 21.

Thus, the pixel 302 according to the present embodiment, as well as the pixel 2 according to the preceding embodiment, operates the switch circuit 335 on the basis of an electric potential of an image signal that is input to the SRAM 25, and, the electric potential S1 of the first control line 11 or the electric potential S2 of the second control line 12 is input to the pixel electrode 21 in such a manner that the first control line 11 or the second control line 12 is connected to the pixel electrode 21.

Driving Method

Next, the driving method of the electrophoretic display device according to the first configuration example will be described with reference to Table 3 and FIG. 19 to FIG. 29. In the present embodiment, multiple driving modes (normal image display, inverted image display, all white display, and all black display) of the electrophoretic display device will be described.

TABLE 3

| | IMAGE SIGNAL | EFFECTIVE CONTROL LINE (ELECTRIC POTENTIAL) | PIXEL ELECTRODE ELECTRIC POTENTIAL | COMMON ELECTRODE ELECTRIC POTENTIAL H | COMMON ELECTRODE ELECTRIC POTENTIAL L | DISPLAY COLOR |
|---|---|---|---|---|---|---|
| NORMAL IMAGE DISPLAY | H | S1 (VH) | VH | VH | VL | BLACK |
| | L | S2 (VL) | VL | | | WHITE |
| INVERTED IMAGE DISPLAY | H | S1 (VL) | VL + Vthp | VH − Vthn | VL + Vthp | WHITE |
| | L | S2 (VH) | VH − Vthn | | | BLACK |
| ALL WHITE DISPLAY | H | S1 (VL) | VL + Vthp | VH | VL + Vthp | WHITE |
| | L | S2 (VL) | VL | | | WHITE |
| ALL BLACK DISPLAY | H | S1 (VH) | VH | VH − Vthn | VL | BLACK |
| | L | S2 (VH) | VH − VthN | | | BLACK |

Table 3 is a table that shows an electric potential input to the pixel 302 in each operation of the normal image display (grayshade that coincides with image data), the inverted image display (display of which image data are inverted in gray scale), the all white display (all the pixels perform white display) and all black display (all the pixels perform black display) in comparison with one another.

Note that, in Table 3, "image signal" is a high level (H) or low level (L) electric potential that is input to the data line 5. In addition, in Table 3 and FIG. 19 to FIG. 29, "VH" is a high level electric potential that is supplied to the first control line 11 or the second control line 12, and "VL" is a low level electric potential that is supplied to the first control line 11 or the second control line 12. "Vthp" is a threshold voltage value of the P-MOS 336, and "Vthn" is a threshold voltage value of the N-MOS 337.

Normal Image Display

Figure 19:
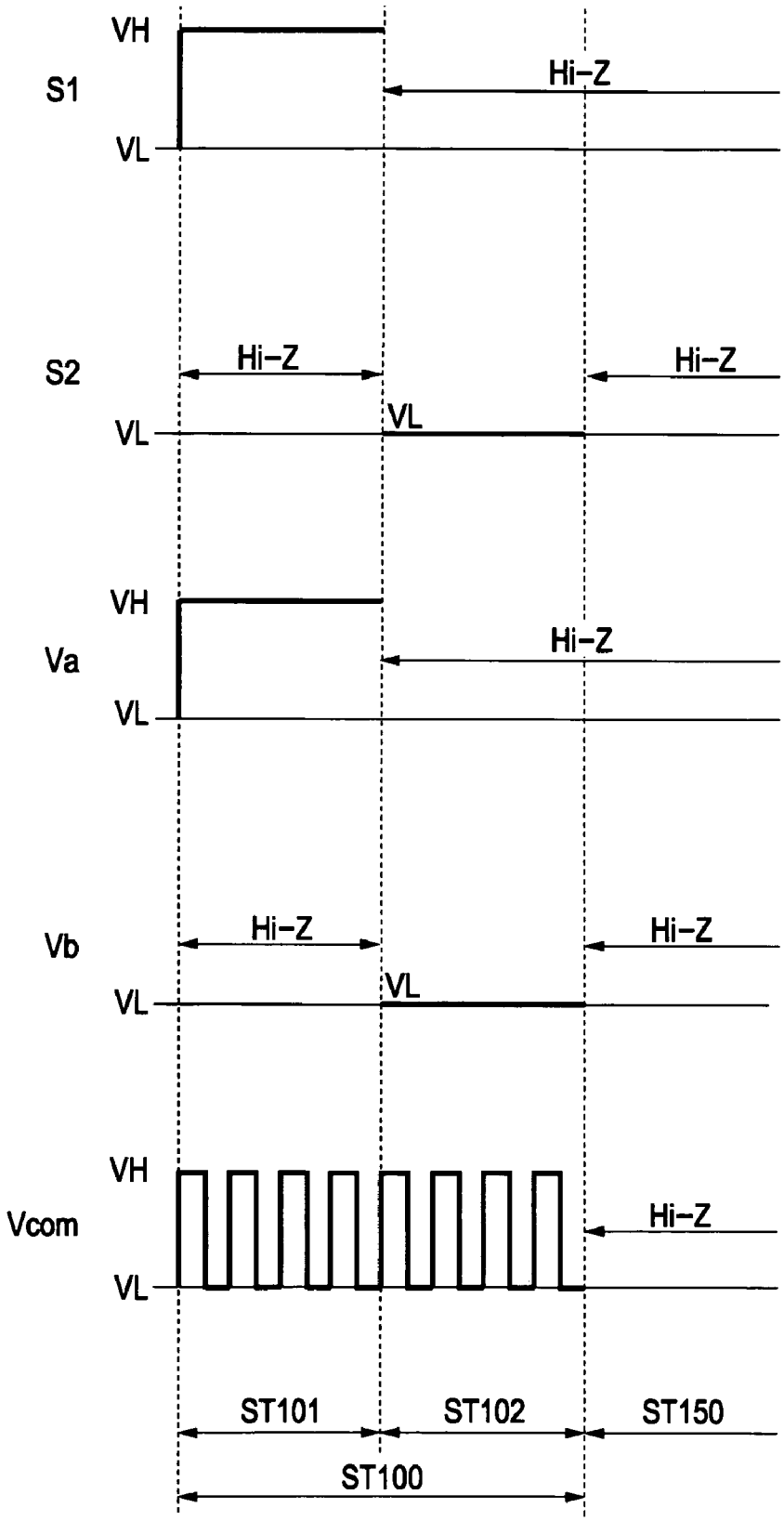
FIG. 19 is a timing chart of a normal image display according to the first configuration example.
Figure 20:
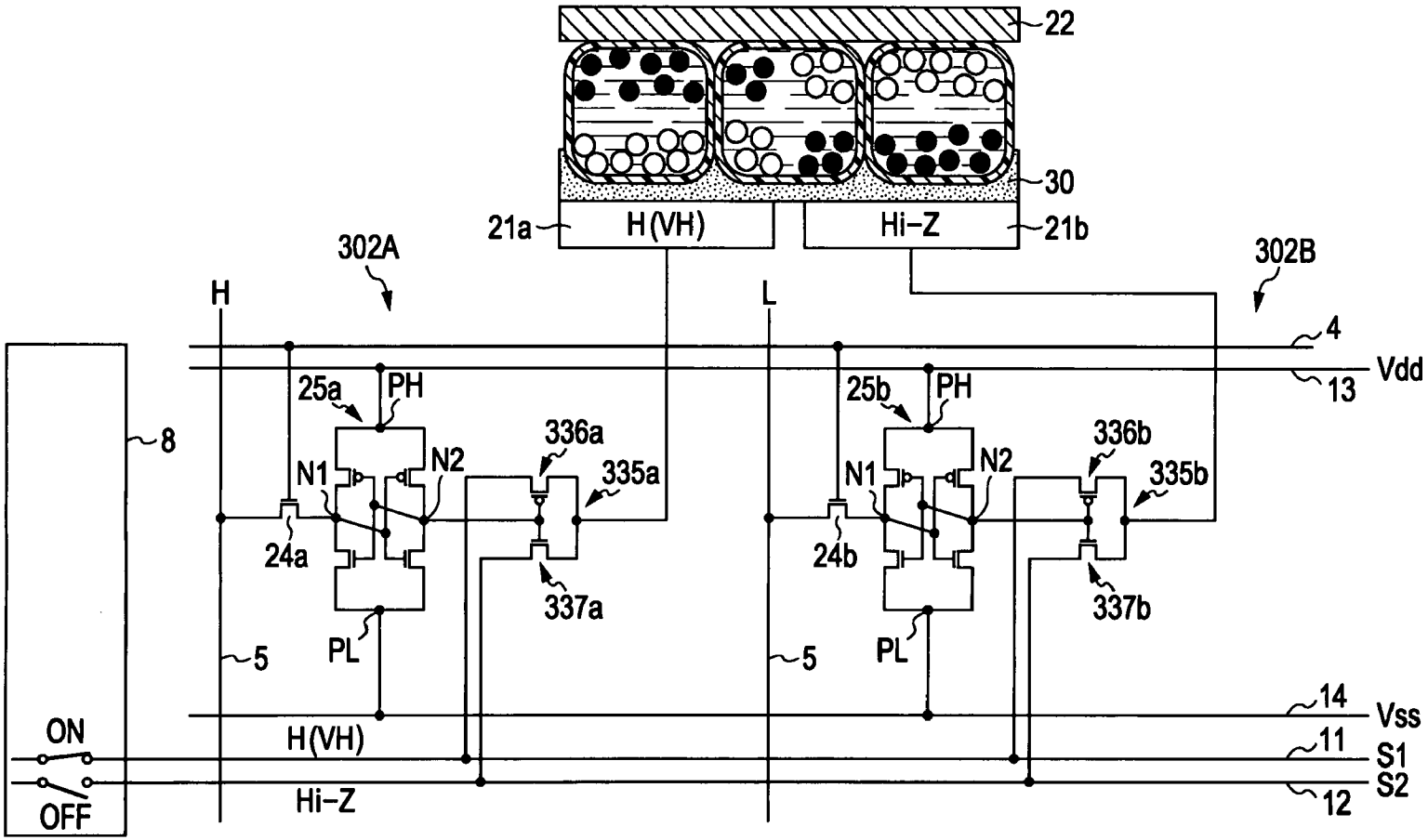
FIG. 20 is a view that shows the state of adjacent pixels in the normal image display.
Figure 21:
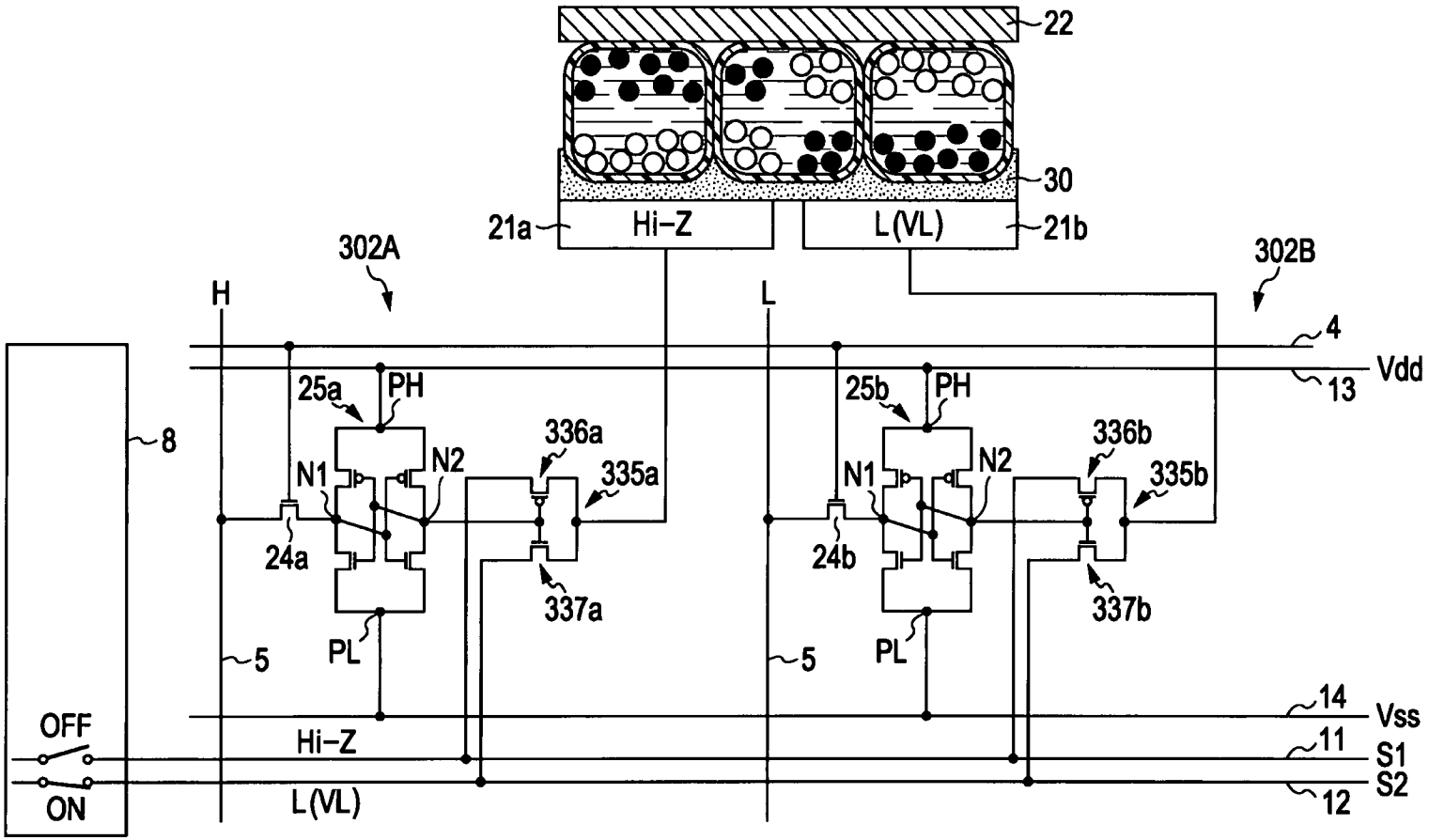
FIG. 21 is a view that shows the state of the adjacent pixels in the normal image display.

FIG. 19 is a view that shows a timing chart in the normal image display. FIG. 20 and FIG. 21 are views, each of which shows the state of adjacent two pixels in the normal image display.

Hereinafter, among the pixels 302 that constitute the display portion 3, adjacent two pixels 302A and 302B shown in FIG. 20 will be described. The pixel 302A is a pixel that performs black display, and the pixel 302B is a pixel that performs white display. Note that the suffixes "A", "B", "a", and "b" of the reference numerals of the components shown in FIG. 20 and FIG. 21 are used for the sake of convenience to clearly identify the two pixels 302A and 302B that are arranged adjacent to each other and the components that belong to these pixels, and the pixels 302A and 302B do not differ in configuration from the pixel 302 shown in FIG. 18.

FIG. 19 shows the electric potential S1 of the first control line 11, the electric potential S2 of the second control line 12, the electric potential Va of the pixel electrode 21*a* in the pixel 302A that performs black display, the electric potential Vb of the pixel electrode 21*b* in the pixel 302B that performs white display, and the electric potential Vcom of the common electrode 22.

The sequence of the normal image display shown in FIG. 19 includes a normal image display period ST100 and a power supply off period ST150. In the normal image display period ST100, a black color image display period ST101 and a white color image display period ST102 are sequentially executed. FIG. 20 shows the state of the pixels 302A and 302B in the black color image display period ST101. In addition, FIG. 21 shows the state of the pixels 302A and 302B in the white color image display period ST102.

Although not shown in the drawing, before the normal image display period ST100, an image signal is input to the pixel 302. The operation in inputting an image signal is the same as that of the image signal input period ST12 that is described above with reference to FIG. 6 in the above first embodiment, so that the description thereof will be omitted. Then, the following description of each driving mode will be made under the condition that a high level (H) image signal is held in the SRAM 25*a* of the pixel 302A, and a low level (L) image signal is held in the SRAM 25*b* of the pixel 302B.

First, in the black color image display period ST101 within the normal image display period ST100, as shown in FIG. 19 and FIG. 20, a high level electric potential VH is supplied to the first control line 11, and the second control line 12 is made into a high impedance state (Hi-Z) where the second control line 12 is electrically disconnected.

Then, in the pixel 302A that holds a high level (H) image signal, a low level electric potential Vss is output to the output terminal N2 of the SRAM 25*a*. In this manner, the P-MOS 336*a* enters an on state and thereby the first control line 11 is electrically connected to the pixel electrode 21*a*. Thus, a high level electric potential VH is input to the pixel electrode 21*a*. On the other hand, in the pixel 302B that holds a low level (L) image signal, a high level electric potential Vdd is output from the output terminal N2 of the SRAM 25*b* and thereby the N-MOS 337*b* enters an on state. However, because the second control line 12 is in a high impedance state, the pixel electrode 21*b* remains in a high impedance state.

In addition, a pulse-like signal that repeats a period of high level (VH) and a period of low level (VL) at a predetermined interval is input to the common electrode 22. As described above, on the basis of a difference in electric potential between the common electrode 22 and the pixel electrodes 21*a* and 21*b*, the pixel 302A performs black display, and the display of the pixel 302B remains unchanged.

Next, in the white color image display period ST102, as shown in FIG. 19 and FIG. 21, the first control line 11 is made into a high impedance state where the first control line 11 is electrically disconnected, and the second control line 12 is supplied with a low level electric potential VL. In this manner, the pixel electrode 21*a* that is connected to the first control line 11 through the P-MOS 336*a* is made into a high impedance state, while, on the other hand, a low level electric potential VL is input to the pixel electrode 21*b* that is connected to the second control line 12 through the N-MOS 337*b*. In the meantime, a pulse-like signal is continuously input to the common electrode 22. As described above, while the display of the pixel 302A is held as it is, the pixel 302B performs white display.

After that, when the period proceeds to the power supply off period ST150, at least the first control line 11 and the second control line 12 enters a high impedance state where one of the lines is electrically disconnected. Thus, an image that is written in the normal image display period ST100 is maintained. Note that, in the power supply off period ST150, the scanning line 4 or the data line 5 may be made into a high impedance state.

In addition, the SRAM 25 may be made into a power off state in such a manner that the first power supply line 13 and the second power supply line 14 are made into a high impedance state. However, when the operation (for example, the operation to invert display, the operation to refresh display, or the like) based on an image signal input to the SRAM 25 is performed after the normal image display period ST100, only the SRAM 25 is made into a power on state. In this manner, it is not necessary to transfer an image signal again when another operation is performed. In addition, at this time, when the power supply voltage (Vdd) of the SRAM 25 is set to a minimum limit power supply voltage that is able to hold a stored electric potential, it is possible to suppress power consumed by the operation of the SRAM 25.

As described above, the electrophoretic display device according to the first configuration example is able to display an image in the same sequence as that electrophoretic display device according to the above first embodiment. In addition, as shown in FIG. 20 and FIG. 21, the second control line 12 is made into a high impedance state in the black color image display period ST101, and the first control line 11 is made into a high impedance state in the white color image display period ST102, so that a leakage path due to the lateral electric field between the adjacent pixel electrodes 21*a* and 21*b* is always interrupted. Thus, a leakage current due to a difference in electric potential between the adjacent pixels will not be generated.

Inverted Image Display

Next, the inverted image display will be described with reference to Table 3 and FIG. 22 to FIG. 24. The inverted image display, as shown in Table 3, may be executed by the same operation as that of the normal image display except that the electric potentials (VH, VL) of the first and second control lines 11 and 12 are interchanged with each other.

Figure 22:
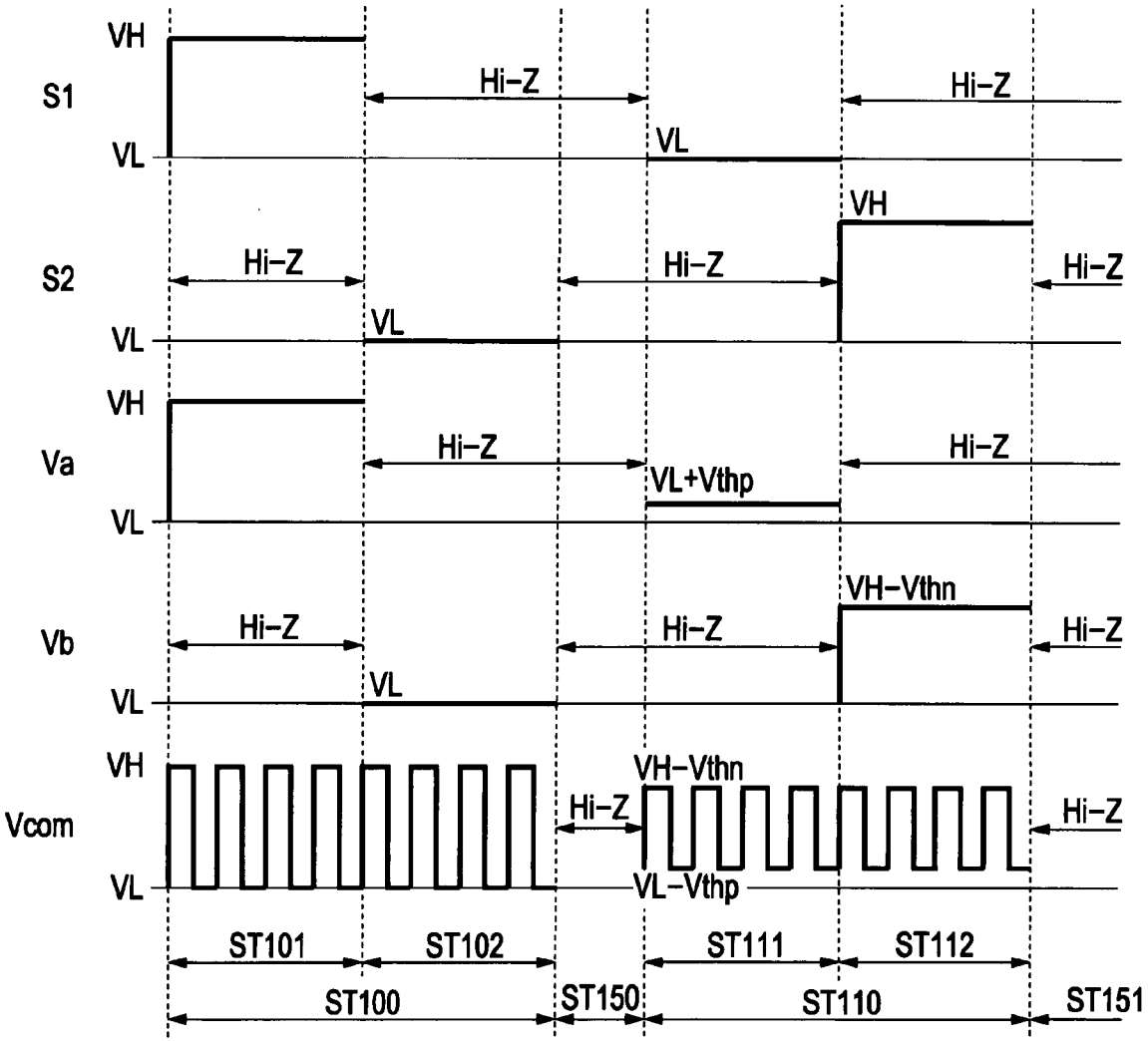
FIG. 22 is a timing chart of an inverted image display according to the first configuration example.

FIG. 22 is a view that shows a timing chart in the inverted image display. FIG. 23 and FIG. 24 are views, each of which shows the state of adjacent two pixels in the inverted image display, and respectively correspond to FIG. 20 and FIG. 21 in the normal image display. FIG. 22 shows the normal image display period ST100, the power supply off period ST150, an inverted image display period ST110 and a power supply off period ST151. That is, FIG. 22 shows a sequence in which, after the normal image display has been performed, the display image is inverted.

The inverted image display period ST110 includes a white color inversion display period ST111 during which the pixel is inverted from black display to white display and a black color inversion display period ST112 during which the pixel is inverted from white display to black display. FIG. 23 shows the state of the pixels 302A and 302B in the white color inversion display period ST111. FIG. 24 shows the state of the pixels 302A and 302B in the black color inversion display period ST112.

In the power supply off period ST150 after the normal image display period ST100, the pixel 302A performs black display, and the pixel 302B performs white display. Then, when the period proceeds from the power supply off period ST150 to the white color inversion display period ST11, a low level electric potential VL is supplied to the first control line 11, while, on the other hand, the second control line 12 is made into a high impedance state where the second control line 12 is electrically disconnected.

In the pixel 302A in which a high level (H) image signal is held, the P-MOS 336*a* enters an on state and thereby the first control line 11 is electrically connected to the pixel electrode 21*a*. As a result, a low level electric potential (VL+Vthp) is input to the pixel electrode 21*a*.

Here, not the electric potential VL of the first control line 11 but the electric potential (VL+Vthp) is input to the pixel electrode 21*a* is due to the following reasons. In the P-MOS 336*a*, when a difference in electric potential Vgs between the electric potential of the source terminal (electric potential of the first control line 11) and the electric potential of the gate terminal (electric potential of the output terminal N2) is larger than the threshold voltage value Vthp of the P-MOS 336*a*, the P-MOS 336*a* enters an on state. However, when the electric potential difference Vgs is smaller than the threshold voltage value Vthp, the P-MOS 336*a* is made to enter an off state. Thus, the drain electric potential ultimately decreases to a minimum electric potential (VL+Vthp) by which the P-MOS 336*a* can maintain an on state, and this electric potential is input as a low level electric potential of the pixel electrode 21*a*.

Then, a pulse-like signal that repeats a period of high level electric potential (VH−Vthn) and a low level electric potential (VL+Vthp) at a predetermined interval is input to the common electrode 22. In this manner, the pixel 302A that has been performing black display in the normal image display period ST100 is inverted from black display to white display. On the other hand, in the pixel 302B in which a low level (L) image signal is held, the N-MOS 337*b* enters an on state and thereby the second control line 12 is electrically connected to the pixel electrode 21*b*. Thus, the pixel electrode 21*b* enters a high impedance state, and white display is maintained.

Figure 24:
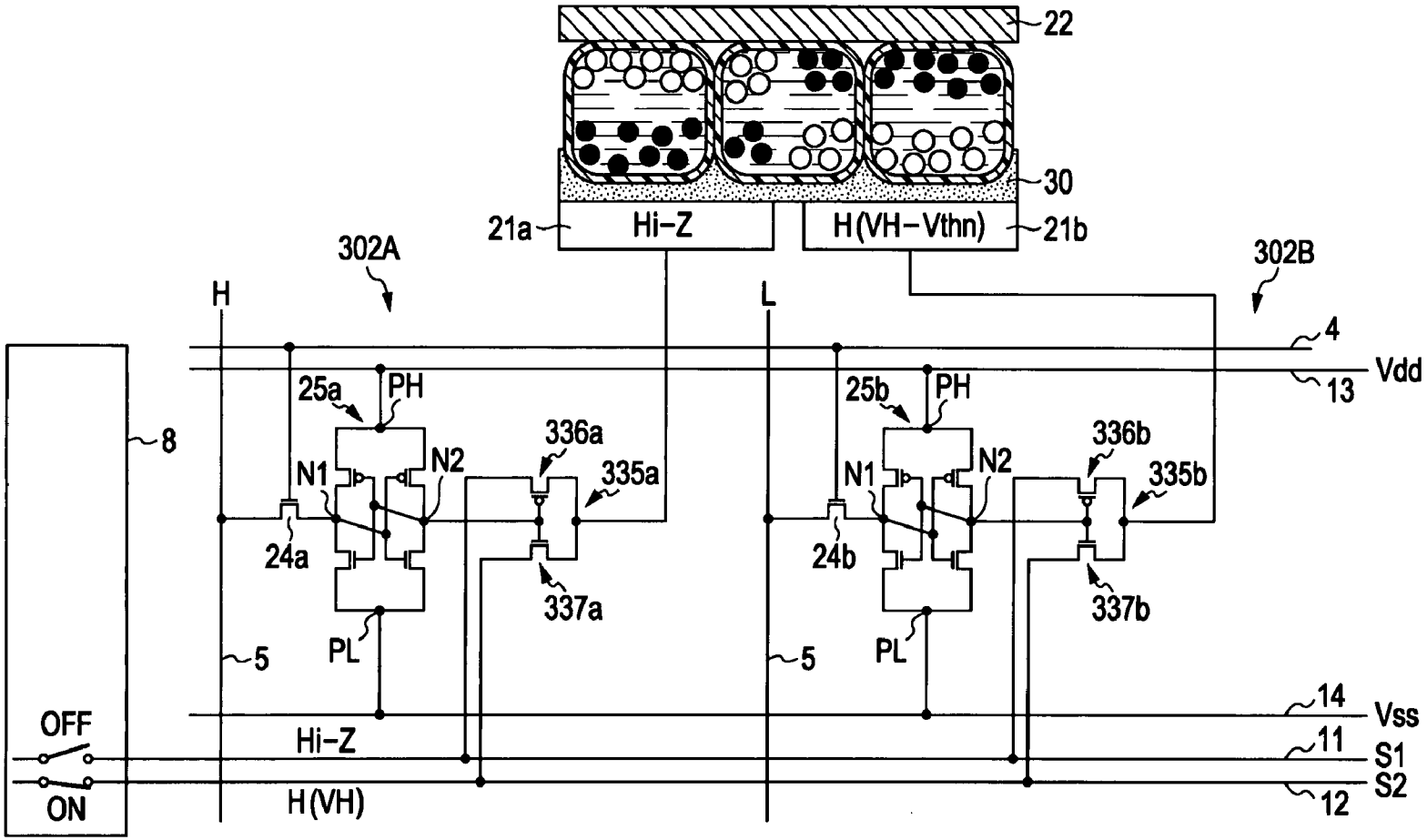
FIG. 24 is a view that shows the state of the adjacent pixels in the inverted image display.

Next, when the period proceeds to the black color inversion display period ST112, as shown in FIG. 22 and FIG. 24, the first control line 11 is made into a high impedance state where the first control line 11 is electrically disconnected, and the second control line 12 is supplied with a high level electric potential VH.

In the pixel 302A in which a high level (H) image signal is held, the first control line 11 is electrically connected to the pixel electrode 21*a* and, thereby, the pixel electrode 21*a* enters a high impedance state. On the other hand, in the pixel 302B in which a low level (L) image signal is held, the second control line 12 is electrically connected to the pixel electrode 21*b* and, thereby, a high level electric potential (VH−Vthn) is input to the pixel electrode 21*b*.

Here, not the electric potential VH of the second control line 12 but the electric potential (VH−Vthn) is input to the pixel electrode 21*b* is due to the following reasons. When a difference in electric potential Vgs between the electric potential of the gate terminal of the N-MOS 337*b* (electric potential of the output terminal N2) and the electric potential of the source terminal thereof (electric potential of the second control line 12) is larger than the threshold voltage value Vthn of the N-MOS 337*b*, the N-MOS 337*b* enters an on state. However, when the electric potential difference Vgs is smaller than the threshold voltage value Vthn, the N-MOS 337*b* is made to enter an off state. Thus, the drain electric potential ultimately increases to a maximum electric potential (VH−Vthn) by which the N-MOS 337*b* can maintain an on state, and this electric potential is input as a high level electric potential of the pixel electrode 21*b*.

Then, a pulse-like signal that repeats a period of high level electric potential (VH−Vthn) and a low level electric potential (VL+Vthp) at a predetermined interval is continuously input to the common electrode 22. In this manner, the pixel 302B that has been performing white display in the normal image display period ST100 is inverted from white display to black display, as shown in FIG. 24.

After that, when the period proceeds to the power supply off period ST151, all the lines connected to the pixels 302A and 302B are made into a high impedance state where all the lines are electrically disconnected and, thereby, the inverted image that is written in the inverted image display period ST110 is maintained.

Note that the high level electric potential and the low level electric potential that are input to the common electrode 22 are respectively differentiated from the electric potential (VL) of the first control line 11 and the electric potential (VH) of the second control line 11 in the inverted image display period ST110; this is because the electric potential Va of the pixel electrode 21*a* of the pixel 302A in the white color inversion display period ST111 becomes (VL+Vthp) and the electric potential Vb of the pixel electrode 21*b* of the pixel 302B in the black color inversion display period ST112 becomes (VH−Vthn).

More specifically, when the low level electric potential of the pulse that is input to the common electrode 22 is set to VL, in the pixel 302A in which the pixel electrode 21*b* is at a low level electric potential (VL+Vthp), the low level electric potential of the common electrode 22 becomes lower than the low level electric potential of the pixel electrode 21. Thereafter, in the pixel 302A in which a white display operation should be originally performed, an electric field that is the same as that of the black display operation is formed. In this manner, in the pixel performing a white display operation, white particles move in a direction away from the common electrode 22 and, as a result, the display quality is deteriorated. In addition, when the high level electric potential of the pulse input to the common electrode 22 is set to VH, in the pixel 302A in which the pixel electrode 21*a* is at a high level electric potential (VH−Vthn), the high level electric potential of the common electrode 22 becomes higher than the high level electric potential of the pixel electrode 21. Thereafter, in the pixel 302B performing a black display operation, black particles move in a direction away from the common electrode 22 and, as a result, the display quality is deteriorated. For the above reasons, in the embodiment of the invention, the electric potential of the pulse that is applied to the common electrode 22 is adjusted in conformity to the low level electric potential (VL+Vthp) of the pixel electrode 21*a* and the high level electric potential (VH−Vthn) of the pixel electrode 21*b*.

Note that, if the electric potential difference Vgs is sufficiently ensured in the P-MOS 336*a* and the N-MOS 337*b*, a variation in drain electric potential by an amount of threshold voltage value as described above does not occur. However, when the driving voltage of each circuit is formed of only positive power supply in order to ensure a difference in electric potential applied to the electrophoretic element, the low level electric potential Vss of the SRAM 25 and the low level electric potential VL of the first control line 11 become the same electric potential (for example, 0 V), and the high level electric potential Vdd of the SRAM 25 and the high level electric potential VH of the second control line 12 become the same electric potential (for example, 15 V). In this case, the above described variation in drain electric potential occurs. Thus, in the present embodiment, in order for the variation in drain electric potential not to cause inconvenience of display, the electric potential of the common electrode 22 is adjusted.

As described above, in the electrophoretic display device according to the first configuration example, it is possible to easily invert a display image in such a manner that the electric potential of the first control line 11 and the electric potential of the second control line 12 are inverted with respect to the electric potentials applied in the normal image display. That is, it is not necessary to transfer image data again in order to invert a display image, and also it is possible to perform a variety of display images while suppressing power consumption.

Figure 23:
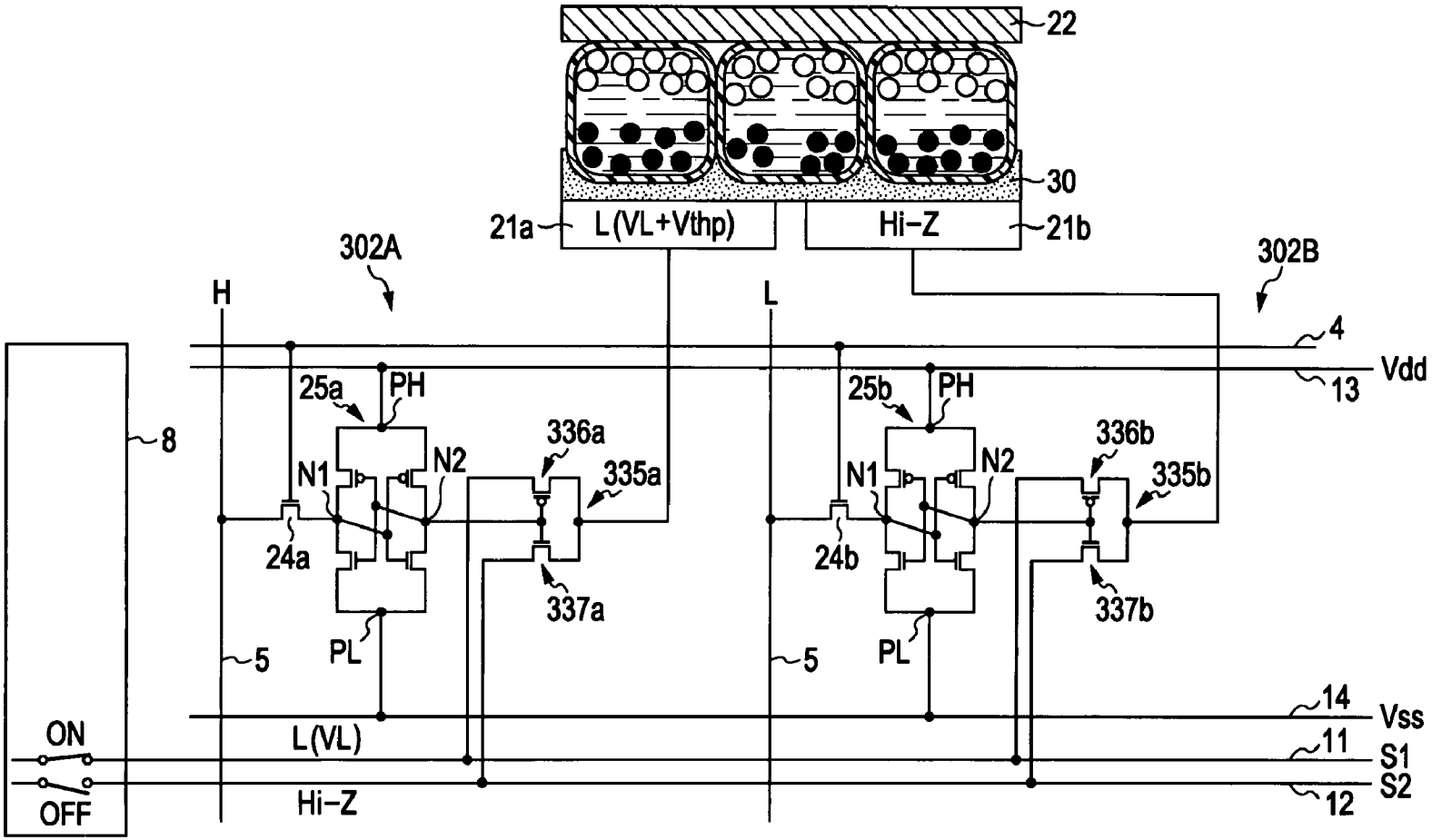
FIG. 23 is a view that shows the state of adjacent pixels in the inverted image display.

In addition, as shown in FIG. 23 and FIG. 24, the second control line 12 is made into a high impedance state in the white color inversion display period ST111, and the first control line 11 is made into a high impedance state in the black color inversion display period ST112, so that a leakage path due to the lateral electric field between the adjacent pixel electrodes 21*a* and 21*b* is always interrupted. Thus, a leakage current due to a difference in electric potential between the adjacent pixels will not be generated.

All White Display

Next, the all white display will be described with reference to Table 3 and FIG. 25 and FIG. 26. The all white display, as shown in Table 3, is performed in such a manner that a low level electric potential VL is supplied to both the first control line 11 and the second control line 12.

Figure 25:
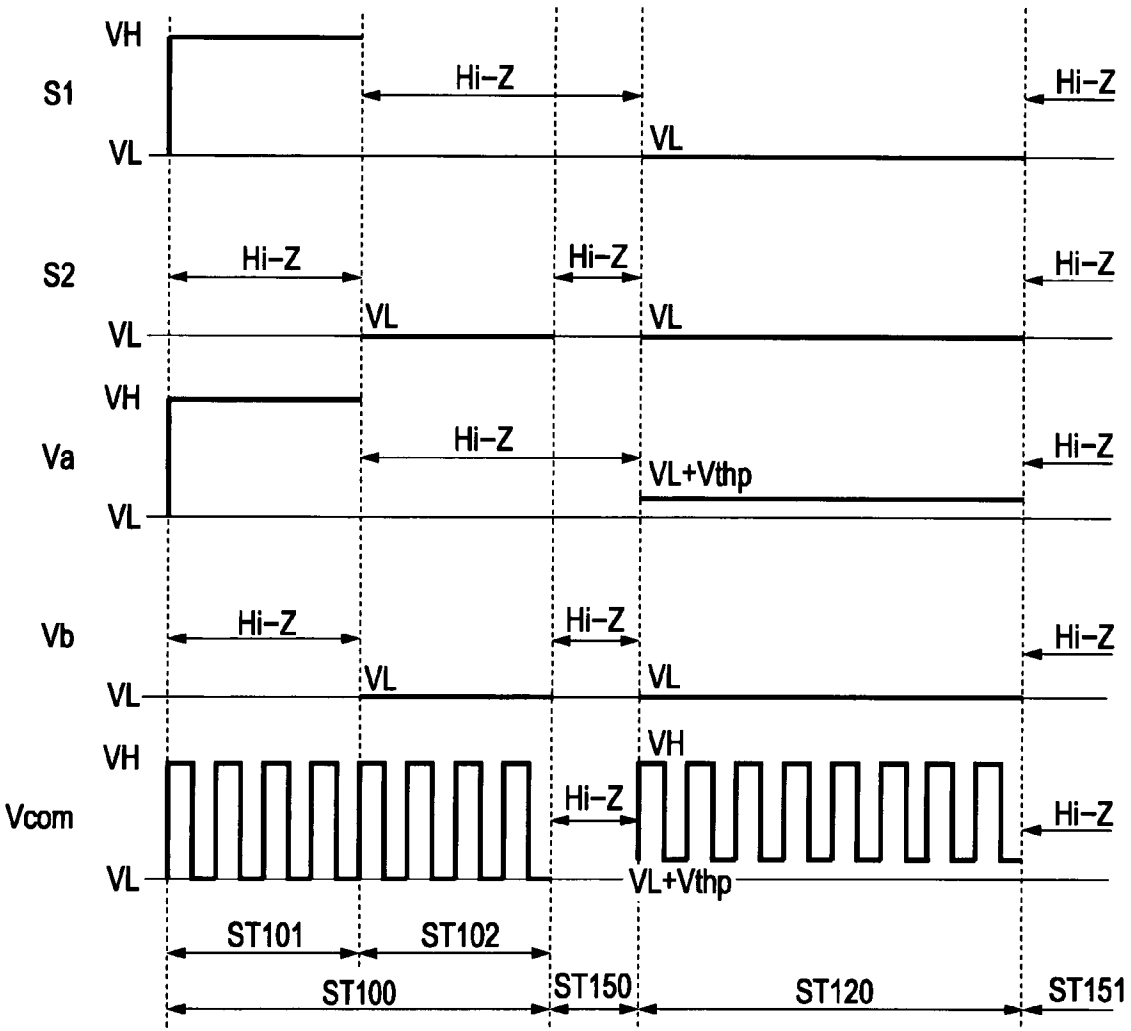
FIG. 25 is a timing chart of an all white display according to the first configuration example.
Figure 26:
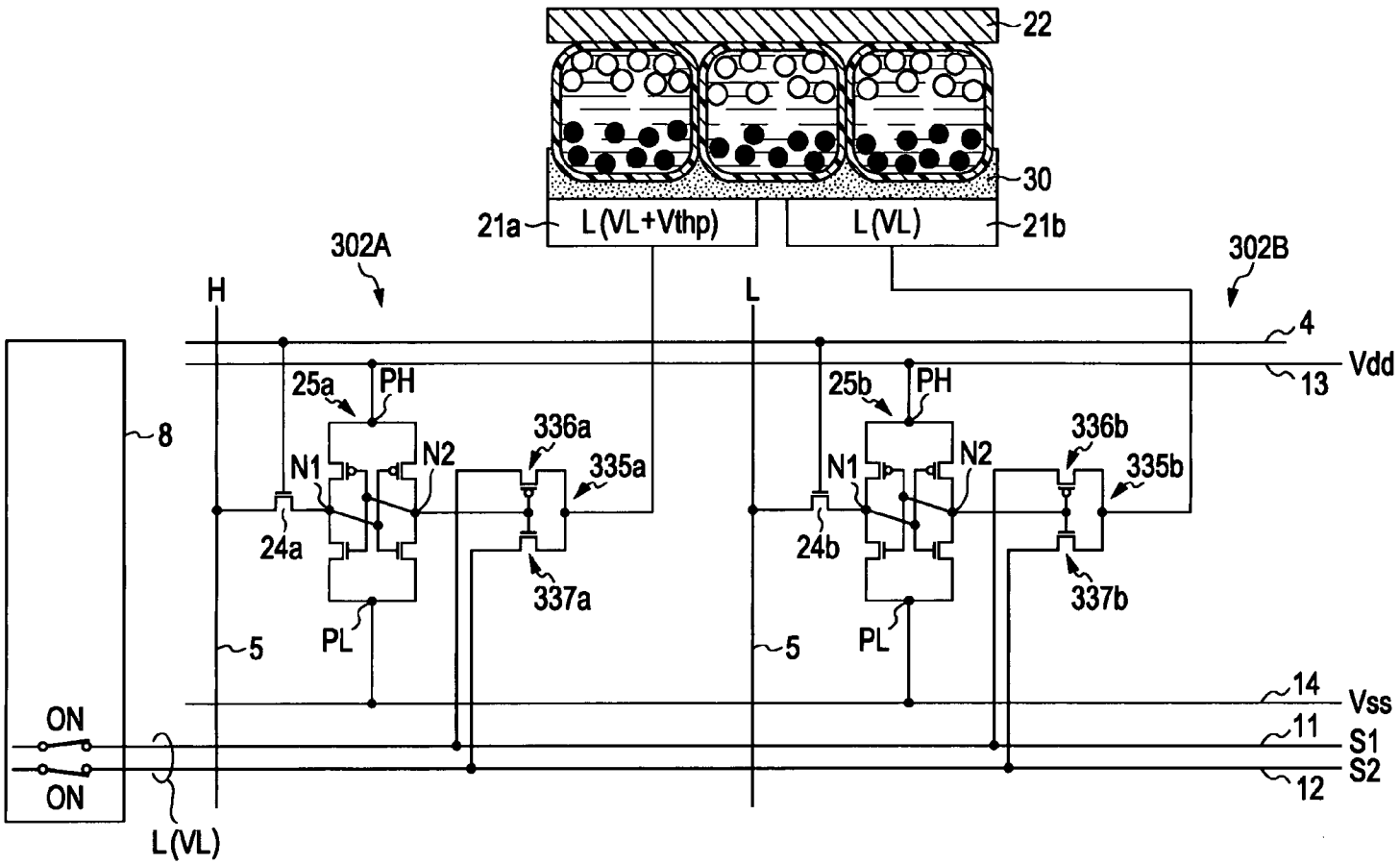
FIG. 26 is a view that shows the state of adjacent pixels in the all white display.

FIG. 25 is a view that shows a timing chart in the all white display and that corresponds to FIG. 22 in the above inverted image display. FIG. 25 shows the normal image display period ST100, the power supply off period ST150, an all white display period ST120 and the power supply off period ST151. That is, FIG. 25 shows a sequence in which, after the normal image display has been performed, a display image is erased by means of all white display. FIG. 26 shows the state of the pixels 302A and 302B in the all white display period ST120.

In the power supply off period ST150 after the normal image display period ST100, the pixel 302A performs black display, and the pixel 302B performs white display. Then, when the period proceeds from the power supply off period ST150 to the all white display period ST120, a low level electric potential VL is supplied to both the first control line 11 and the second control line 12.

In the pixel 302A in which a high level (H) image signal is held, the P-MOS 336*a* enters an on state and thereby the first control line 11 is electrically connected to the pixel electrode 21*a*. As a result, a low level electric potential (VL+Vthp) is input to the pixel electrode 21*a*. On the other hand, in the pixel 302B in which a low level (L) image signal is held, the N-MOS 337*b* enters an on state and, thereby, the second control line 12 is electrically connected to the pixel electrode 21*b*. Thus, a low level electric potential VL is input to the pixel electrode 21*b*. Then, a pulse-like signal that repeats a period of high level electric potential VH and a period of low level electric potential (VL+Vthp) at a predetermined interval is input to the common electrode 22. In this manner, in a period during which the common electrode 22 is at a high level, the electrophoretic element 23 is driven on the basis of a difference in electric potential between the pixel electrode 21 and the common electrode 22 and, as a result, the pixel 302A that has been performing black display in the normal image display period ST100 is inverted from black display to white display. In addition, the display of the pixel 302B that originally performs white display remains unchanged, so that all the pixels perform white display.

In addition, in the all white display as well, because the low level electric potential of the pixel electrode 21*a* is (VL+Vthp), the low level electric potential of the pulse input to the common electrode 22 is adjusted to the (VL+Vthp). In this manner, the occurrence of inconvenience of display is prevented. In addition, in the all white display, as shown in FIG. 26, a low level electric potential is input to both the first control line 11 and the second control line 12 at the same time, so that a difference in electric potential (Vthp) slightly occurs between the adjacent pixel electrodes. However, because the first control line 11 and the second control line 12, which form both ends of the leakage path, are at the same electric potential, a leakage current will not be generated.

All Black Display

Next, the all black display will be described with reference to Table 3 and FIG. 27 and FIG. 28. The all black display, as shown in Table 3, is performed in such a manner that a high level electric potential VH is supplied to both the first control line 11 and the second control line 12.

Figure 27:
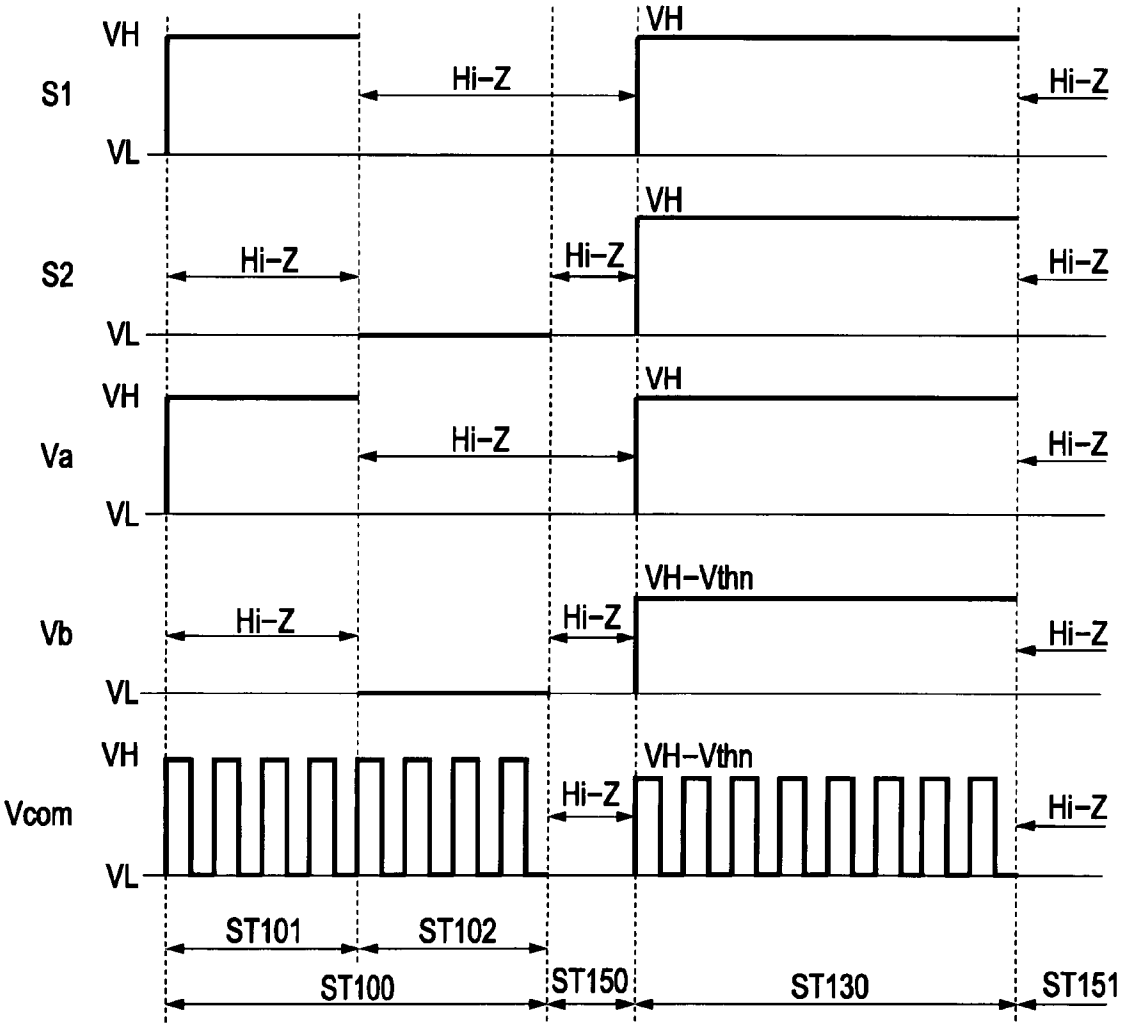
FIG. 27 is a timing chart of an all black display according to the first configuration example.
Figure 28:
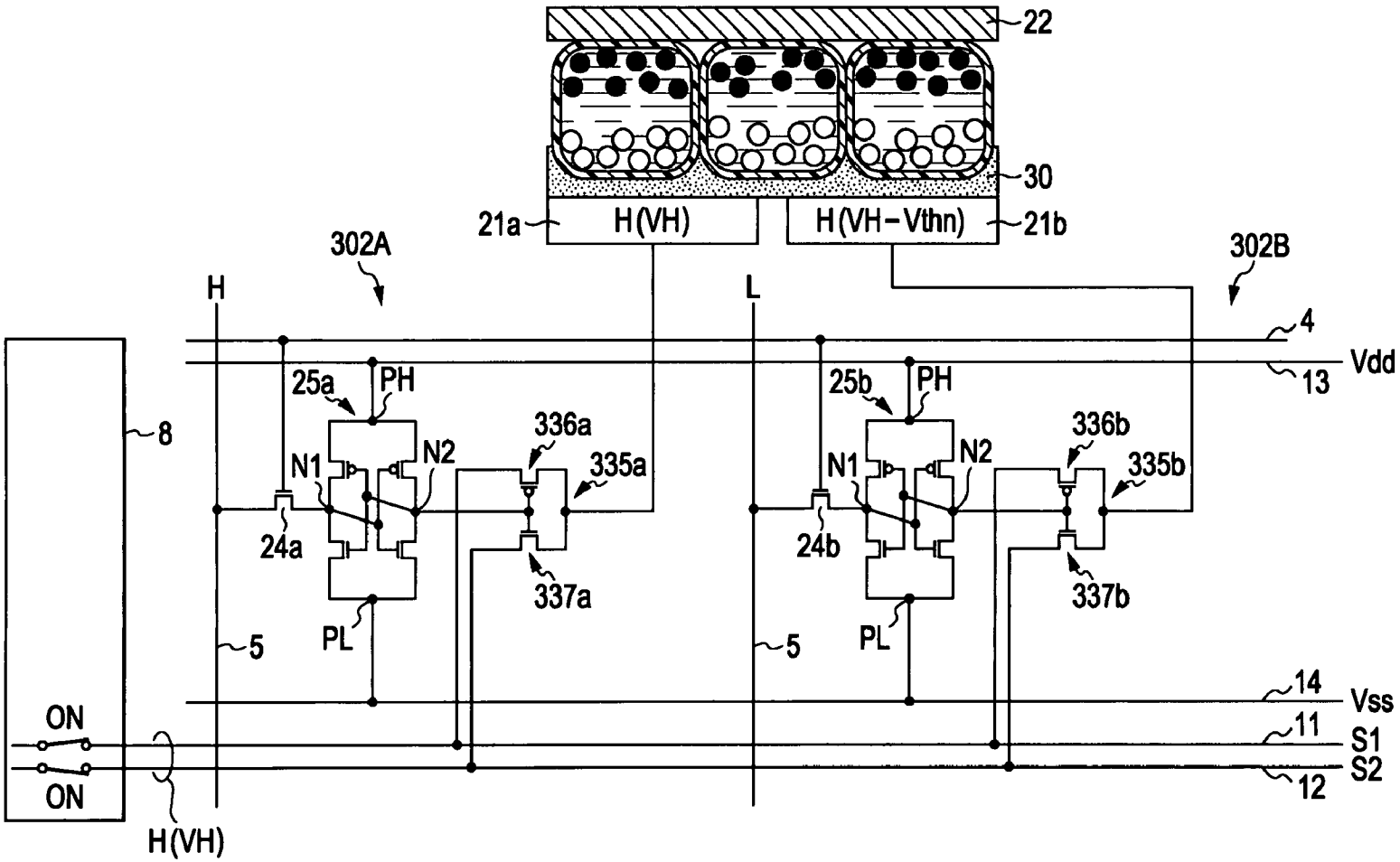
FIG. 28 is a view that shows the state of adjacent pixels in the all black display.

FIG. 27 is a view that shows a timing chart in the all black display and that corresponds to FIG. 22 in the above inverted image display. FIG. 27 shows the normal image display period ST100, the power supply off period ST150, an all black display period ST130 and the power supply off period ST151. That is, FIG. 27 shows a sequence in which, after the normal image display has been performed, a display image is erased by means of all black display. FIG. 28 shows the state of the pixels 302A and 302B in the all black display period ST130.

In the power supply off period ST150 after the normal image display period ST100, the pixel 302A performs black display, and the pixel 302B performs white display. Then, when the period proceeds from the power supply off period ST150 to the all black display period ST130, a high level electric potential VH is supplied to both the first control line 11 and the second control line 12.

In the pixel 302A in which a high level (H) image signal is held, the P-MOS 336*a* enters an on state and thereby the first control line 11 is electrically connected to the pixel electrode 21*a*. As a result, a high level electric potential VH is input to the pixel electrode 21*a*. On the other hand, in the pixel 302B in which a low level (L) image signal is held, the N-MOS 337*b* enters an on state and, thereby, the second control line 12 is electrically connected to the pixel electrode 21*b*. Thus, a high level electric potential VH−Vthn is input to the pixel electrode 21*b*. Then, a pulse-like signal that repeats a period of high level electric potential (VH−Vthn) and a low level electric potential VL at a predetermined interval is input to the common electrode 22. In this manner, in a period during which the common electrode 22 is at a low level, the electrophoretic element 23 is driven on the basis of a difference in electric potential between the pixel electrode 21 and the common electrode 22 and, as a result, the pixel 302B that has been performing white display in the normal image display period ST100 is inverted from white display to black display. In addition, the display of the pixel 302A that originally performs black display remains unchanged, so that all the pixels perform black display.

In addition, in the all black display as well, because the high level electric potential of the pixel electrode 21*b* is (VH−Vthn), the high level electric potential of the pulse input to the common electrode 22 is adjusted to the (VH−Vthn). In this manner, the occurrence of inconvenience of display is prevented. In addition, in the all black display, as shown in FIG. 28, a high level electric potential VH is input to both the first control line 11 and the second control line 12 at the same time, so that a difference in electric potential (Vthn) slightly occurs between the adjacent pixel electrodes. However, because the first control line 11 and the second control line 12, which form both ends of the leakage path, are at the same electric potential, a leakage current will not be generated.

As described in detail above, in the electrophoretic display device according to the first configuration example, by providing the switch circuit 335 formed of only two transistors, it is possible to simplify the configuration of a pixel circuit and also possible to reduce an area because of a reduction in the number of transistors in comparison with the pixel 2, shown in FIG. 2, according to the first embodiment. Thus, it is possible to reduce an area per pixel, and, therefore, it is possible to realize an electrophoretic display device that is easily in conformity with high resolution of pixels. In addition, by reducing the number of transistors, it is possible to reduce a parasitic capacitance when an electric current is conducted, so that it is possible to reduce power consumption.

In addition, the inconvenience of display, which may possibly occur because of a reduction in the number of transistors, may also be effectively prevented. That is, the electric potential of the pulse input to the common electrode 22 is adjusted in accordance with a variation in electric potential input to the pixel electrode 21, and, thereby, it is possible to prevent deterioration of display quality due to a reverse electric field being applied to the electrophoretic element.

Note that, in the present embodiment, the high level electric potential of the common electrode 22 is set to (VH−Vthn) and the low level electric potential is set to (VL+Vthp); however, the high level electric potential of the common electrode 22 may be an electric potential that is lower than (VH−Vthn) and the low level electric potential may be an electric potential that is higher than (VL+Vthp). This is because, when the electric potential difference Vgs between the gate and source of the P-MOS 336 and the electric potential difference Vgs between the gate and source of the N-MOS 337 come close to Vthp and Vthn, respectively, it takes time to saturate the drain electric potential, so that it is assumed that the drain electric potential may be not saturated at the time when the input of the pulse to the common electrode 22 is started. In this case, the high level electric potential of the pixel electrode 21 is lower than the above electric potential (VH−Vthn), and the low level electric potential is higher than the above electric potential (VL+Vthp). Then, in order to further reliably prevent the occurrence of inconvenience of display, it is desirable that the high level electric potential of the common electrode 22 is set slightly lower than (VH−Vthn) and the low level electric potential thereof is set slightly higher than (VL+Vthp).

SECOND CONFIGURATION EXAMPLE

Figure 29:
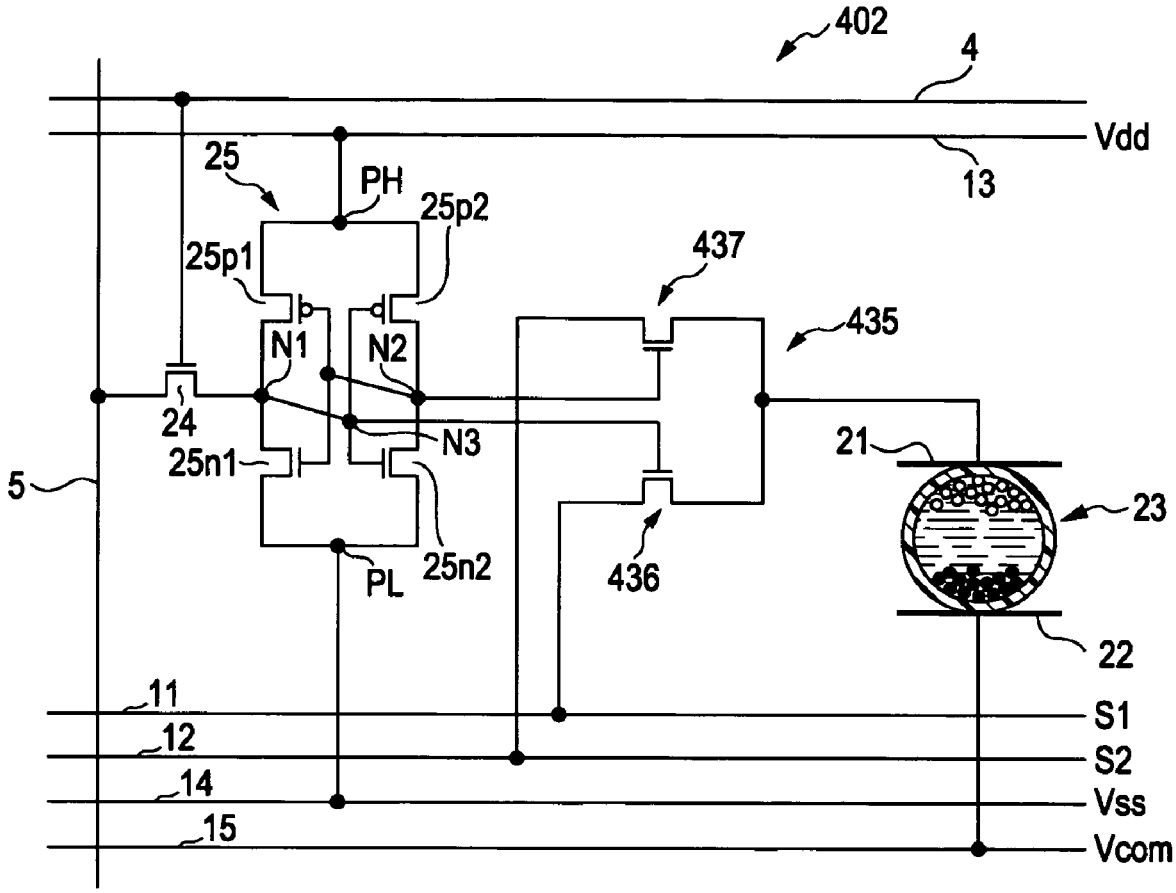
FIG. 29 is a circuitry diagram of a pixel according to a second configuration example of the second embodiment.

Next, a second configuration example of the second embodiment will be described. FIG. 29 is a circuit diagram of a pixel 402 provided in an electrophoretic display device according to the second configuration example. The pixel 402 shown in FIG. 29 is configured to include a switch circuit 435 formed of a P-MOS (first transistor) 436 and an N-MOS (second transistor) 437 in place of the switch circuit 35 of the pixel 2 shown in FIG. 2. Hereinafter, the same reference numerals are assigned to the same components as those shown in FIG. 2, and the description thereof will be omitted.

In the pixel 402, the switch circuit 435 is connected between the SRAM 25 and the pixel electrode 21. The gate terminal of the N-MOS 436 is connected to the second output terminal N3 of the SRAM 25, and the gate terminal of the N-MOS 437 is connected to the first output terminal N2 of the SRAM 25. The source terminal of the N-MOS 436 is connected to the first control line 11, and the drain terminal thereof is connected to the pixel electrode 21. The source terminal of the N-MOS 437 is connected to the second control line 12, and the drain terminal thereof is connected to the pixel electrode 21.

In the above configured pixel 402, when a high level (H) is input as an image signal, the N-MOS 436 enters an on state by a high level electric potential (Vdd) output from the second output terminal N3 of the SRAM 25 and, thereby, the first control line 11 is connected to the pixel electrode 21. On the other hand, when a low level (L) is input as an image signal, the N-MOS 437 enters an on state by a high level electric potential (Vdd) output from the first output terminal N2 of the SRAM 25 and, thereby, the second control line 12 is connected to the pixel electrode 21.

Thus, the pixel 402 according to the present embodiment, as well as the pixel 2 according to the preceding embodiment, operates the switch circuit 435 on the basis of an electric potential of an image signal that is input to the SRAM 25, and, the electric potential S1 of the first control line 11 or the electric potential S2 of the second control line 12 is input to the pixel electrode 21 in such a manner that the first control line 11 or the second control line 12 is connected to the pixel electrode 21.

Driving Method

Next, the driving method of the electrophoretic display device according to the second configuration example will be described with reference to Table 4 and FIG. 30 to FIG. 39. In the present embodiment as well, multiple driving modes (normal image display, inverted image display, all white display, and all black display) will be described; however, the same components as those of the above first configuration example will be omitted where appropriate.

Table 4 is a table that shows an electric potential input to the pixel 402 in each operation of the normal image display, the inverted image display, the all white display and all black display in comparison with one another, and that corresponds to Table 3 in the first configuration example. However, "Vthn" shown in Table 4 is a threshold voltage value of each of the N-MOSs 436 and 437.

Normal Image Display

Figure 30:
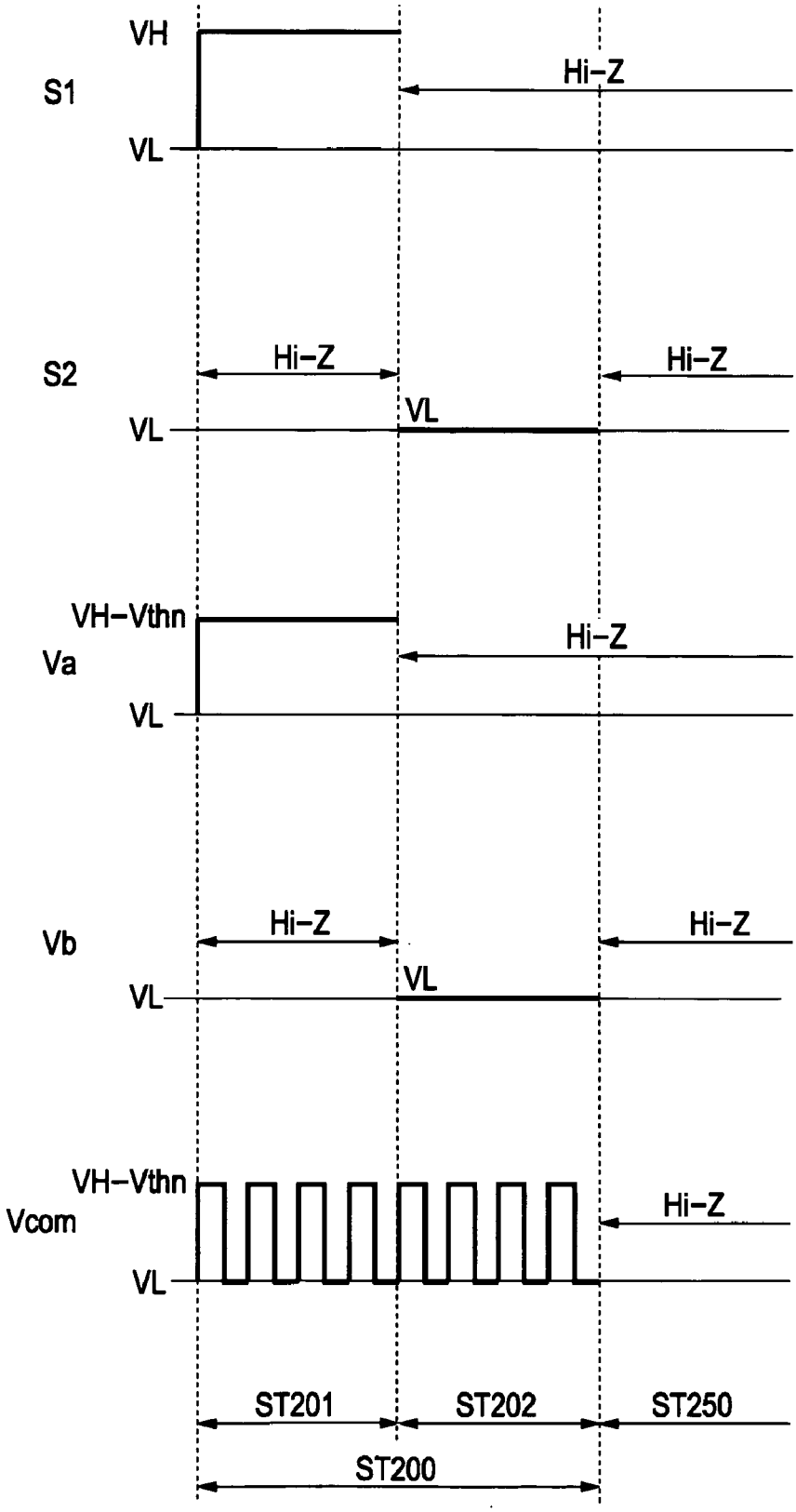
FIG. 30 is a timing chart of a normal image display according to the second configuration example.

FIG. 30 is a view that shows a timing chart in the normal image display and that corresponds to FIG. 19 according to the first configuration example. As shown in FIG. 30, the sequence of the normal image display includes a normal image display period ST200 and a power supply off period ST250. In the normal image display period ST200, a black color image display period ST201 and a white color image display period ST202 are sequentially executed.

Figure 31:
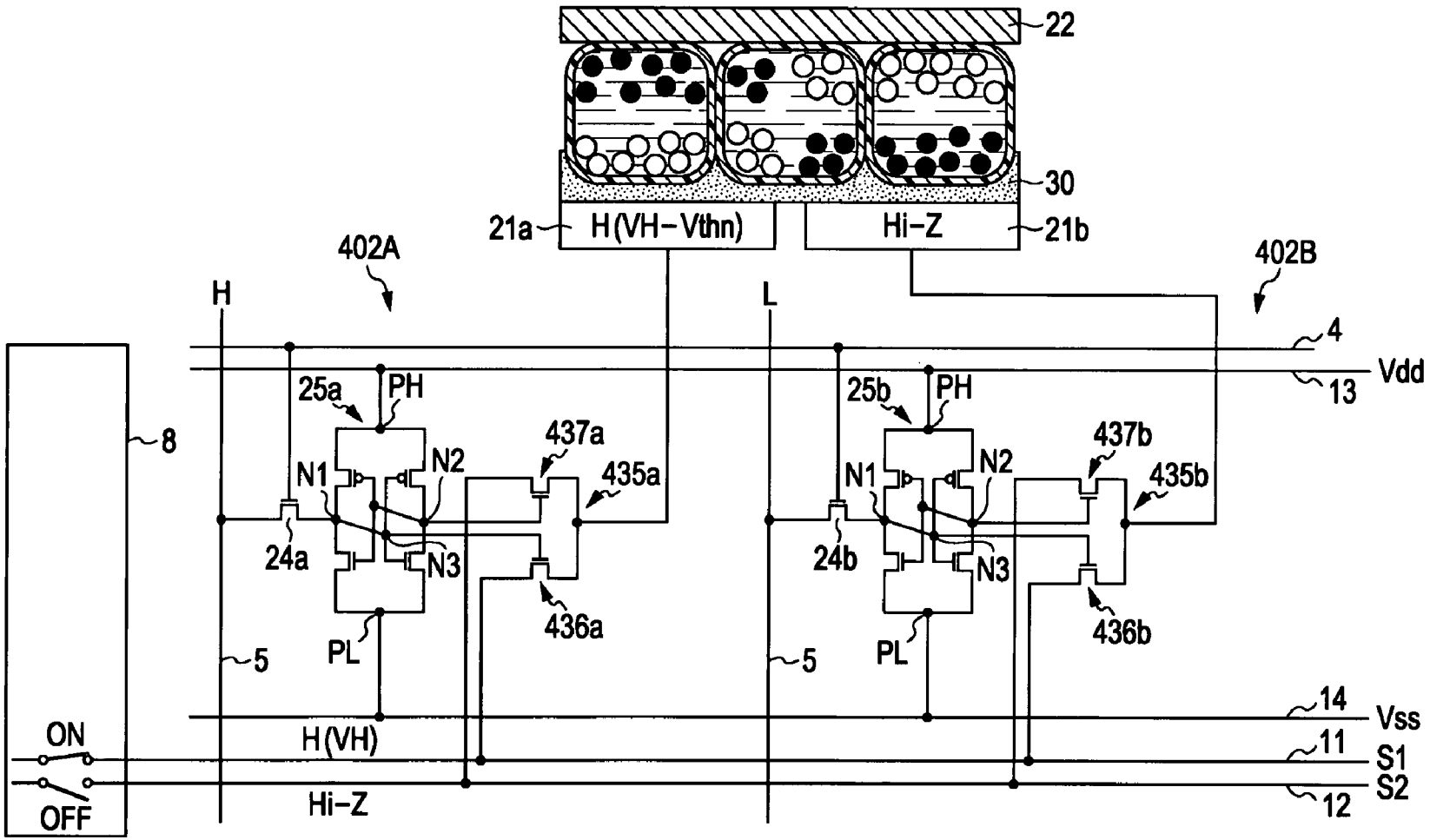
FIG. 31 is a view that shows the state of adjacent pixels in the normal image display.
Figure 32:
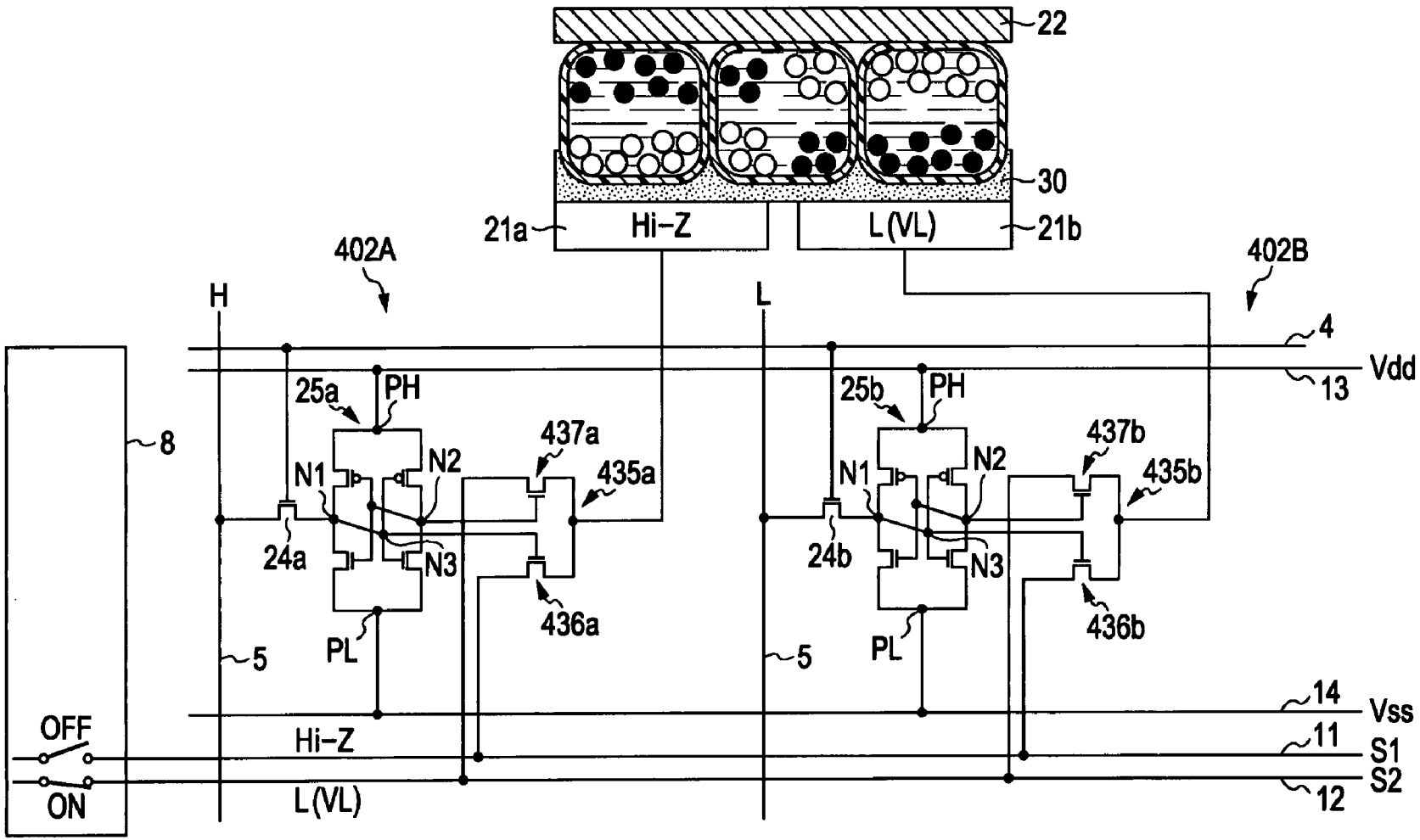
FIG. 32 is a view that shows the state of the adjacent pixels in the normal image display.

FIG. 31 and FIG. 32 respectively correspond to FIG. 20 and FIG. 21 according to the first configuration example. That is, FIG. 31 is a view that shows the state of pixels 402A and 402B in the black color image display period ST201, and FIG. 32 is a view that shows the state of the pixels 402A and 402B in the white color image display period ST202. Hereinafter, the description will be made under the condition that a high level (H) image signal is held in the SRAM 25*a* of the pixel 402A, and a low level (L) image signal is held in the SRAM 25*b* of the pixel 402B.

In the black color image display period ST201, the first control line 11 is supplied with a high level electric potential VH, and the second control line 12 is made into a high impedance state. In the pixel 402A in which a high level (H) image signal is held, the N-MOS 436*a* enters an on state and thereby the first control line 11 is electrically connected to the pixel electrode 21*a*. In this manner, a high level electric potential is input to the pixel electrode 21*a*. On the other hand, in the pixel 402B that holds a low level (L) image signal, the N-MOS 437*b* enters an on state. However, because the second control line 12 is in a high impedance state, the pixel electrode 21*b* remains in a high impedance state.

In the meantime, a pulse-like signal that repeats a period of high level electric potential (VH−Vthn) and a low level electric potential VL at a predetermined interval is input to the common electrode 22. As described above, on the basis of a difference in electric potential between the common electrode 22 and the pixel electrodes 21*a* and 21*b*, the pixel 402A performs black display, and the display of the pixel 402B remains unchanged.

TABLE 4

| | IMAGE SIGNAL | EFFECTIVE CONTROL LINE (ELECTRIC POTENTIAL) | PIXEL ELECTRODE ELECTRIC POTENTIAL | COMMON ELECTRODE ELECTRIC POTENTIAL H | COMMON ELECTRODE ELECTRIC POTENTIAL L | DISPLAY COLOR |
|---|---|---|---|---|---|---|
| NORMAL | H | S1 (VH) | VH − Vthp | VH − Vthn | VL | BLACK |
| IMAGE | L | S2 (VL) | VL | | | WHITE |
| DISPLAY | | | | | | |
| INVERTED | H | S1 (VL) | VL | VH − Vthn | VL | WHITE |
| IMAGE | L | S2 (VH) | VH − Vthn | | | BLACK |
| DISPLAY | | | | | | |
| ALL WHITE | H | S1 (VL) | VL | VH | VL | WHITE |
| DISPLAY | L | S2 (VL) | VL | | | WHITE |
| ALL BLACK | H | S1 (VH) | VH − Vthn | VH − Vthn | VL | BLACK |
| DISPLAY | L | S2 (VH) | VH − Vthn | | | BLACK |

Next, in the white color image display period ST202, the first control line 11 is made into a high impedance state where the first control line 11 is electrically disconnected, and the second control line 12 is supplied with a low level electric potential VL. In this manner, the pixel electrode 21*a* that is connected to the first control line 11 through the N-MOS 436*a* is made into a high impedance state, while, on the other hand, a low level electric potential VL is input to the pixel electrode 21*b* that is connected to the second control line 12 through the N-MOS 437*b*. At this time, a pulse-like signal is continuously input to the common electrode 22. As described above, while the display of the pixel 402A is maintained as it is, the pixel 402B performs white display.

After that, when the period proceeds to the power supply off period ST250, all the lines connected to the pixels 402A and 402B enter a high impedance state where all the lines are electrically disconnected. Thus, an image that is written in the normal image display period ST200 is maintained.

Note that an electric potential input to the pixel electrode 21*a* becomes (VH−Vthn) in the black color image display period ST201 because of the same reasons of the above first configuration example. Then, because the high level electric potential of the pixel electrode 21*a* becomes lower by an amount of Vthn, the high level electric potential of the pulse input to the common electrode 22 is set to (VH−Vthn). Thus, the occurrence of inconvenience of display is prevented.

As described above, the electrophoretic display device according to the second configuration example is able to display an image in the same sequence as that electrophoretic display device according to the above first embodiment. In addition, as shown in FIG. 31 and FIG. 32, the second control line 12 is made into a high impedance state in the black color image display period ST201, and the first control line 11 is made into a high impedance state in the white color image display period ST202, so that a leakage path due to the lateral electric field between the adjacent pixel electrodes 21*a* and 21*b* is always interrupted. Thus, a leakage current due to a difference in electric potential between the adjacent pixels will not be generated.

Inverted Image Display

Figure 33:
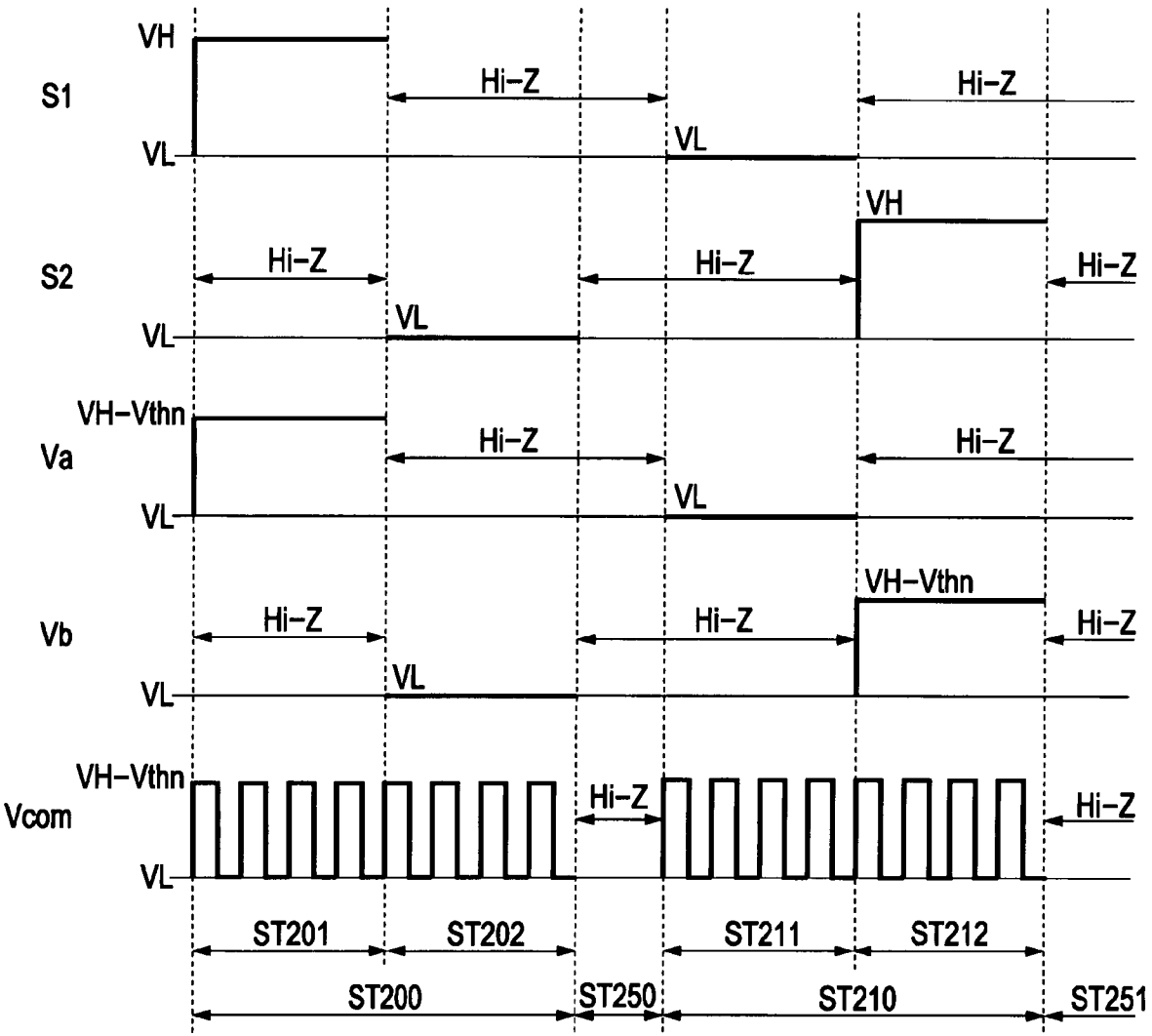
FIG. 33 is a timing chart of an inverted image display according to the second configuration example.
Figure 34:
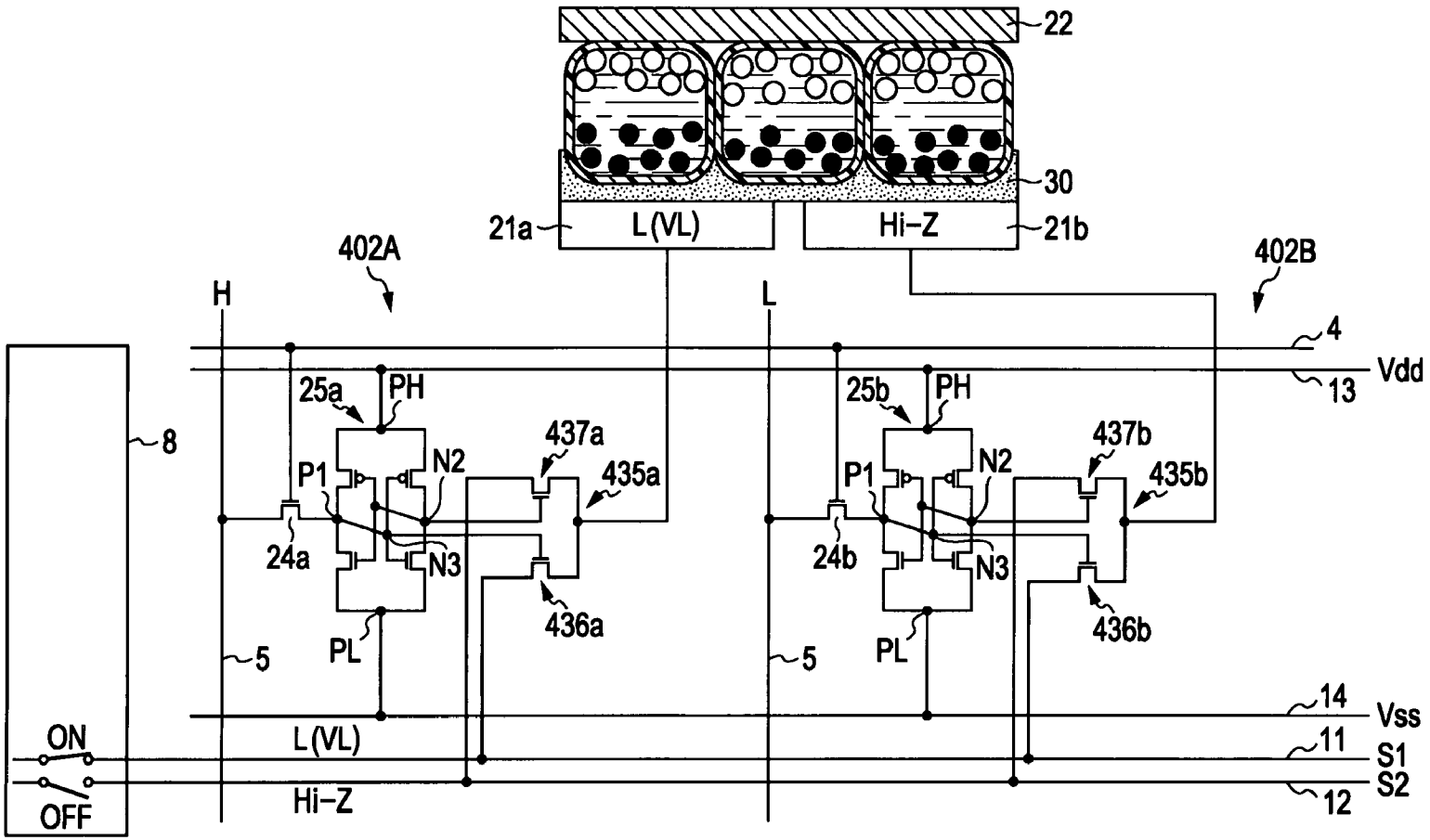
FIG. 34 is a view that shows the state of adjacent pixels in the inverted image display.
Figure 35:
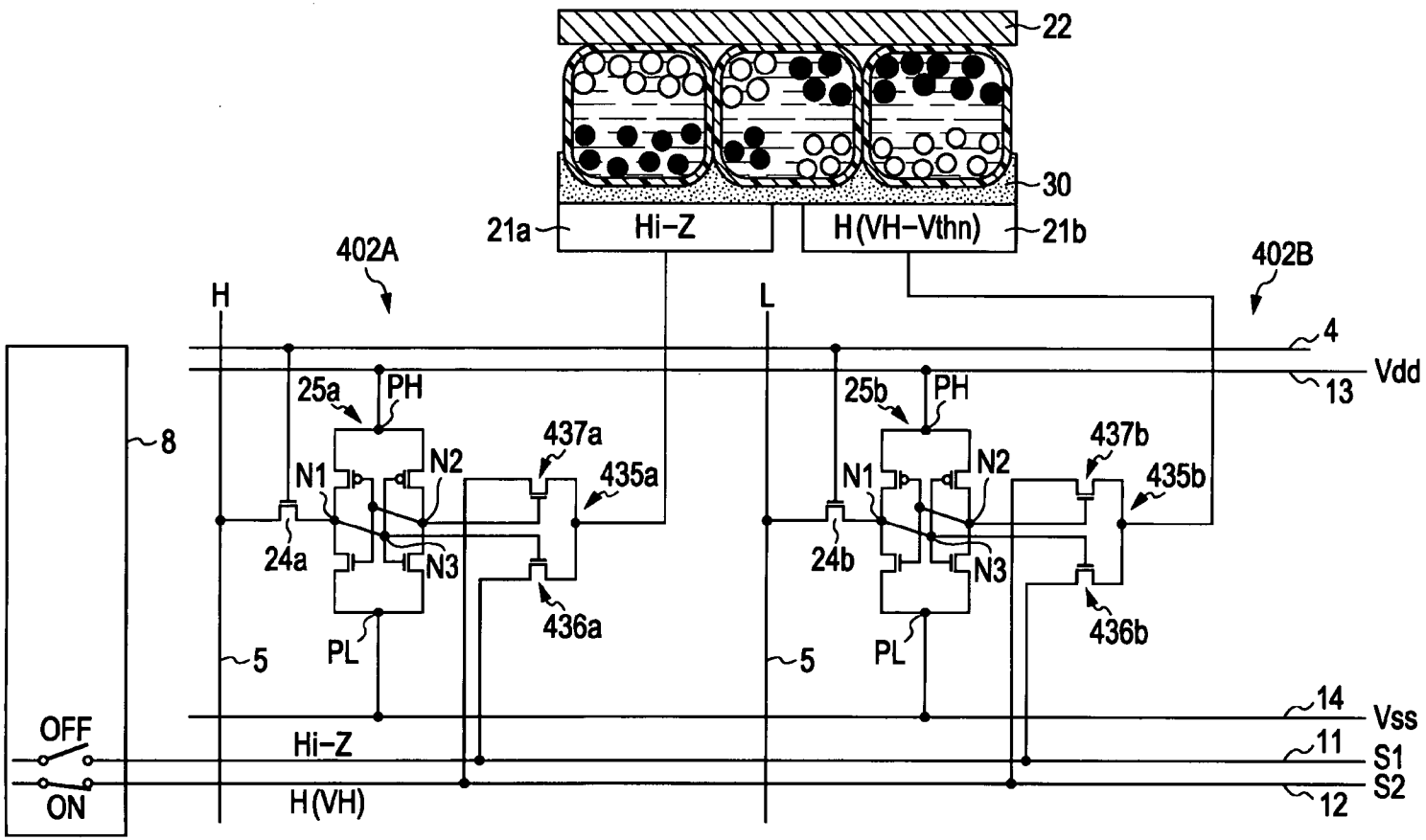
FIG. 35 is a view that shows the state of the adjacent pixels in the inverted image display.

FIG. 33 is a view that shows a timing chart in the inverted image display. FIG. 34 is a view that shows the state of the pixels 402A and 402B in the white color inversion display period ST211 shown in FIG. 33, and FIG. 35 is a view that shows the state of the pixels 402A and 402B in the black color inversion display period ST212 shown in FIG. 33. FIG. 33 shows the normal image display period ST200, the power supply off period ST250, the inverted image display period ST210 and the power supply off period ST251. The inverted image display period ST200 includes the white color inversion display period ST211 and the black color inversion display period ST212.

The operation of the inverted image display in the electrophoretic display device according to the second configuration example is the same as that of the electrophoretic display device according to the above first configuration example. After the above described normal image display period ST200, in a state where the period has proceeded to the power supply off period ST250, the pixel 402A performs black display, and the pixel 402B performs white display.

When the period proceeds from the power supply off period ST250 to the white color inversion display period ST211, the first control line 11 is supplied with a low level electric potential VL, and the second control line 12 is held in a high impedance state. Then, in the pixel 402A, a low level electric potential VL is input from the first control line 11 through the N-MOS 436*a* to the pixel electrode 21*a*. On the other hand, in the pixel 402B, the pixel electrode 21*b* remains in a high impedance state. Then, a pulse-like signal that repeats a period of high level electric potential (VH−Vthn) and a low level electric potential VL at a predetermined interval is input to the common electrode 22. In this manner, the pixel 402A that has been performing black display is inverted from black display to white display.

Next, when the period proceeds to the black color inversion display period ST212, the first control line 11 is made into a high impedance state, and a high level electric potential VH is supplied to the second control line 12. Then, in the pixel 402A, the pixel electrode 21*a* that is connected through the N-MOS 436*a* to the first control line 11 enters a high impedance state. On the other hand, in the pixel 402B, a high level electric potential VH is input to the pixel electrode 21*b* that is connected through the N-MOS 437*b* to the second control line 12. Because a pulse-like signal is input to the common electrode 22, the pixel 402B that has been performing white display is inverted from white display to black display. At this time, the display of the pixel 402A remains unchanged.

Owing to the above white color inversion display period ST211 and the black color inversion display period ST212, an image that is obtained by inverting the black and white of the image that is displayed in the normal image display period ST200 is displayed. Note that, in the electrophoretic display device of the second configuration example as well, the electric potential input to the pixel electrode 21 differs from the electric potential of the first control line 11 and the electric potential of the second control line 12 because of the characteristics of the N-MOSs 436 and 437. Then, the high level electric potential of the pulse input to the common electrode 22 is adjusted to (VH−Vthn) in conformity to the high level electric potential of the pixel electrode 21 and, thereby, the occurrence of inconvenience of display is prevented.

In addition, as shown in FIG. 34 and FIG. 35, the second control line 12 is made into a high impedance state in the white color inversion display period ST211, and the first control line 11 is made into a high impedance state in the black color inversion display period ST212, so that at least one of the control lines is electrically disconnected during display operation. Because the leakage path is always interrupted, a leakage current between the adjacent pixels will not be generated.

All White Display

Figure 36:
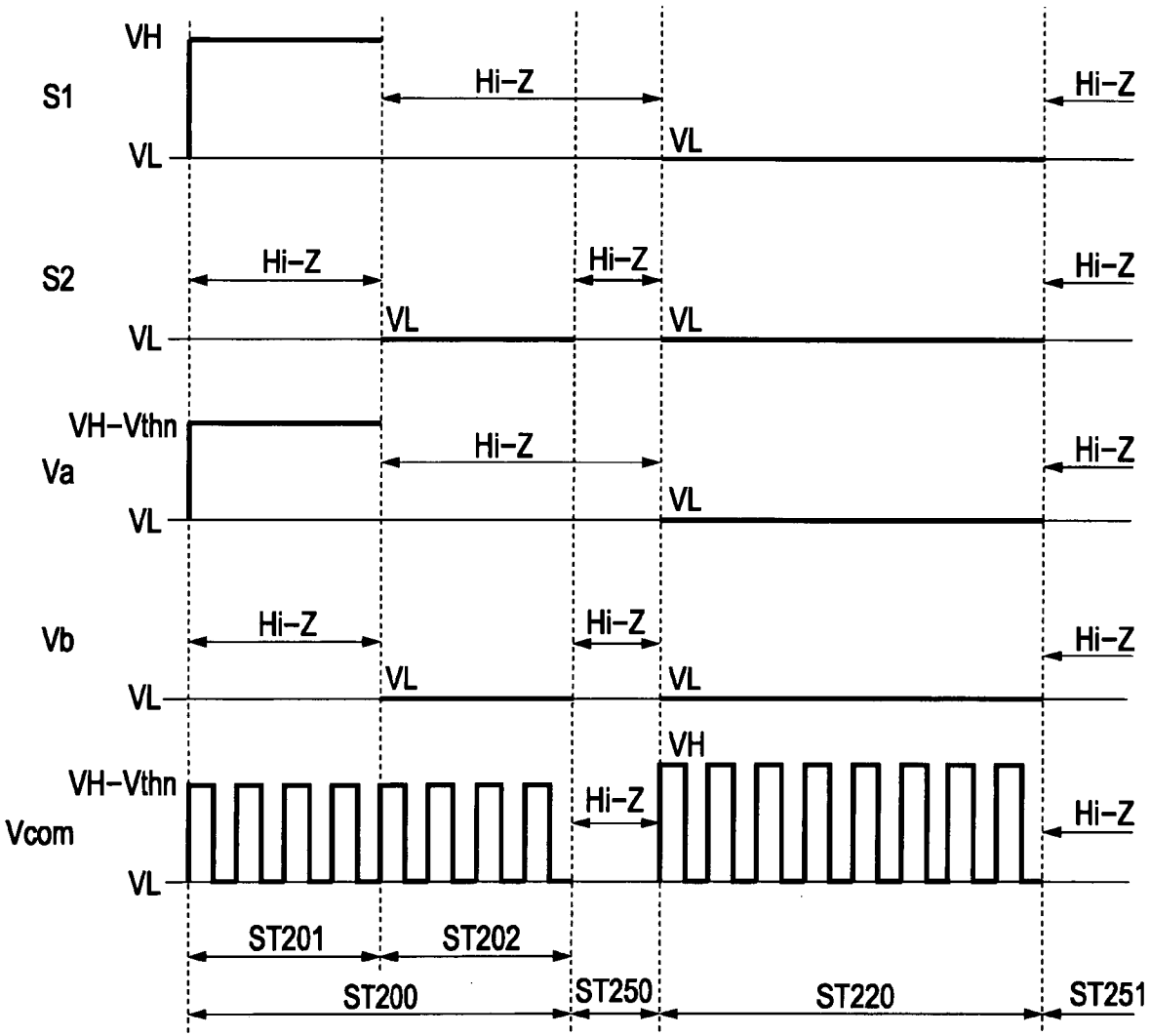
FIG. 36 is a timing chart of an all white display according to the second configuration example.
Figure 37:
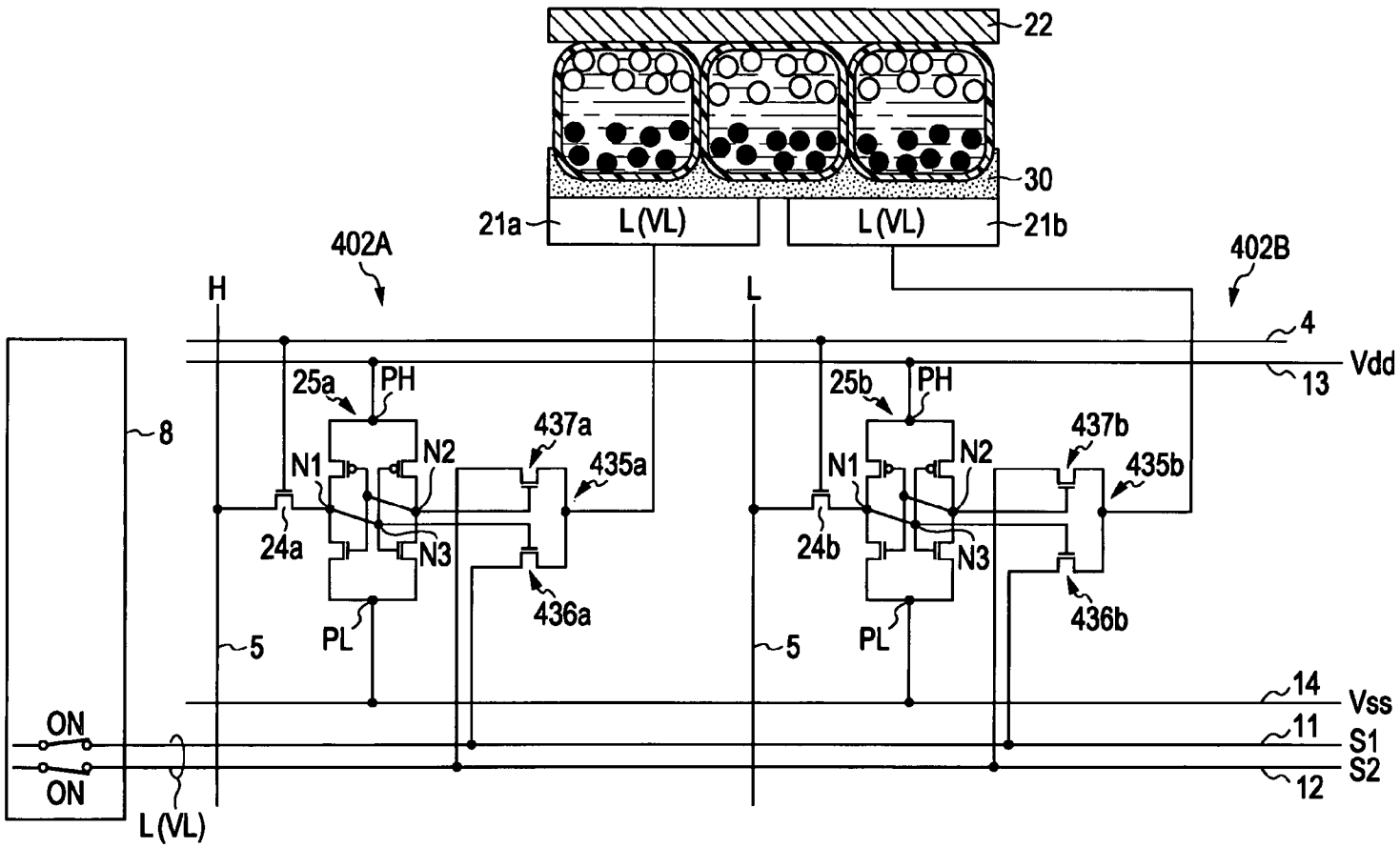
FIG. 37 is a view that shows the state of adjacent pixels in the all white display.

FIG. 36 is a view that shows a timing chart in the all white display. FIG. 37 shows the state of the pixels 402A and 402B in the all white display period ST220 shown in FIG. 36. FIG. 36 shows the normal image display period ST200, the power supply off period ST250, the all white display period ST220 and the power supply off period ST251. That is, FIG. 36 shows a sequence in which, after the normal image display has been performed, a display image is erased by means of all white display.

In the power supply off period ST250 after the described normal image display period ST200, the pixel 402A performs black display, and the pixel 402B performs white display. Then, when the period proceeds from the power supply off period ST250 to the all white display period ST220, a low level electric potential VL is supplied to both the first control line 11 and the second control line 12.

In the pixel 402A, the first control line 11 is electrically connected to the pixel electrode 21*a* and, thereby, a low level electric potential VL is input to the pixel electrode 21*a*. On the other hand, in the pixel 402B, the second control line 12 is electrically connected to the pixel electrode 21*b* and, thereby, a low level electric potential VL is input to the pixel electrode 21*b*. Then, a pulse-like signal that repeats a period of high level electric potential VH and a period of low level electric potential VL at a predetermined interval is input to the common electrode 22.

In this manner, in a period during which the common electrode 22 is at a high level electric potential VH, the electrophoretic element 23 is driven on the basis of a difference in electric potential between the pixel electrode 21 and the common electrode 22 and, as a result, the pixel 402A that has been performing black display in the normal image display period ST200 is inverted from black display to white display. In addition, the display of the pixel 402B that originally performs white display remains unchanged, so that all the pixels perform white display. Note that, in the all white display of the second configuration example, as shown in FIG. 37, because the pixel electrodes 21*a* and 21*b* are at the same electric potential, a leakage current is not generated between the pixel electrodes.

All Black Display

Figure 38:
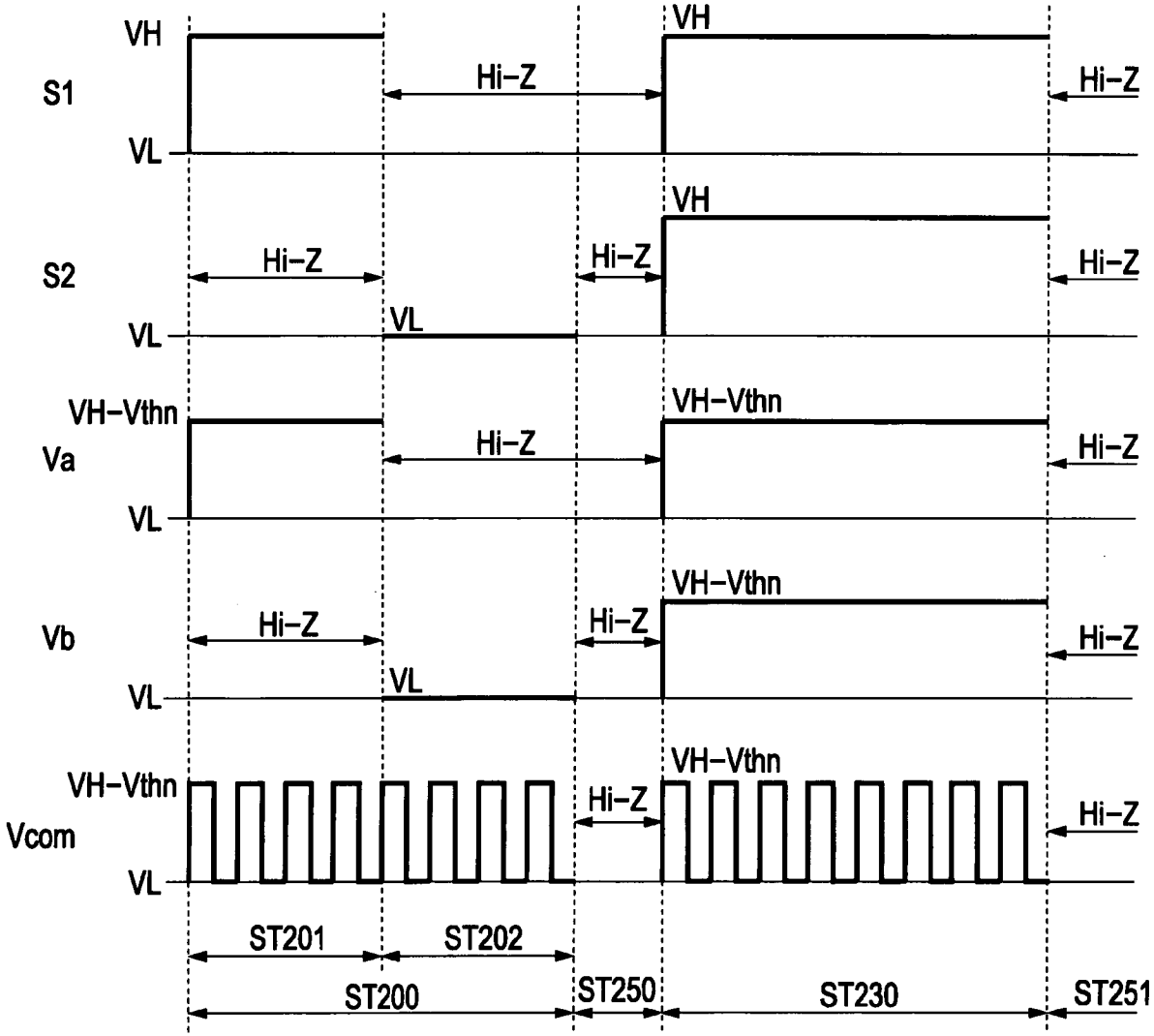
FIG. 38 is a timing chart of an all black display according to the second configuration example.
Figure 39:
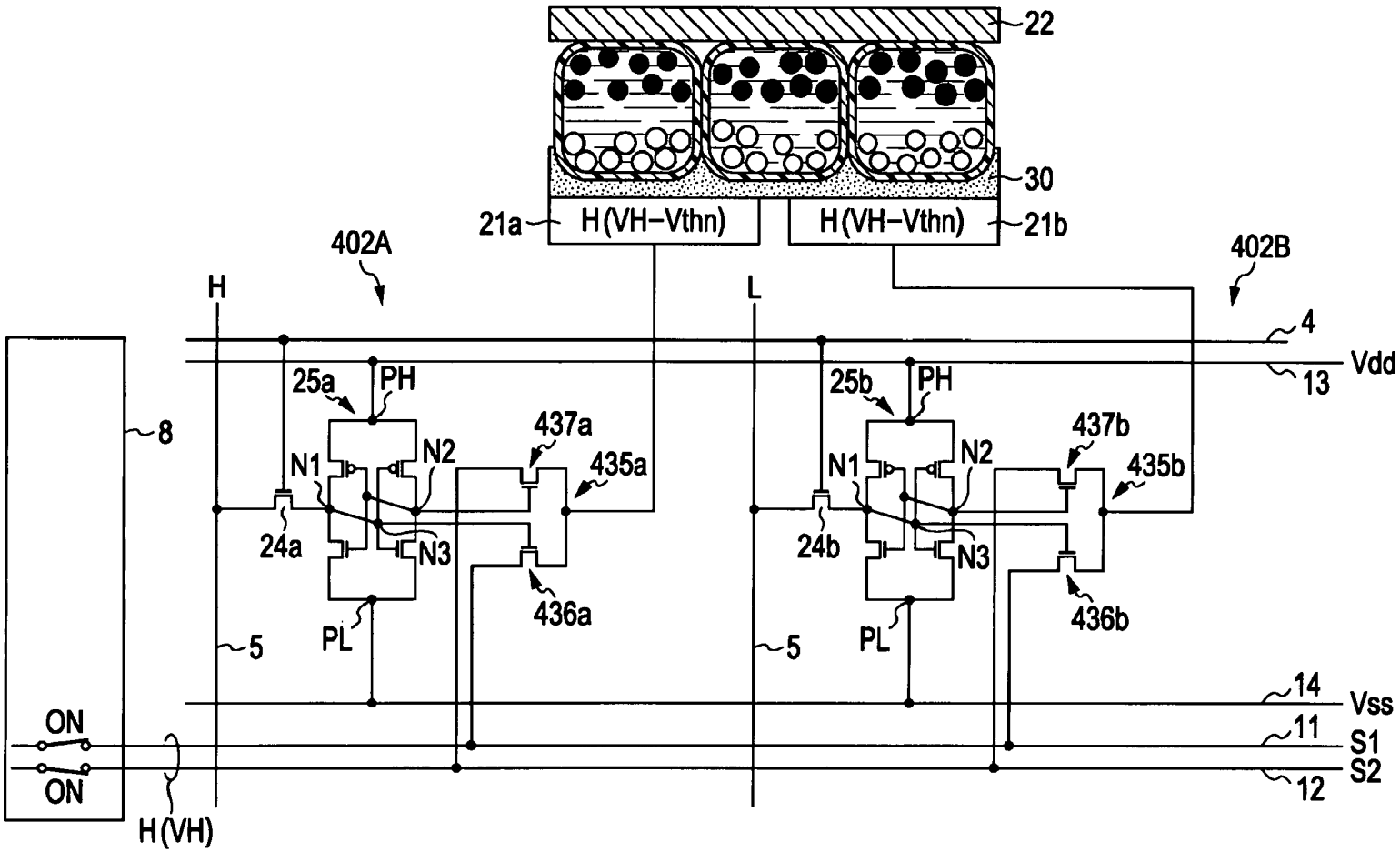
FIG. 39 is a view that shows the state of adjacent pixels in the all black display.

FIG. 38 is a view that shows a timing chart in the all black display. FIG. 39 is a view that shows the state of the pixels 402A and 402B in the all black display period ST230 shown in FIG. 38. FIG. 38 shows the normal image display period ST200, the power supply off period ST250, the all black display period ST230 and the power supply off period ST251. That is, FIG. 38 shows a sequence in which, after the normal image display has been performed, a display image is erased by means of all black display.

In the power supply off period ST250 after the normal image display period ST200, the pixel 402A performs black display, and the pixel 402B performs white display. Then, when the period proceeds from the power supply off period ST250 to the all black display period ST230, a high level electric potential VH is supplied to both the first control line 11 and the second control line 12.

In the pixel 402A, the first control line 11 is electrically connected to the pixel electrode 21*a* and, thereby, a high level electric potential (VH−Vthn) is input to the pixel electrode 21*a*. On the other hand, in the pixel 402B, the second control line 12 is electrically connected to the pixel electrode 21*b* and, thereby, a high level electric potential (VH−Vthn) is input to the pixel electrode 21*b*. Then, a pulse-like signal that repeats a period of high level electric potential (VH−Vthn) and a low level electric potential VL at a predetermined interval is input to the common electrode 22.

In this manner, in a period during which the common electrode 22 is at a low level electric potential VL, the electrophoretic element 23 is driven on the basis of a difference in electric potential between the pixel electrode 21 and the common electrode 22 and, as a result, the pixel 402B that has been performing white display in the normal image display period ST200 is inverted from white display to black display. In addition, the display of the pixel 402A that originally performs black display remains unchanged, so that all the pixels perform black display.

Note that, in the all black display of the second configuration example, because the high level electric potential input to the pixel electrodes 21*a* and 21*b* is lower than the high level electric potential VH of the first control line 11 and the high level electric potential VH of the second control line 12 by an amount of threshold voltage value Vthn, the high level electric potential of the common electrode 22 is set to (VH−Vthn) to thereby prevent the occurrence of inconvenience of display. In addition, in the all black display, as shown in FIG. 39, because the pixel electrodes 21*a* and 21*b* are at the same electric potential, a leakage current is not generated between the pixel electrodes.

As described in detail above, in the electrophoretic display device according to the second configuration example, because the switch circuit 435 of each pixel 402 is formed of a smaller number of transistors, it is possible to reduce the area of each pixel 402. Thus, it is possible to reduce an area per pixel, and, therefore, it is possible to realize an electrophoretic display device that is easily in conformity with high resolution of pixels. In addition, by reducing two transistors as compared with the pixel 2 shown in FIG. 2, it is possible to reduce a parasitic capacitance when an electric current is conducted, so that it is possible to reduce power consumption. In addition, the electric potential of the pulse input to the common electrode 22 is adjusted in accordance with a variation in electric potential input to the pixel electrode 21 on the basis of a display mode. Thus, by performing an image display using a variable electric potential of the pixel electrode 21 effectively, it is possible to prevent the occurrence of inconvenience of display due to a reduction in the number of transistors.

THIRD CONFIGURATION EXAMPLE

Figure 40:
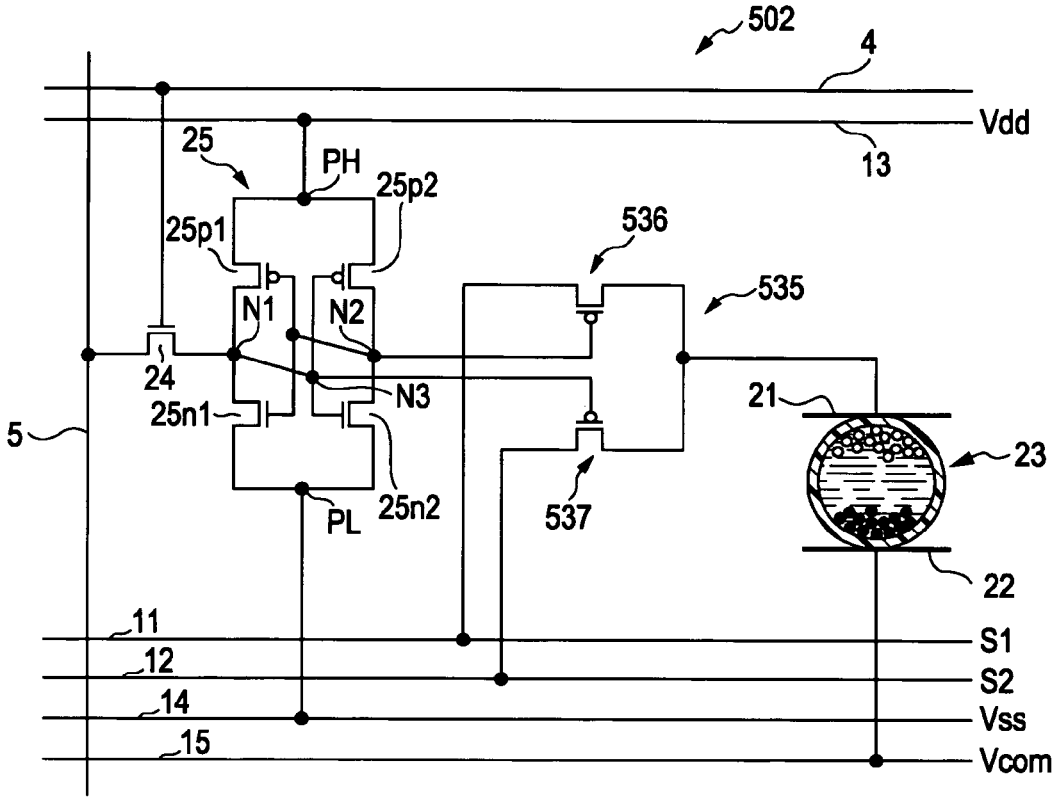
FIG. 40 is a circuitry diagram of a pixel according to a third configuration example of the second embodiment.

Next, a third configuration example of the second embodiment will be described. FIG. 40 is a circuit diagram of a pixel 502 provided in an electrophoretic display device according to the third configuration example. The pixel 502 shown in FIG. 40 is configured to include a switch circuit 535 formed of a P-MOS (first transistor) 536 and a P-MOS (second transistor) 537 in place of the switch circuit 35 of the pixel 2 shown in FIG. 2. Hereinafter, the same reference numerals are assigned to the same components as those shown in FIG. 2, and the description thereof will be omitted.

In the pixel 502, the switch circuit 535 is connected between the SRAM 25 and the pixel electrode 21. The gate terminal of the P-MOS 536 is connected to the first output terminal N2 of the SRAM 25, and the gate terminal of the P-MOS 537 is connected to the second output terminal N3 of the SRAM 25. The source terminal of the P-MOS 536 is connected to the first control line 11, and the drain terminal thereof is connected to the pixel electrode 21. The source terminal of the P-MOS 537 is connected to the second control line 12, and the drain terminal thereof is connected to the pixel electrode 21.

In the above configured pixel 502, when a high level (H) is input as an image signal, the P-MOS 536 enters an on state by a low level electric potential (Vss) output from the first output terminal N2 of the SRAM 25 and, thereby, the first control line 11 is connected to the pixel electrode 21. On the other hand, when a low level (L) is input as an image signal, the P-MOS 537 enters an on state by a low level electric potential (Vss) output from the second output terminal N3 of the SRAM 25 and, thereby, the second control line 12 is connected to the pixel electrode 21.

Thus, the pixel 502 according to the present embodiment, as well as the pixel 2 according to the preceding embodiment, operates the switch circuit 535 on the basis of an electric potential of an image signal that is input to the SRAM 25, and, the electric potential S1 of the first control line 11 or the electric potential S2 of the second control line 12 is input to the pixel electrode 21 in such a manner that the first control line 11 or the second control line 12 is connected to the pixel electrode 21.

Driving Method

Next, the driving method of the electrophoretic display device according to the third configuration example will be described with reference to Table 5 and FIG. 40 to FIG. 50. In the present embodiment as well, multiple driving modes (normal image display, inverted image display, all white display, and all black display) will be described; however, the same components as those of the above first configuration example and the above second configuration example will be omitted where appropriate.

TABLE 5

| | IMAGE SIGNAL | EFFECTIVE CONTROL LINE (ELECTRIC POTENTIAL) | PIXEL ELECTRODE ELECTRIC POTENTIAL | COMMON ELECTRODE ELECTRIC POTENTIAL H | COMMON ELECTRODE ELECTRIC POTENTIAL L | DISPLAY COLOR |
|---|---|---|---|---|---|---|
| NORMAL IMAGE DISPLAY | H | S1 (VH) | VH | VH | VL + Vthp | BLACK |
| | L | S2 (VL) | VL + Vthp | | | WHITE |
| INVERTED IMAGE DISPLAY | H | S1 (VL) | VL + Vthp | VH | VL + Vthp | WHITE |
| | L | S2 (VH) | VH | | | BLACK |
| ALL WHITE DISPLAY | H | S1 (VL) | VL + Vthp | VH | VL + Vthp | WHITE |
| | L | S2 (VL) | VL + Vthp | | | WHITE |
| ALL BLACK DISPLAY | H | S1 (VH) | VH | VH | VL | BLACK |
| | L | S2 (VH) | VH | | | BLACK |

Table 5 is a table that shows an electric potential input to the pixel 502 in each operation of the normal image display, the inverted image display, the all white display and all black display in comparison with one another, and that corresponds to Table 3 in the first configuration example. However, "Vthp" shown in Table 5 is a threshold voltage value of each of the P-MOSs 536 and 537.

Normal Image Display

Figure 41:
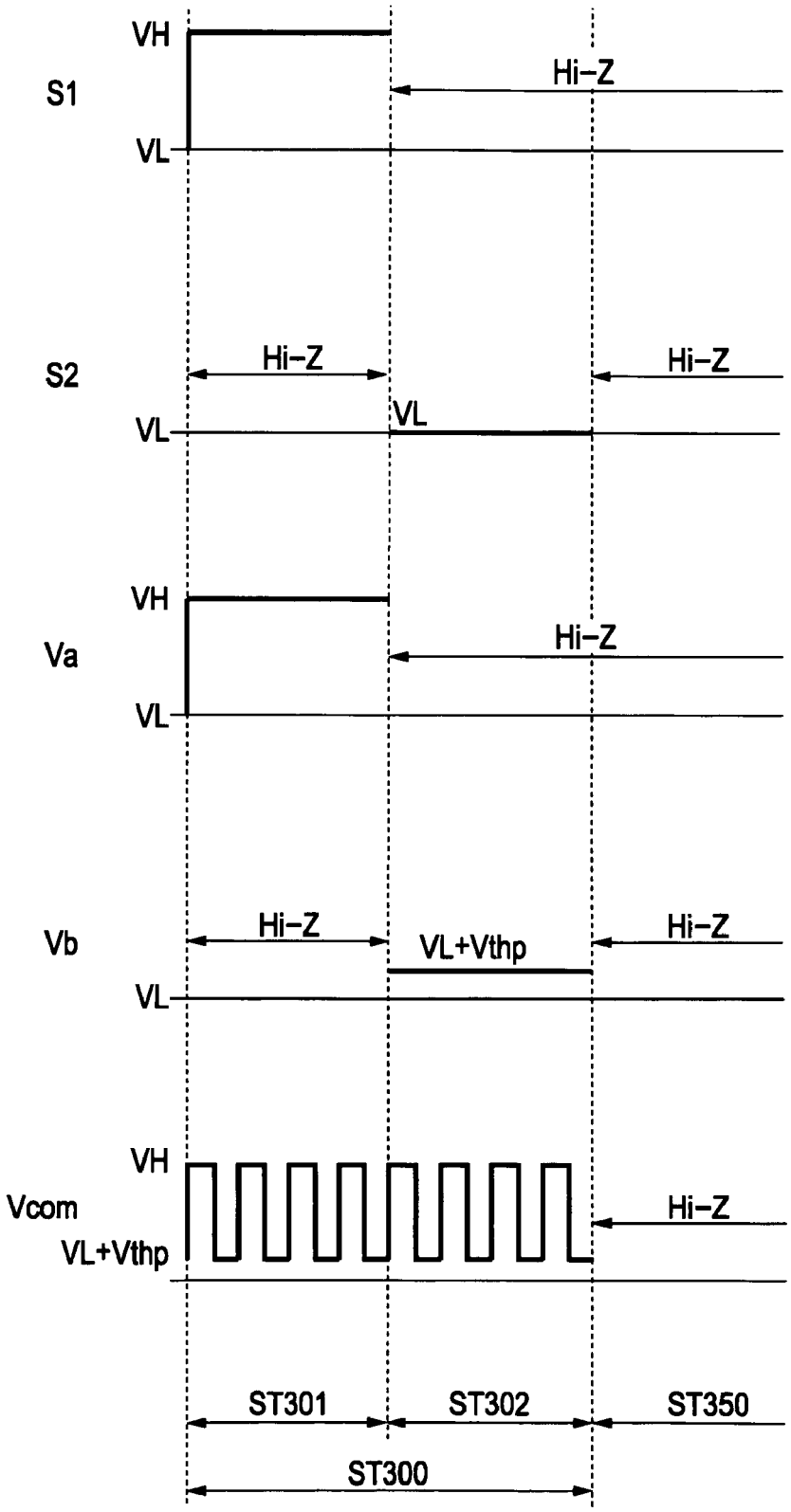
FIG. 41 is a timing chart of a normal image display according to the third configuration example.

FIG. 41 is a view that shows a timing chart in the normal image display and that corresponds to FIG. 19 according to the first configuration example. As shown in FIG. 41, the sequence of the normal image display includes a normal image display period ST300 and a power supply off period ST350. In the normal image display period ST300, a black color image display period ST301 and a white color image display period ST302 are sequentially executed.

Figure 42:
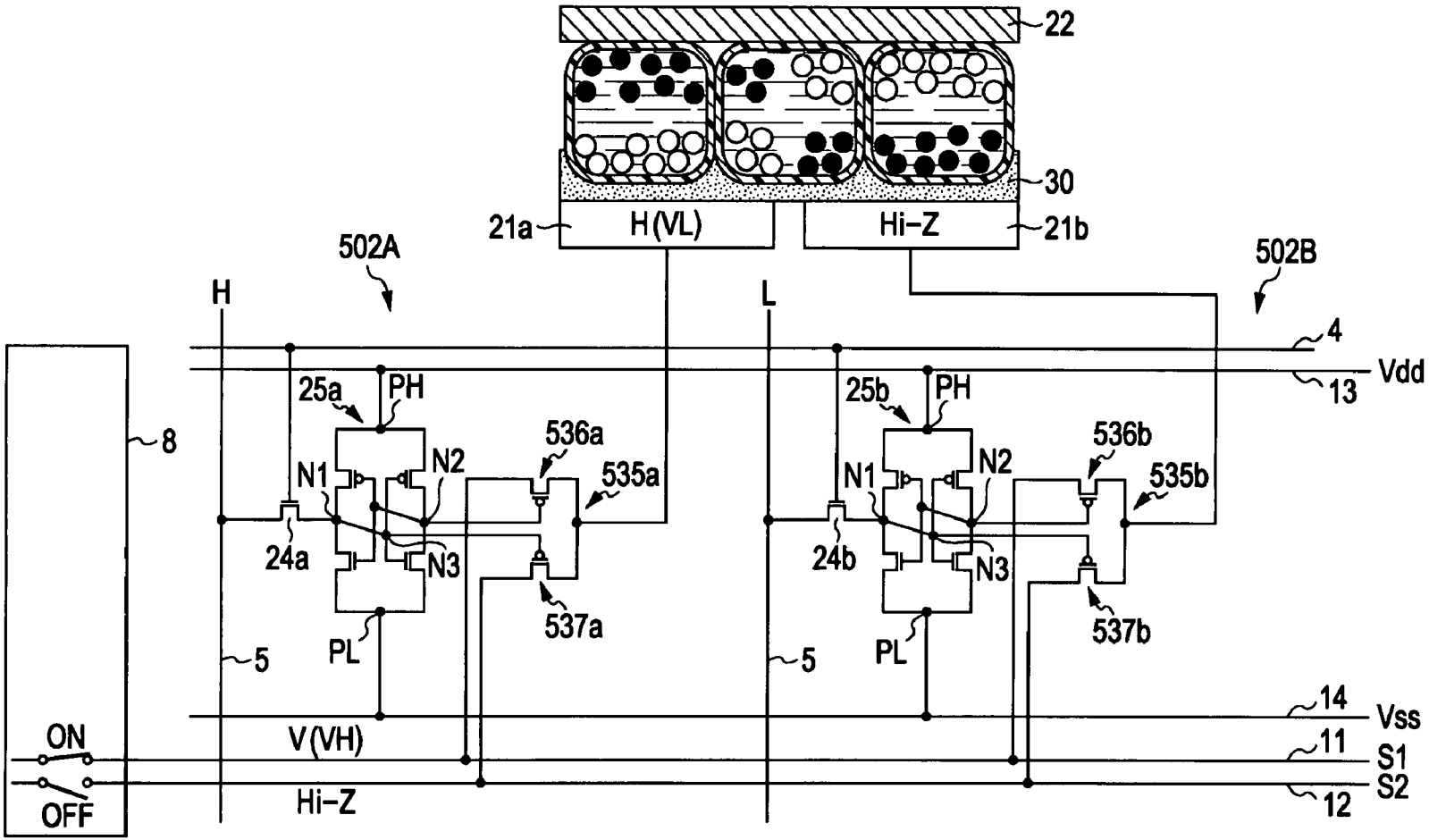
FIG. 42 is a view that shows the state of adjacent pixels in the normal image display.
Figure 43:
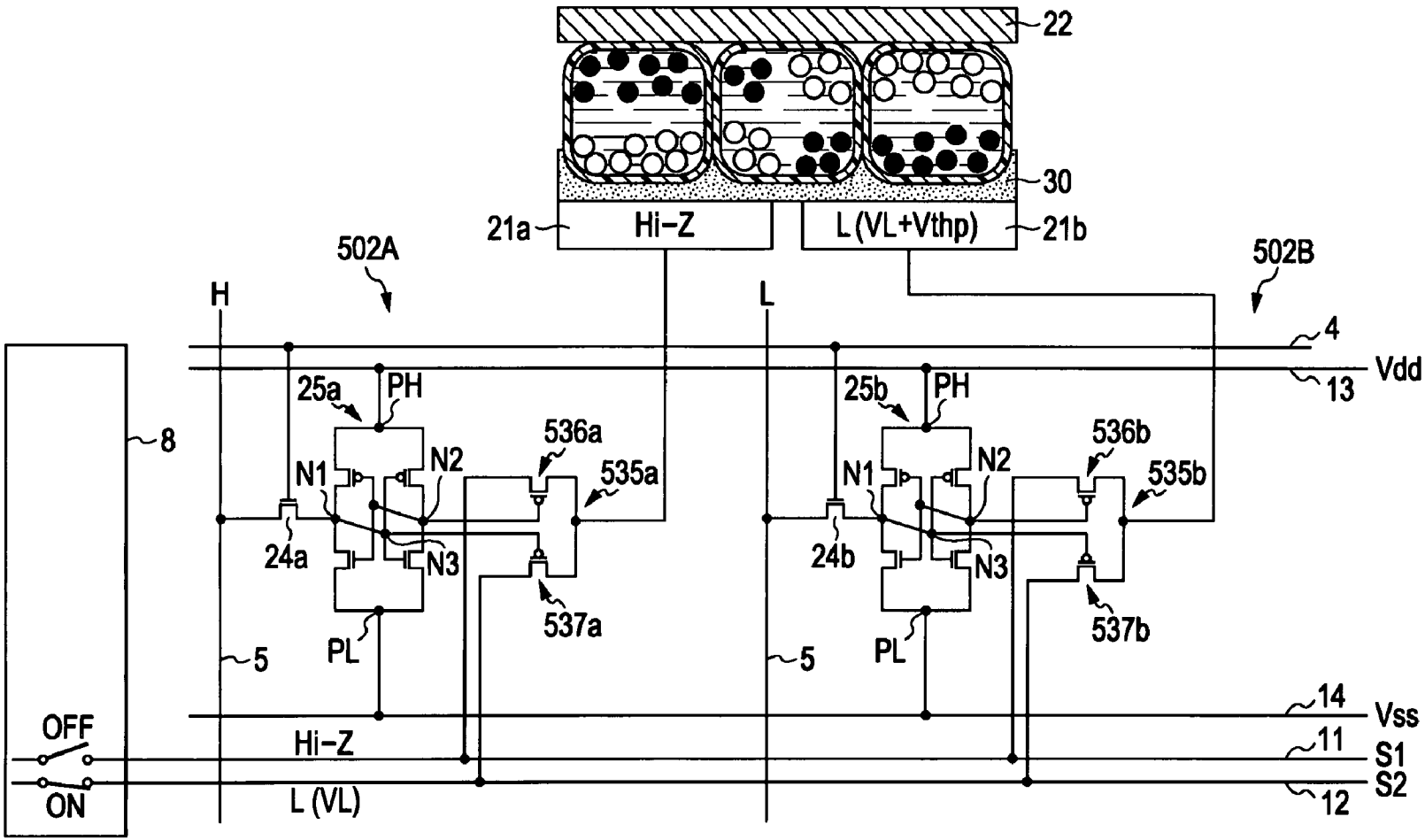
FIG. 43 is a view that shows the state of the adjacent pixels in the normal image display.

FIG. 42 and FIG. 43 respectively correspond to FIG. 20 and FIG. 21 according to the first configuration example. That is, FIG. 42 is a view that shows the state of pixels 502A and 502B in the black color image display period ST301, and FIG. 43 is a view that shows the state of the pixels 502A and 502B in the white color image display period ST302. Hereinafter, the description will be made under the condition that a high level (H) image signal is held in the SRAM 25*a* of the pixel 502A, and a low level (L) image signal is held in the SRAM 25*b* of the pixel 502B.

In the black color image display period ST301, the first control line 11 is supplied with a high level electric potential VH, and the second control line 12 is made into a high impedance state. In the pixel 502A in which a high level (H) image signal is held, the P-MOS 536*a* enters an on state and thereby the first control line 11 is electrically connected to the pixel electrode 21*a*. In this manner, a high level electric potential is input to the pixel electrode 21*a*. On the other hand, in the pixel 502B that holds a low level (L) image signal, the P-MOS 537*b* enters an on state. However, because the second control line 12 is in a high impedance state, the pixel electrode 21*b* is also in a high impedance state.

In addition, a pulse-like signal that repeats a period of high level electric potential VH and a period of low level electric potential (VL+Vthp) at a predetermined interval is input to the common electrode 22. As described above, on the basis of a difference in electric potential between the common electrode 22 and the pixel electrodes 21*a* and 21*b*, the pixel 502A performs black display, and the display of the pixel 502B remains unchanged.

Next, in the white color image display period ST302, the first control line 11 is made into a high impedance state where the first control line 11 is electrically disconnected, and the second control line 12 is supplied with a low level electric potential VL. In this manner, the pixel electrode 21*a* that is connected to the first control line 11 through the P-MOS 536*a* is made into a high impedance state, while, on the other hand, a low level electric potential VL is input to the pixel electrode 21*b* that is connected to the second control line 12 through the P-MOS 537*b*. In the meantime, a pulse-like signal is continuously input to the common electrode 22. As described above, while the display of the pixel 502A is maintained as it is, the pixel 502B performs white display.

After that, when the period proceeds to the power supply off period ST350, all the lines connected to the pixels 502A and 502B enter a high impedance state where all the lines are electrically disconnected. Thus, an image that is written in the normal image display period ST300 is maintained.

Note that an electric potential input to the pixel electrode 21*a* becomes (VL+Vthn) in the black color image display period ST301 because of the same reasons of the above first configuration example. Then, because the low level electric potential of the pixel electrode 21*a* becomes higher by an amount of Vthp, the low level electric potential of the pulse input to the common electrode 22 is set to (VL+Vthp). Thus, the occurrence of inconvenience of display is prevented.

As described above, the electrophoretic display device according to the third configuration example is able to display an image in the same sequence as that electrophoretic display device according to the above first embodiment. In addition, as shown in FIG. 42 and FIG. 43, the second control line 12 is made into a high impedance state in the black color image display period ST301, and the first control line 11 is made into a high impedance state in the white color image display period ST302, so that a leakage path due to the lateral electric field between the adjacent pixel electrodes 21*a* and 21*b* is always interrupted. Thus, a leakage current due to a difference in electric potential between the adjacent pixels will not be generated.

Inverted Image Display

Figure 44:
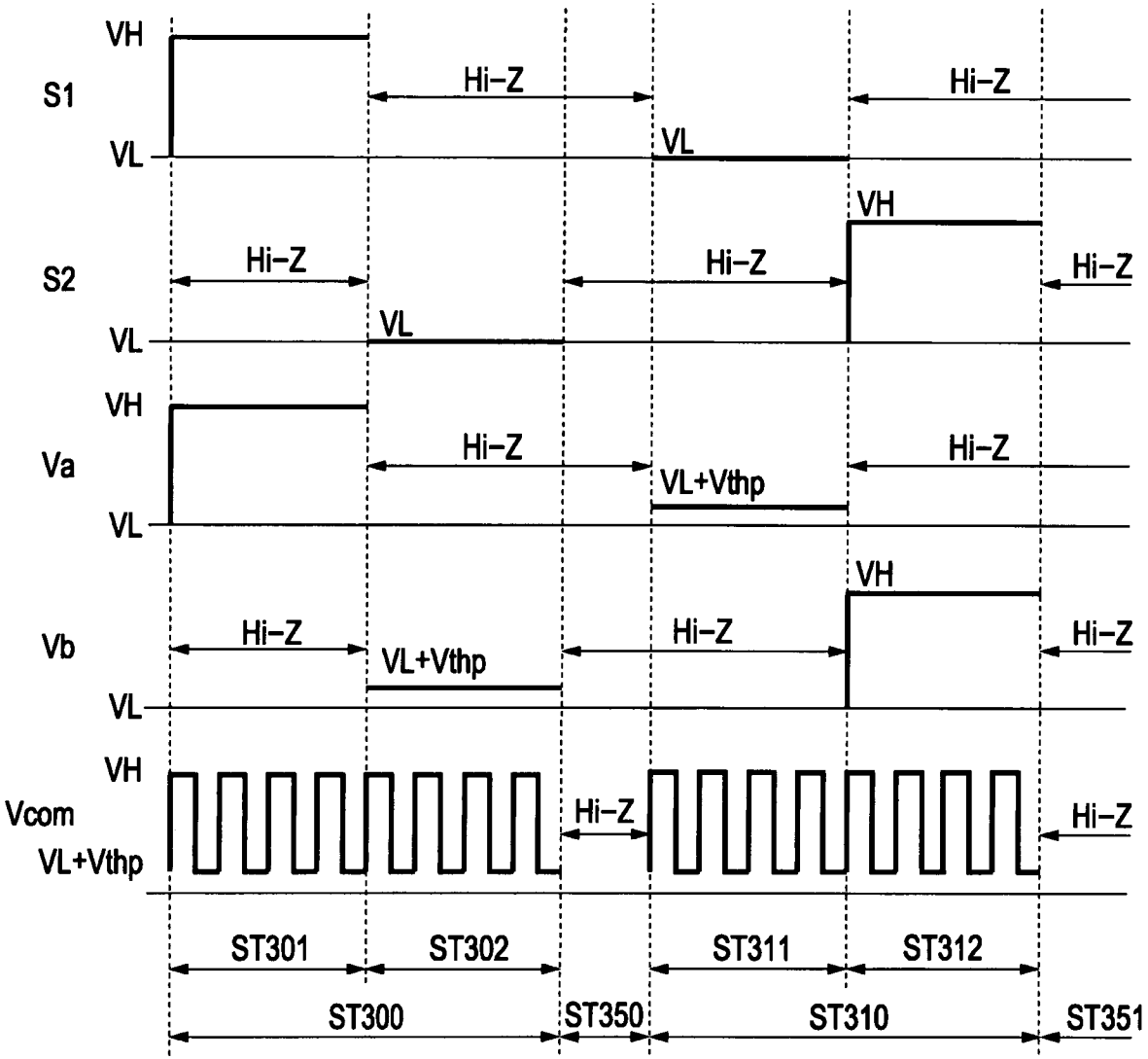
FIG. 44 is a timing chart of an inverted image display according to the third configuration example.
Figure 45:
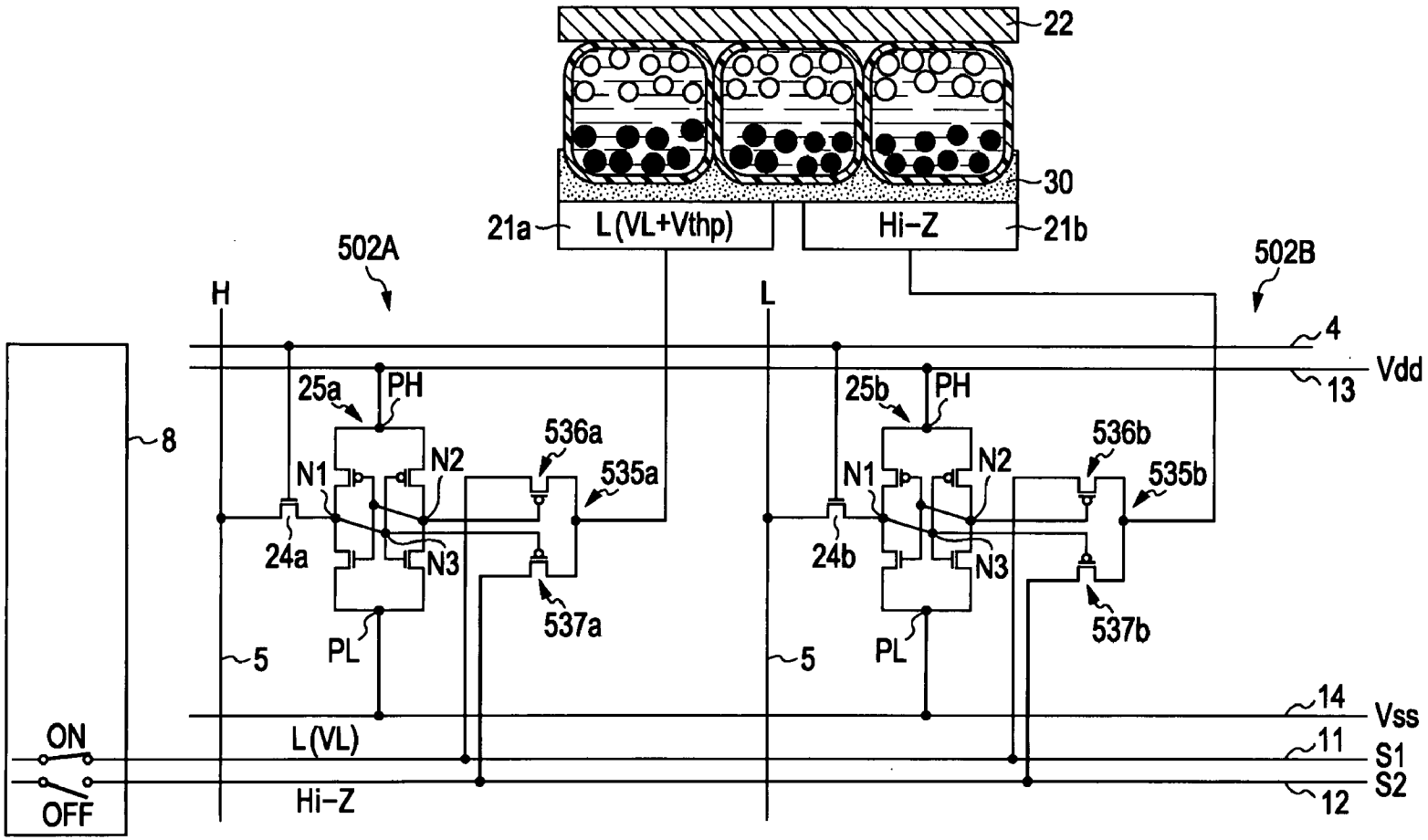
FIG. 45 is a view that shows the state of adjacent pixels in the inverted image display.
Figure 46:
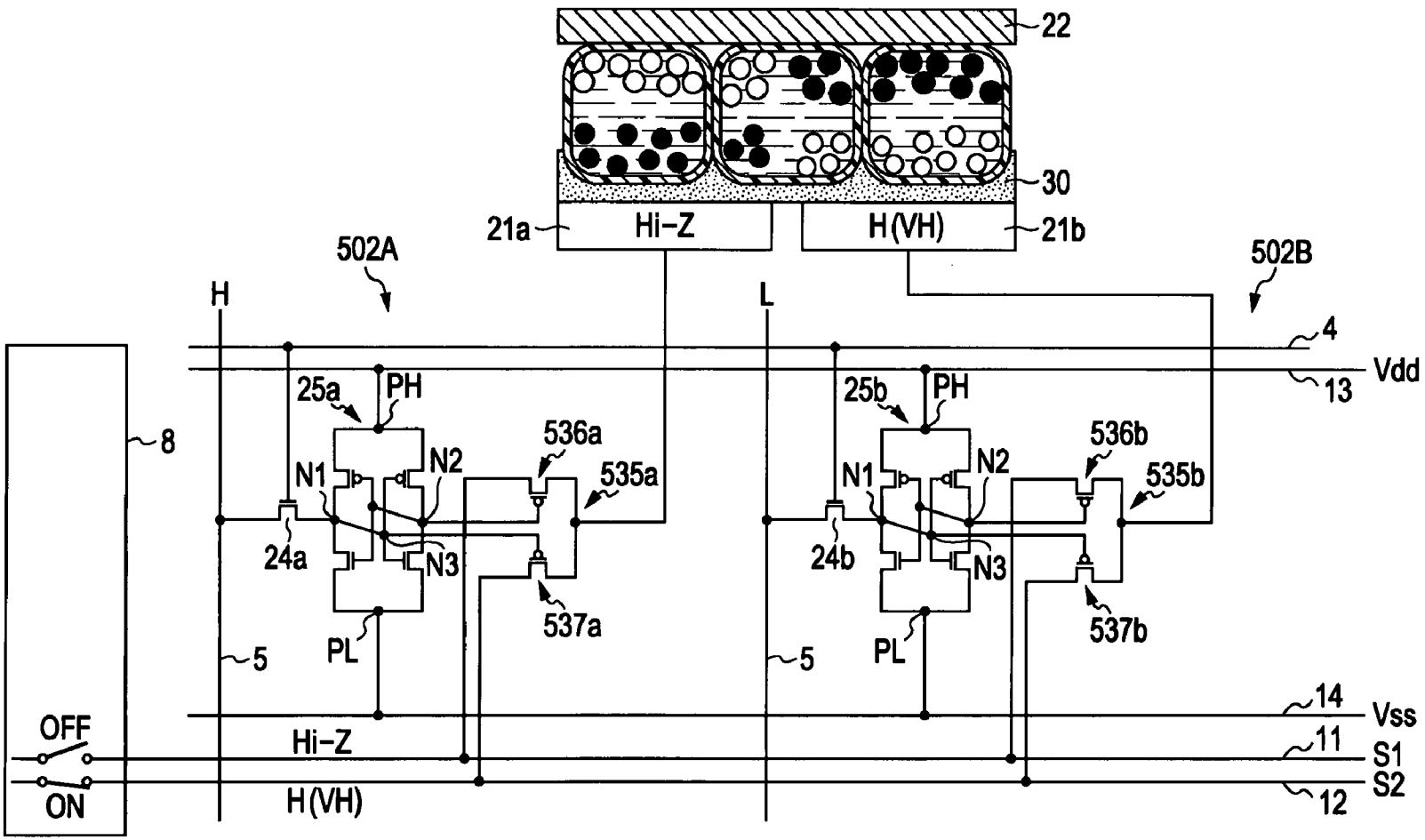
FIG. 46 is a view that shows the state of the adjacent pixels in the inverted image display.

FIG. 44 is a view that shows a timing chart in the inverted image display. FIG. 45 is a view that shows the state of the pixels 502A and 502B in a white color inversion display period ST311 shown in FIG. 44, and FIG. 46 is a view that shows the state of the pixels 502A and 502B in a black color inversion display period ST312 shown in FIG. 44. FIG. 44 shows the normal image display period ST300, the power supply off period ST350, an inverted image display period ST310 and the power supply off period ST351. The inverted image display period ST300 includes the white color inversion display period ST311 and the black color inversion display period ST312.

The operation of the inverted image display in the electrophoretic display device according to the third configuration example is the same as that of the electrophoretic display device according to the above first configuration example. After the above described normal image display period ST300, in a state where the period has proceeded to the power supply off period ST350, the pixel 502A performs black display, and the pixel 502B performs white display.

When the period proceeds from the power supply off period ST350 to the white color inversion display period ST311, the first control line 11 is supplied with a low level electric potential VL, and the second control line 12 is held in a high impedance state. Then, in the pixel 502A, a low level electric potential (VL+Vthp) is input from the first control line 11 through the P-MOS 536*a* to the pixel electrode 21*a*. On the other hand, in the pixel 502B, the pixel electrode 21*b* remains in a high impedance state. In addition, a pulse-like signal that repeats a high level electric potential VH and a low level electric potential (VL+Vthp) at a predetermined interval is input to the common electrode 22. In this manner, the pixel 502A that has been performing black display is inverted from black display to white display.

Next, when the period proceeds to the black color inversion display period ST312, the first control line 11 is made into a high impedance state, and the second control line 12 is supplied with a high level electric potential VH. Then, in the pixel 502A, the pixel electrode 21*a* that is connected through the P-MOS 536*a* to the first control line 11 enters a high impedance state. On the other hand, in the pixel 502B, a high level electric potential VH is input to the pixel electrode 21*b* that is connected through the P-MOS 537*b* to the second control line 12. Because a pulse-like signal is input to the common electrode 22, the pixel 502B that has been performing white display is inverted from white display to black display. At this time, the display of the pixel 502A remains unchanged.

Owing to the above white color inversion display period ST311 and the black color inversion display period ST312, an image that is obtained by inverting the black and white of the image that is displayed in the normal image display period ST300 is displayed. Note that, in the electrophoretic display device of the third configuration example as well, the electric potential input to the pixel electrode 21 differs from the electric potential of the first control line 11 and the electric potential of the second control line 12 because of the characteristics of the P-MOSs 536 and 537. Then, the electric potential of the pulse input to the common electrode 22 is adjusted in conformity to the electric potential of the pixel electrode 21 and, thereby, the occurrence of inconvenience of display is prevented.

In addition, as shown in FIG. 45 and FIG. 46, the second control line 12 is made into a high impedance state in the white color inversion display period ST311, and the first control line 11 is made into a high impedance state in the black color inversion display period ST312, so that at least one of the control lines is electrically disconnected during display operation. Because the leakage path is always interrupted, a leakage current between the adjacent pixels will not be generated.

All White Display

Figure 47:
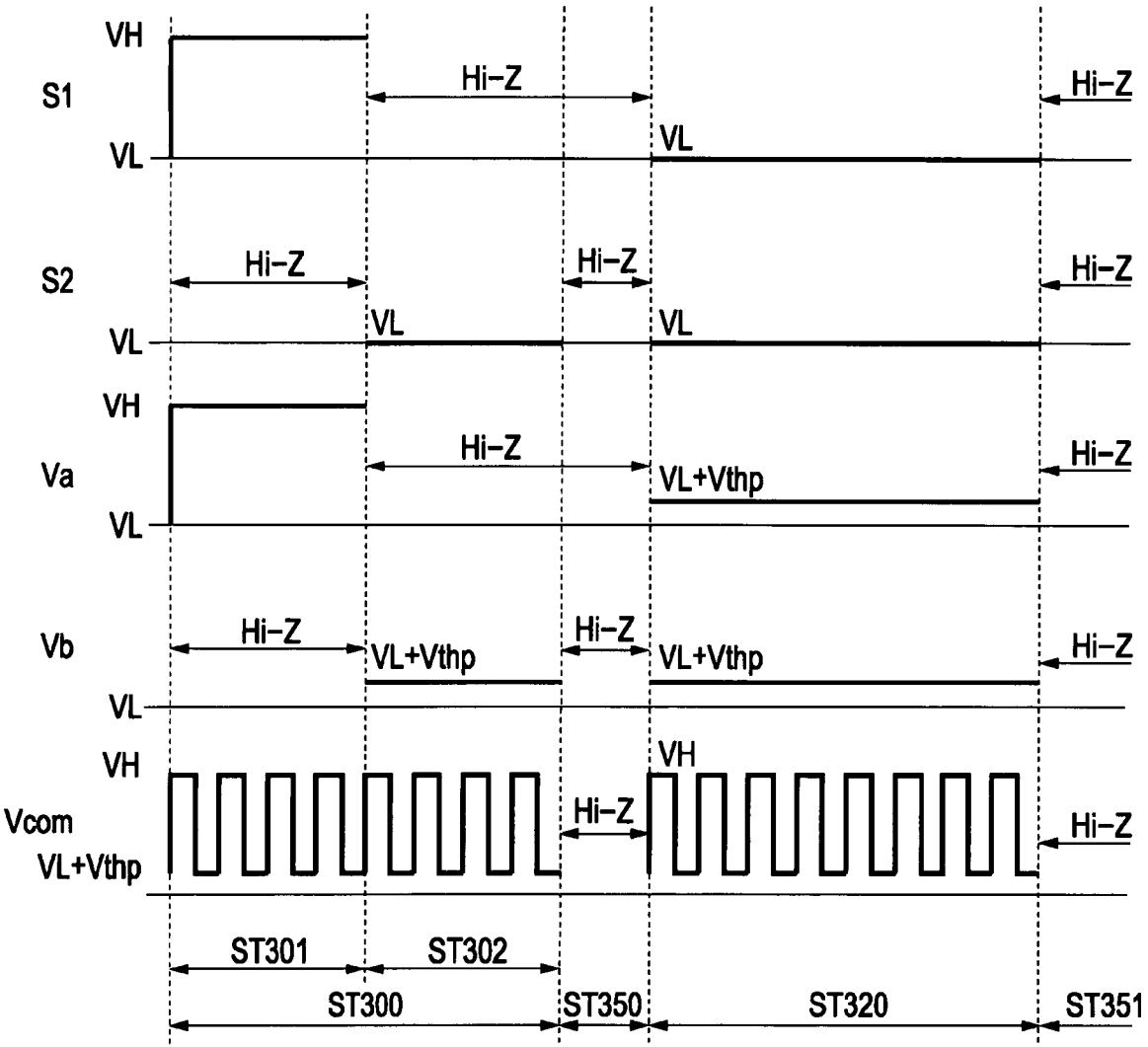
FIG. 47 is a timing chart of an all white display according to the third configuration example.
Figure 48:
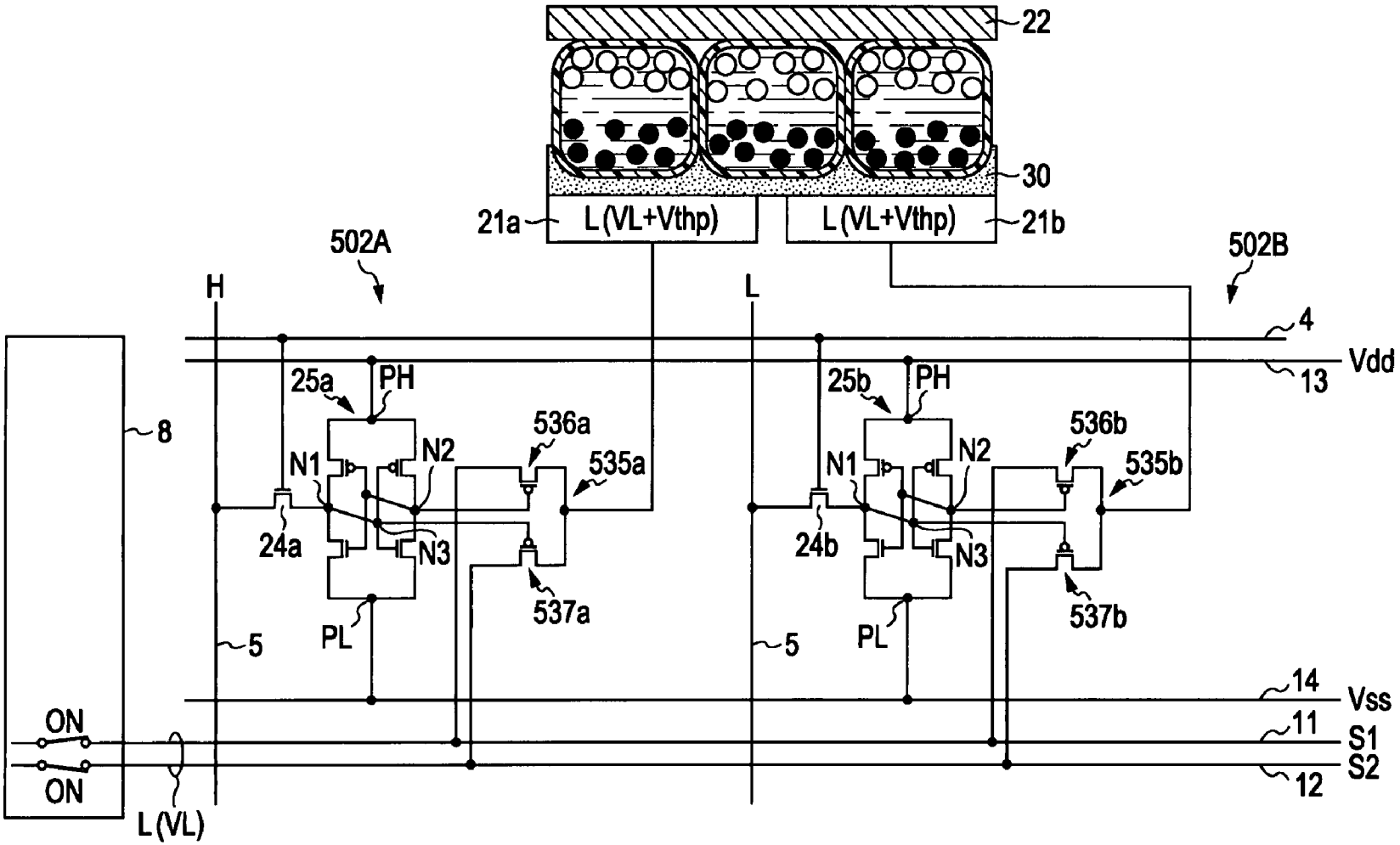
FIG. 48 is a view that shows the state of adjacent pixels in the all white display.

FIG. 47 is a view that shows a timing chart in the all white display. FIG. 48 shows the state of the pixels 502A and 502B in the all white display period ST320 shown in FIG. 47. FIG. 47 shows the normal image display period ST300, the power supply off period ST350, an all white display period ST320 and the power supply off period ST351. That is, FIG. 47 shows a sequence in which, after the normal image display has been performed, a display image is erased by means of all white display.

In the power supply off period ST350 after the normal image display period ST300, the pixel 502A performs black display, and the pixel 502B performs white display. Then, when the period proceeds from the power supply off period ST350 to the all white display period ST320, a low level electric potential VL is supplied to both the first control line 11 and the second control line 12.

In the pixel 502A, the first control line 11 is electrically connected to the pixel electrode 21*a* and, thereby, a low level electric potential (VL+Vthp) is input to the pixel electrode 21*a*. On the other hand, in the pixel 502B, the second control line 12 is electrically connected to the pixel electrode 21*b* and, thereby, a low level electric potential (VL+Vthp) is input to the pixel electrode 21*b*. Then, a pulse-like signal that repeats a period of high level electric potential VH and a period of low level electric potential (VL+Vthp) at a predetermined interval is input to the common electrode 22.

In this manner, in a period during which the common electrode 22 is at a high level electric potential VH, the electrophoretic element 23 is driven on the basis of a difference in electric potential between the pixel electrode 21 and the common electrode 22 and, as a result, the pixel 502A that has been performing black display in the normal image display period ST300 is inverted from black display to white display. In addition, the display of the pixel 502B that originally performs white display remains unchanged, so that all the pixels perform white display.

Note that, in the all white display of the third configuration example, because the low level electric potential input to the pixel electrodes 21*a* and 21*b* is higher than the low level electric potential VL of the first control line 11 and the low level electric potential VL of the second control line 12 by an amount of threshold voltage value Vthp, the low level electric potential of the common electrode 22 is set to (VL+Vthp) to thereby prevent the occurrence of inconvenience of display. In addition, in the all white display of the third configuration example, as shown in FIG. 48, because the pixel electrodes 21*a* and 21*b* are at the same electric potential, a leakage current is not generated between the pixel electrodes.

All Black Display

Figure 49:
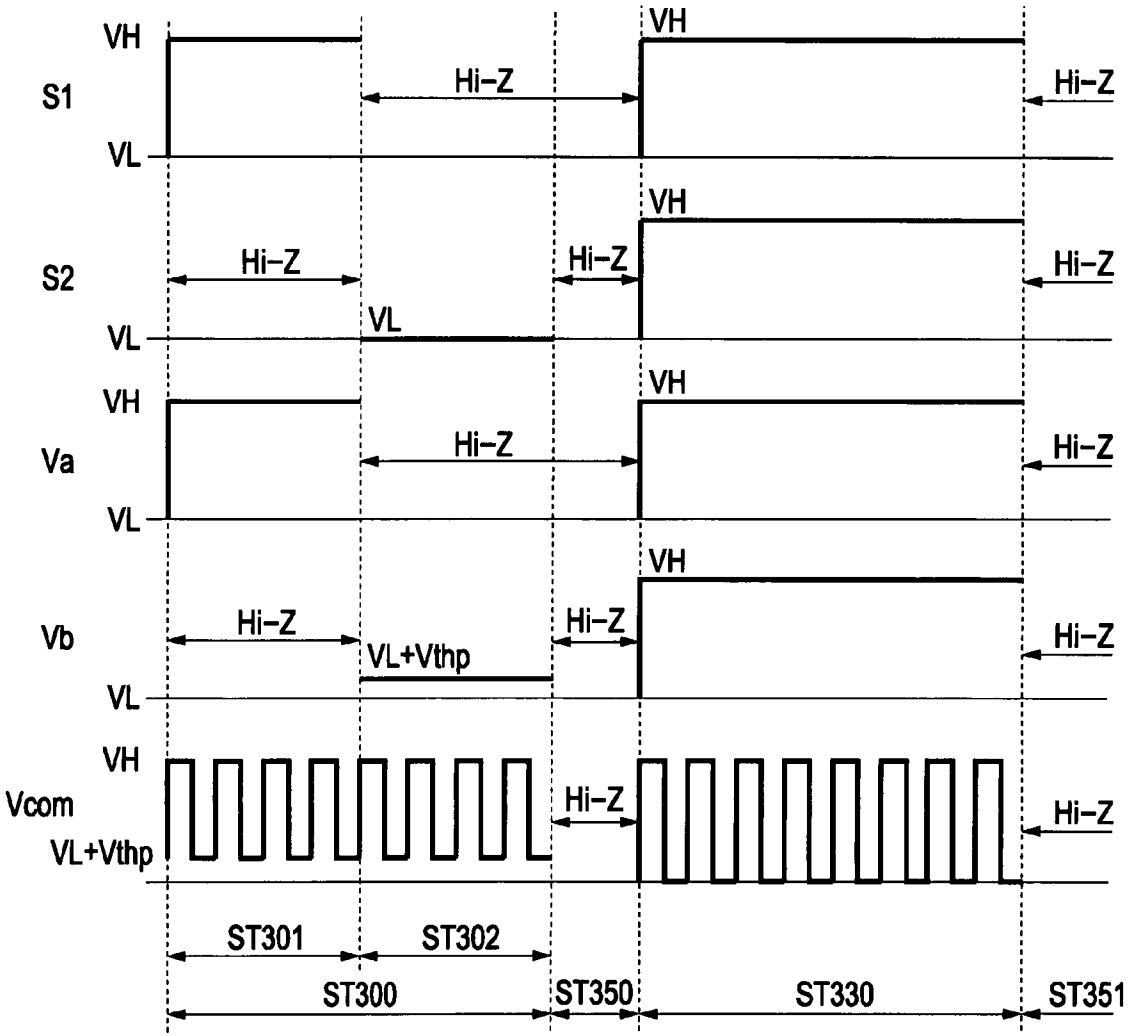
FIG. 49 is a timing chart of an all black display according to the third configuration example.
Figure 50:
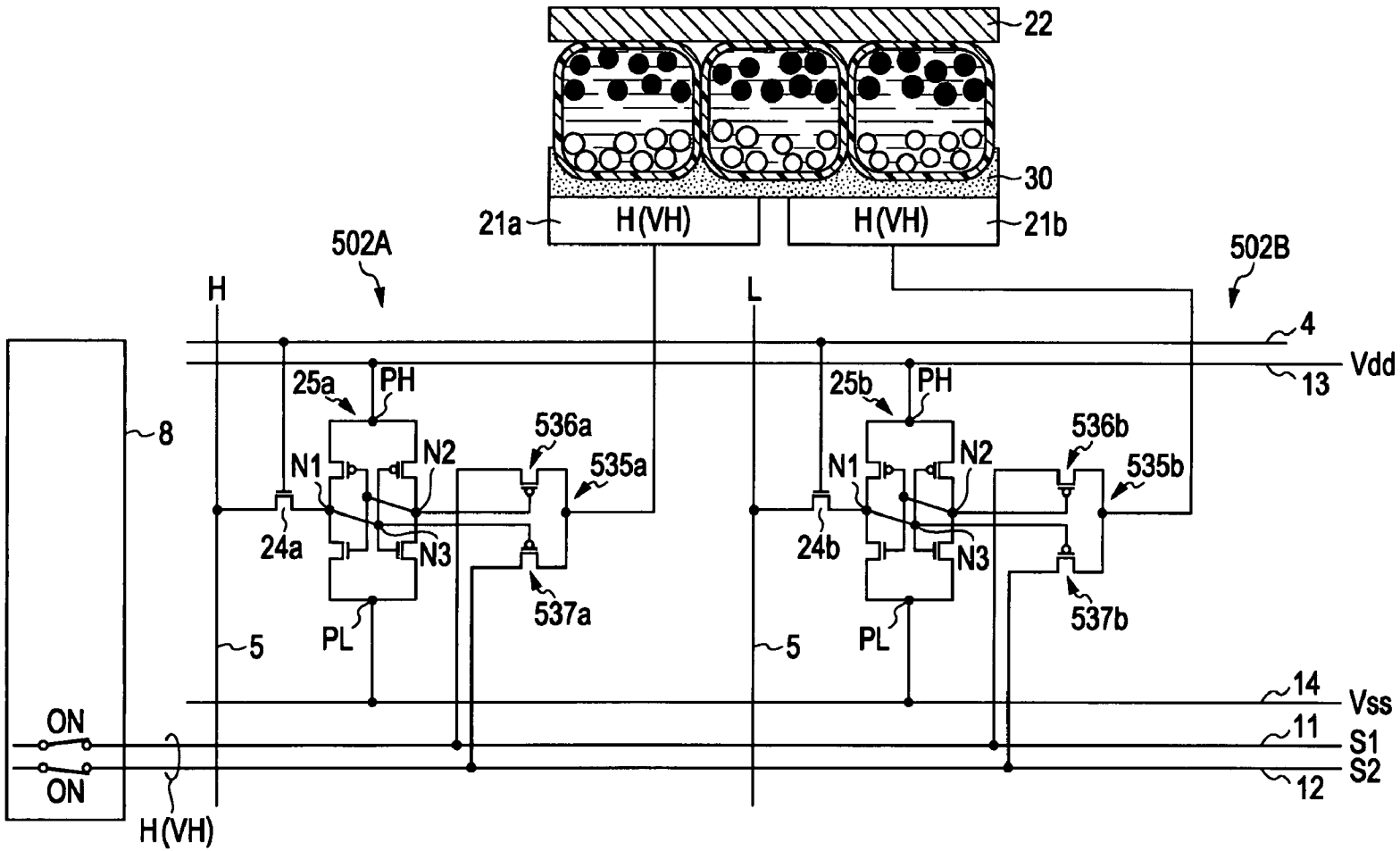
FIG. 50 is a view that shows the state of adjacent pixels in the all black display.

FIG. 49 is a view that shows a timing chart in the all black display. FIG. 50 shows the state of the pixels 502A and 502B in the all black display period ST330 shown in FIG. 49. FIG. 49 shows the normal image display period ST300, the power supply off period ST350, an all black display period ST330 and the power supply off period ST351. That is, FIG. 49 shows a sequence in which, after the normal image display has been performed, a display image is erased by means of all black display.

In the power supply off period ST350 after the normal image display period ST300, the pixel 502A performs black display, and the pixel 502B performs white display. Then, when the period proceeds from the power supply off period ST350 to the all black display period ST330, a high level electric potential VH is supplied to both the first control line 11 and the second control line 12.

In the pixel 502A, the first control line 11 is electrically connected to the pixel electrode 21*a* and, thereby, a high level electric potential VH is input to the pixel electrode 21*a*. On the other hand, in the pixel 502B, the second control line 12 is electrically connected to the pixel electrode 21*b* and, thereby, a high level electric potential VH is input to the pixel electrode 21*b*. Then, a pulse-like signal that repeats a period of high level electric potential VH and a period of low level electric potential VL at a predetermined interval is input to the common electrode 22.

In this manner, in a period during which the common electrode 22 is at a low level electric potential VL, the electrophoretic element 23 is driven on the basis of a difference in electric potential between the pixel electrode 21 and the common electrode 22 and, as a result, the pixel 502B that has been performing white display in the normal image display period ST300 is inverted from white display to black display. In addition, the display of the pixel 502A that originally performs black display remains unchanged, so that all the pixels perform black display. Note that, in the all black display of the third configuration example, as shown in FIG. 50, because the pixel electrodes 21*a* and 21*b* are at the same electric potential, a leakage current is not generated between the pixel electrodes.

As described in detail above, in the electrophoretic display device according to the third configuration example, by providing the switch circuit 535 formed of only two transistors, it is possible to simplify the configuration of a pixel circuit and also possible to reduce an area because of a reduction in the number of transistors in comparison with the pixel 2, shown in FIG. 2, according to the first embodiment. Thus, it is possible to reduce an area per pixel, and, therefore, it is possible to realize an electrophoretic display device that is easily in conformity with high resolution of pixels. In addition, by reducing the number of transistors, it is possible to reduce a parasitic capacitance when an electric current is conducted, so that it is possible to reduce power consumption.

In addition, the inconvenience of display, which may possibly occur because of a reduction in the number of transistors, may also be effectively prevented. That is, the electric potential of the pulse input to the common electrode 22 is adjusted in accordance with a variation in electric potential input to the pixel electrode 21, and, thereby, it is possible to prevent deterioration of display quality due to a reverse electric field being applied to the electrophoretic element.

Electronic Apparatuses

Figure 15:
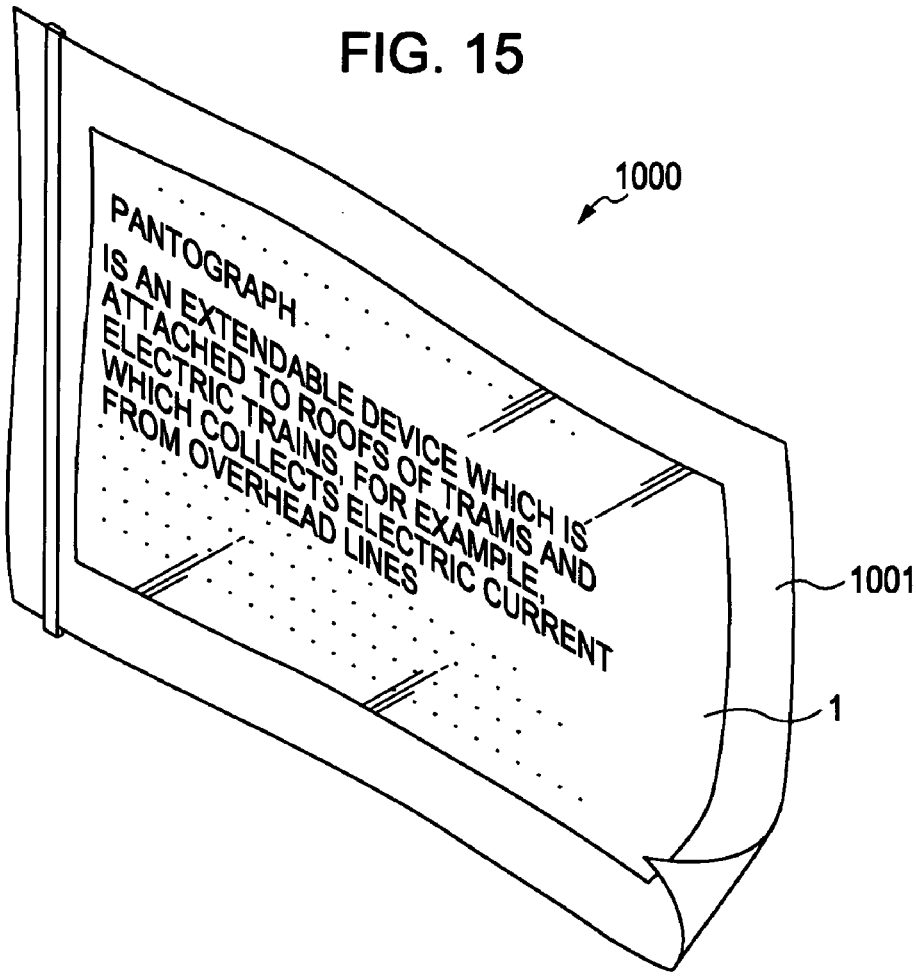
FIG. 15 is a view that shows an example of an electronic apparatus that is provided with an electrophoretic display device according to the aspects of the invention.
Figure 16:
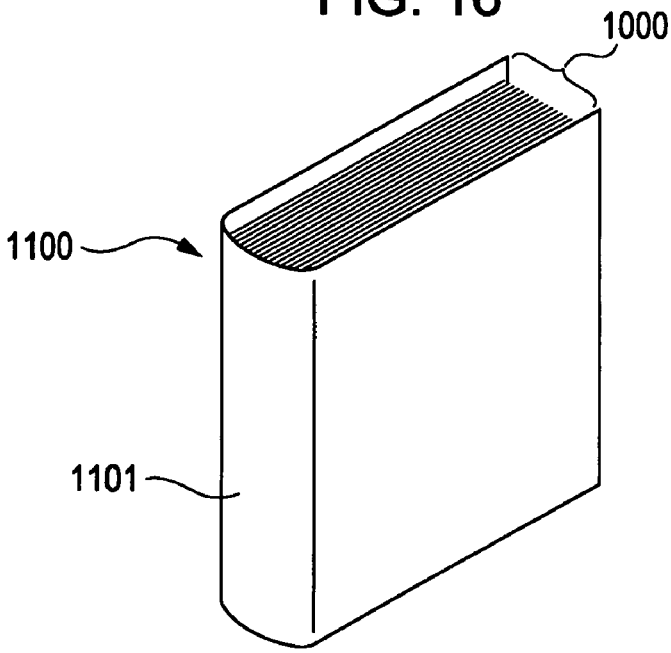
FIG. 16 is a view that shows an example of an electronic apparatus that is provided with an electrophoretic display device according to the aspects of the invention.

FIG. 15 is a view that shows an example of an electronic apparatus that is provided with the electrophoretic display device according to the aspects of the present invention. The above described electrophoretic display device has been applied to various electronic apparatuses, and examples of an electronic apparatus that is provided with the above described electrophoretic display device will be described. First, an example in which the electrophoretic display device according to the aspects of the invention is applied to a flexible electronic paper will be described. FIG. 15 is a perspective view that shows the configuration of the above electronic paper. The electronic paper 1000 includes the electrophoretic display device 1 according to the aspects of the invention as a display portion. The electronic paper 1000 is configured so that the electrophoretic display device 1 according to the aspects of the invention is provided on the surface of a body 1001 that is formed of a flexible sheet having the same texture as the existing paper. FIG. 16 is a perspective view that shows the configuration of an electronic notebook 1100. The electronic notebook 1100 is configured so that the multiple sheets of electronic paper 1000 shown in FIG. 15 are bound and fastened with a cover 1101. The cover 1101 is provided with a display data input device (not shown) that is used to input display data sent from, for example, an external device. In this manner, in accordance with the display data, while the sheets of electronic paper 1000 are fastened, it is possible to change or update the display content. In addition, the electronic apparatus may include, in addition to the above examples, a liquid crystal display television, a viewfinder type or a direct view type video tape recorder, a car navigation system, a pager, a personal organizer, an electronic calculator, a word processor, a workstation, a video telephone, a point-of-sales terminal, devices provided with a touch panel, and the like, as other examples. The electrophoretic display device according to the aspects of the invention may be applied as the display portion of the above electronic apparatuses. By providing the electrophoretic display device according to the aspects of the invention as the display portion, it is possible to suppress the occurrence of a leakage current between the adjacent pixels. Thus, it is possible to reduce power consumption and achieve an electronic apparatus that improves reliability. In addition, when an electronic apparatus is provided with the electrophoretic display device according to the second embodiment, it is possible to reduce the size of one pixel. Thus, the electronic apparatus includes a high-definition display portion.

What is claimed is:

1. A method of driving an electrophoretic display device that is provided with a pair of substrates, an electrophoretic element that includes electrophoretic particles and that is held between the pair of substrates, and a display portion formed of a plurality of pixels, wherein the display portion includes pixel electrodes, an opposite electrode, a first control line, and a second control line, wherein each of the pixel electrodes is formed in each of the pixels, wherein the opposite electrode is opposed to the plurality of pixel electrodes through the electrophoretic element, wherein the first control line and the second control line are connected to each of the pixels, wherein each of the pixels includes a pixel switching element, an electric potential control portion that is connected to each of the pixels through the first control line, the second control line, and the opposite electrode, a memory circuit, and a switch circuit, wherein the memory circuit is connected to the pixel switching element, wherein the switch circuit is connected between the memory circuit and the pixel electrode and is connected to the first control line and the second control line, the driving method comprising: inputting an image signal through the corresponding pixel switching element to each of the memory circuits; supplying a first electric potential and a second electric potential respectively to the first control line and the second control line; inputting an electric potential from the first control line or the second control line by operating each of the switch circuits on the basis of an output from the corresponding memory circuit; and inputting a rectangular wave that has more than one cycle and that repeats the first electric potential and the second electric potential to the opposite electrode: wherein: a first image signal is input to the memory circuit of each pixel that displays a first gray scale, and a second image signal is input to the memory circuit of each pixel that displays a second gray scale, in each pixel that displays the first gray scale, the first control line and the pixel circuit are made into a connected state by operating the switch circuit on the basis of an output from the memory circuit that holds the first image signal, in each pixel that displays the second gray scale, the second control line and the pixel electrode are made into a connected state by operating the switch circuit on the basis of an output from the memory circuit that holds the second image signal, the first control line is made into a high impedance state by the electric potential control portion such that the first control line is electrically disconnected and the second control line is supplied with the second electric potential to thereby change at least a portion of the pixels of the display portion from the first gray scale to the second gray scale, and the first control line is supplied with the first electric potential and the second control line is made into a high impedance state by the electric potential control portion such that the second control line is electrically disconnected to thereby change at least a portion of the pixels of the display portion from the second gray scale to the first gray scale, and the first control line is connected to a source side of a first transistor of the switch circuit and the second control line is connected to a source side of a second transistor of the switch circuit.

2. The driving method according to claim 1, wherein a display image is updated by repeating the operation in which the at least portion of the pixels of the display portion are changed from the first gray scale to the second gray scale and the operation in which the at least portion of the pixels of the display portion are changed from the second gray scale to the first gray scale.

3. The driving method according to claim 1, wherein between the operation in which the at least portion of the pixels of the display portion are changed from the first gray scale to the second gray scale and the operation in which the at least portion of the pixels of the display portion are changed from the second gray scale to the first gray scale, the first control line and the second control line are made into a high impedance state where the first control line and the second control line are electrically disconnected.

4. The driving method according to claim 1, wherein after the rectangular wave that repeats the first electric potential and the second electric potential and that has more than one cycle has been input to the opposite electrode, each of the memory circuits, each of the switch circuits and the opposite electrode are made into a high impedance state where each of the memory circuits, each of the switch circuits and the opposite electrode are electrically disconnected.

5. An electrophoretic display device comprising a control portion that executes the driving method according to claim 1.

6. An electronic apparatus comprising the electrophoretic display device according to claim 5.

* * * * *